US007194224B2

(12) United States Patent
Niimi et al.

(10) Patent No.: US 7,194,224 B2
(45) Date of Patent: Mar. 20, 2007

(54) IMAGE FORMING APPARATUS, IMAGE FORMING PROCESS, AND PROCESS CARTRIDGE

(75) Inventors: Tatsuya Niimi, Shizuoka (JP); Masami Kadonaga, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 69 days.

(21) Appl. No.: 10/927,050

(22) Filed: Aug. 27, 2004

(65) Prior Publication Data

US 2005/0084287 A1 Apr. 21, 2005

(30) Foreign Application Priority Data

Aug. 28, 2003 (JP) ..... 2003-304270
May 13, 2004 (JP) ..... 2004-143117

(51) Int. Cl.
*G03G 21/16* (2006.01)

(52) U.S. Cl. ..... 399/111; 399/115; 399/168

(58) Field of Classification Search ..... 399/111, 399/115, 168, 170, 172, 128
See application file for complete search history.

(56) References Cited

U.S. PATENT DOCUMENTS 5,270,740 A 12/1993 Naruse et al.
5,359,350 A 10/1994 Nakano et al.
5,389,962 A 2/1995 Sekiya et al.
5,412,413 A 5/1995 Sekiya et al.
5,420,618 A 5/1995 Sekiya et al.
5,547,790 A 8/1996 Umeda et al.
5,600,356 A 2/1997 Sekiya et al.
5,677,094 A 10/1997 Umeda et al.
5,804,343 A 9/1998 Umeda et al.
5,853,935 A 12/1998 Suzuki et al.
5,871,876 A 2/1999 Ikuno et al.
5,955,228 A 9/1999 Sakai et al.
6,087,055 A 7/2000 Niimi (Continued)

FOREIGN PATENT DOCUMENTS

JP 52-36016 3/1977

(Continued)

*Primary Examiner*—David M. Gray
*Assistant Examiner*—Laura K Roth
(74) *Attorney, Agent, or Firm*—Oblon, Spivak, McClelland, Maier & Neustadt, P.C.

(57) ABSTRACT

The present invention relates to an image forming apparatus, an image forming process and a process cartridge, in which the image quality and the durability of the photoconductor may be enhanced, images may be formed stably even after the repeated usages, and higher quality and higher stability of images may be established due to the superimposed alternating voltage as well as decrease of the charging hazard on the photoconductor. Specifically, the image forming apparatus according to the present invention comprises a photoconductor, latent electrostatic image forming unit, developing unit a transferring unit, and fixing unit, wherein the charging member is of roller shape disposed proximate to the photoconductor, the photoconductor is charged at the charging nip portion formed between the photoconductor and the charging member, in a condition that satisfies the following Equation:

$$4.4\times10^{14} \leqq [(\text{Number of Charged Particles})\div(\text{Circumferential length of the photoconductor})] \leqq 17.7\times10^{14}$$

wherein the "Number of Charged Particles" refers to the number of charged particles accepted by the photoconductor surface per its unit surface area from the operated charging member, while the photoconductor rotates one round, thus the unit is [number/$m^2$]; and the unit of "Circumferential length of the photoconductor" is [mm].

44 Claims, 20 Drawing Sheets

U.S. PATENT DOCUMENTS

| | | | |
|---|---|---|---|
| 6,132,911 | A | 10/2000 | Niimi |
| 6,157,795 | A | 12/2000 | Kadonaga et al. |
| 6,218,533 | B1 | 4/2001 | Niimi |
| 6,326,112 | B1 | 12/2001 | Tamura et al. |
| 6,449,449 | B1 | 9/2002 | Kadonaga |
| 6,492,079 | B2 | 12/2002 | Shimada et al. |
| 6,516,169 | B2 | 2/2003 | Niimi et al. |
| 6,558,863 | B2 | 5/2003 | Rokutanzono et al. |
| 6,562,531 | B2 | 5/2003 | Niimi |
| 6,573,016 | B2 | 6/2003 | Kami et al. |
| 6,576,388 | B2 | 6/2003 | Sakon et al. |
| 6,641,964 | B2 | 11/2003 | Ikuno et al. |
| 6,653,033 | B1 | 11/2003 | Kami et al. |
| 6,677,091 | B2 | 1/2004 | Niimi |
| 6,757,507 | B2 | 6/2004 | Mochizuki et al. |
| 6,790,572 | B2 | 9/2004 | Tamoto et al. |
| 6,803,162 | B2 | 10/2004 | Niimi |
| 2002/0181971 | A1* | 12/2002 | Mochizuki et al. |
| 2003/0002078 | A1 | 1/2003 | Toda et al. |
| 2003/0021618 | A1* | 1/2003 | Ogara et al. |
| 2003/0044201 | A1* | 3/2003 | Kosuge |
| 2003/0073015 | A1* | 4/2003 | Tamoto et al. |
| 2003/0113642 | A1 | 6/2003 | Kami et al. |
| 2003/0138718 | A1 | 7/2003 | Yagi et al. |
| 2004/0033428 | A1 | 2/2004 | Niimi |
| 2004/0048178 | A1 | 3/2004 | Ikuno et al. |
| 2004/0053149 | A1 | 3/2004 | Toda et al. |
| 2004/0120730 | A1 | 6/2004 | Niimi et al. |
| 2004/0126686 | A1 | 7/2004 | Toda et al. |

FOREIGN PATENT DOCUMENTS

| | | |
|---|---|---|
| JP | 3-109406 | 5/1991 |
| JP | 5-27556 | 2/1993 |
| JP | 5-94049 | 4/1993 |
| JP | 5-113688 | 5/1993 |
| JP | 5-150564 | 6/1993 |
| JP | 2000-206723 | 7/2000 |
| JP | 2001-19871 | 1/2001 |
| JP | 2001-33502 | 2/2001 |
| JP | 2001-34001 | 2/2001 |
| JP | 2001-109235 | 4/2001 |
| JP | 2001-109238 | 4/2001 |
| JP | 2001-188403 | 7/2001 |
| JP | 2002-55508 | 2/2002 |
| JP | 2002-55512 | 2/2002 |
| JP | 2002-148904 | 5/2002 |
| JP | 2002-148905 | 5/2002 |
| JP | 2002-156877 | 5/2002 |
| JP | 2002-214888 | 7/2002 |
| JP | 2002/229241 | 8/2002 |
| JP | 2002-244516 | 8/2002 |

* cited by examiner

IMAGE FORMING APPARATUS, IMAGE FORMING PROCESS, AND PROCESS CARTRIDGE

BACKGROUND OF THE INVENTION

1. Field of the Invention

The present invention relates to an image forming apparatus, an image forming process and a process cartridge, in which an alternating voltage is superimposed on a direct voltage and the voltage is applied to a charging member of roller-shape disposed proximity to a photoconductor, then the photoconductor is charged and an image is formed. More specifically, the present invention relates to an image forming apparatus, an image forming process and a process cartridge, in which the image quality and the durability of the photoconductor may be enhanced, images may be formed stably even after the repeated usages, and higher quality and higher stability of images may be established due to the superimposed alternating voltage as well as decrease of the charging hazard on the photoconductor.

2. Description of the Related Art

An image forming apparatus is typically constituted from a photoconductor (hereinafter, sometimes referring to "electrophotographic photoconductor" or "latent electrostatic image bearing unit"), charging unit, exposing unit (writing unit), developing unit, transferring unit, and fixing unit that fixes a toner transferred to a transferring paper, those units are usually disposed around the photoconductor. In addition, the image forming apparatus may be equipped with a cleaning member that cleans the toner remaining on the un-transferring photoconductor surface, and a charge-eliminating member to chancel the remaining charge at the exposing part of the photoconductor.

As for the charging member of such a image forming apparatus, charger of wire-like shape, charger of blade-like shape, charger of brush-like shape, charger of roller-like shape and so on may be exemplified. Among these, the chargers of corotron-type and scorotron-type are simple and convenient; in particular the chargers of corotron-type have been employed previously for a large number of apparatuses, since the charging is stable even at negative polarity that is the charging polarity of organic photoconductors. However, such problems have arisen that the generation of acidic gas (ozone gas, NOx, etc.) associated with the charging deteriorates the environment in use of the image forming apparatus, and degrades chemically the organic photoconductor mounted in the apparatus; therefore, the evacuation from the apparatus and/or the ventilation around the photoconductor is demanded, resulting in the gradual decrease of the market, except a part of higher speed apparatus or apparatus with larger diameter photoconductor. Further, the involvement of charger imposes to assure a space of a few millimeter between the photoconductor surface and the charger, and to utilize a power supply with larger capacity. Accordingly, the resultant apparatus is likely to become more expensive and larger size, these are factors to be avoided the employment of the charger.

By the way, in contact-charging members such as a charging blade, charging brush, charging roller and the like, wherein the photoconductor and charging member contact so as to charge the photoconductor, the generation of acidic gas is reduced and the capacity of the power supply is relatively small; therefore, the contact-charging members have been mainly employed for small size apparatuses. In particular, in the charging roller of roller-shape, the position may be adjusted by merely rotating in co-rotating direction or reverse-rotating direction in some case while contacting with the photoconductor, and the surface area is relatively wide compared to the charging blade and the like since the roller is utilized in rotating motion, therefore, the durability is relatively high. Accordingly, it is estimated that the majority of the charging members employed in the image forming apparatus are such charging rollers at present.

Such charging members of contacting type are disposed in a condition that the photoconductor and the charging member contact each other. Herein, the charging is caused essentially by a charging phenomenon from the charging member to the photoconductor. When the resistances of the charging member and the photoconductor surface are considerably low, the charging may be possibly introduced at the contacting area; however, the limitations in use are remarkable and the controlling is significantly difficult in general, since problems such as image flow are possibly induced due to the repeated usages when the resistance of photoconductor surface is low. Therefore, the resistance of the photoconductor is usually made larger such as at least $10^{10}$ Ω·cm or more such that the movement or diffusion of charge in horizontal direction is avoided at the photoconductor surface. In the image recording apparatus designed in such charging mechanism, the charging roller and the photoconductor do not contact each other, i.e. the contacting area does not exist, the charging phenomenon is induced at a significantly narrow gap of no more than 100 μm or so, consequently the photoconductor is subjected to charging.

Such charging at a narrow gap may be conducted referring to Bassen's discharging property in the usual range of photoconductor thickness. Therefore, the voltage at the photoconductor surface does not rise from zero volt even though a voltage is applied to the roller as applied bias, when the charging is only due to direct component (hereinafter, sometimes referring to "DC charging"); the photoconductor is subjected to charging when a voltage is applied at higher level than the discharge-initiating voltage. When the voltage is applied at higher than the discharge-initiating voltage, the surface voltage of the photoconductor exhibits a linear relation with the applied voltage and the slope of the relation is about one. However, in the case that the charging is conducted solely by direct component, the charging nonuniformity such as dot-like or band-like irregularity is often recognized when the developing is carried out in conventional way.

Japanese Patent Application Laid-Open (JP-A) No. 5-27556, for example, discloses that an alternating voltage of which the voltage between the peaks is more than two times of the discharge-initiating voltage in DC charging is superimposed duplicately, thereby the charging nonuniformity may be reduced.

The charging superimposed with the alternating voltage (hereinafter, sometimes referring to "AC charging") may improve charging uniformity on the photoconductor compared to DC charging. However, such a problem exists that the abrasion wear of the photoconductor is significant in a practical condition, the durability of the photoconductor is decreased, and the confidence of the image forming apparatus is also decreased. As such, the charging uniformity on the photoconductor and the prolonged life of the photoconductor display a trade-off relation each other, it is significantly difficult to enhance the image quality produced by the image forming apparatus as well as to make more durable and stable the image forming apparatus.

On the other hand, the charging roller is utilized normally in contact with the photoconductor so as to make easy and simple to adjust the position of the charging rollers. When the remaining transferring toner exists on the photoconductor and occasionally the remaining toner exists after cleaning, these remaining toner is transferred to the surface of the charging roller thereby the roller is smeared, resulting in inferior charging. Further, when the toner smears the charging rollers, the surfaces of rollers may cause damages such as crazings, resulting in shortened life of charging rollers.

In light of these problems, a non-contact charging member is proposed, in which the surface of the photoconductor and the surface of the charging member are disposed in a close position. The non-contact charging member and the photoconductor are disposed in a separated condition such that a gap of 200 μm or less exists between the surface of the charging member and the surface of the photoconductor. JP-A No. 2001-188403, No. 2002-55508, No. 2002-148904, and No. 2002-148905 disclose the related technology.

In the non-contact charging member, it is necessary that an alternating voltage is superimposed on the direct voltage in order to stabilize the charging property on photoconductor or to make uniform the charging. The alternating voltage contribute to enhance the charging uniformity on the photoconductor compared to DC charging. However, such a problem also exists that the abrasion wear of the photoconductor is significant in a practical condition, the durability of the photoconductor is decreased, and the confidence of the image forming apparatus is also decreased. As such, the charging uniformity on the photoconductor and the prolonged life of the photoconductor display a trade-off relation each other, it is also significantly difficult to enhance the image quality produced by the image forming apparatus as well as to make more durable and stable the image forming apparatus.

In order to assure the charging uniformity of charging member when an AC charging is employed, such AC charging conditions as voltage between peaks (hereinafter, sometimes referring to "Vpp"), frequency, offset voltage of DC component (hereinafter, sometimes referring to "Vdc") are controlled independently.

JP-A No. 5-27556, No. 2001-109235, and No. 2001-109238, for example, describe that Vpp is superimposed on the direct component at charging in a level of two times or more of charge-initiating voltage, thereby the charging of the photoconductor is stabilized.

JP-A No. 5-150564 and No. 2002-55512 describe that an alternating voltage is applied of which the frequency depends on the linear velocity of the photoconductor, thereby the charging is stabilized or uniformed.

As explained above, AC charging has been concerned to the charging uniformity on the photoconductor, and a charging hazard has hardly been considered with respect to AC charging.

JP-A No. 2002-214888 describes that the image deletion and the photoconductor wear may be decreased owing to controlling Vpp and controlling the charging current. However, the controlling is insufficient since the current measurements are difficult when the individual AC conditions are fluctuated such as the frequency is lower or the linear velocity is remarkably higher.

As explained above, the way to determine the charging conditions in order to assure the charging uniformity on the photoconductor and to decrease the charging hazard on the photoconductor, and also the achievement of image forming apparatus that produces images stably with high quality even after the repeated usages have been demanded.

On the other hand, JP-A No. 2001-33502 discloses an analysis of the charging condition between a charging member of roller-like shape and a photoconductor. In the analysis, the charging condition such as charging voltage on the photoconductor may be determined through a simulation of charging phenomena considering the shapes of charging member and photoconductor, physical values, and process conditions such as the applied bias and linear velocity of photoconductor, without the actual preparation of charging member or photoconductor or without carrying out the charging experiment.

However, the proposal was provided in order to manage the uniform charging on the photoconductor at the initial stage or virgin condition; i.e. the proposal does not concern to the degradation due to the repeated usage of the photoconductor in the image forming apparatus.

As explained above, such technology is still required that affords to simulate or decrease the charging hazard on the photoconductor even in the repeated usage of the photoconductor, and also that resolves the trade-off with the charging uniformity.

JP-A No. 2002-156877 discloses an image forming apparatus comprising a charging member that may charge a photoconductor through AC superimposed voltage, and a device that may coat an insulating material on the surface of photoconductor. The application concerns the problem that AC superimposed charging activates the surface of the photoconductor, the adhesive property of the photoconductor surface is raised, thereby the adhesion of toner additives is promoted, resulting in the shortening of the photoconductor life.

Although the application proposes the use of insulating material, when the insulating material is coated on the photoconductor and the charging hazard due to the charging member is lower, the performance of the photoconductor is deteriorated, resulting in adverse effects such as image blur. On the contrary, when the charging hazard is excessively large, the insulating material may degrade itself on the photoconductor, resulting in unstable coated quantity of insulating material. Further, the degraded insulating material may effect adversely on the photoconductor and the formed images, the control is not necessarily easy.

JP-A No. 2002-244516 discloses an image forming apparatus comprising a charging member that charges a photoconductor by AC superimposed voltage, and a unit for coating lubricant on the photoconductor surface. The proposal may prevent the filming or adhesion of toner on the photoconductor; however, the adverse effects of lubricant addition to the photoconductor surface and degradation of the lubricant may not be avoided, unless controlling the quantity of the charging hazard.

JP-A No. 2002-229241 discloses an image forming process in which a charging member applies charging on a photoconductor through AC superimposed voltage, lubricant is applied on the photoconductor surface, and the frequency of AC is 100 Hz to 2.5 kHz. The purpose of the application is also to remove adhered materials on the photoconductor surface essentially, and is not to decrease the charging hazard on the photoconductor. As explained later, specifying the AC frequency may not specify the charging hazard. In this proposal also, the adverse effects of lubricant addition to the photoconductor surface and degradation of the lubricant may not be avoided, unless controlling the quantity of the charging hazard.

JP-A No. 2002-156877, No. 2002-244516, and No. 2002-229241 disclose proposals in which cleaning ability of toner and toner additives is enhanced at the cleaning unit, thereby the toner and toner additives may be removed by the cleaning member. However, if the removal is possible, the abrasion wear of the photoconductor is higher; if the removal is not sufficient, the adverse effects are significant unless controlling the quantity of the charging hazard as explained above.

The charging uniformity on the photoconductor is one of the most important properties in charging the photoconductor by a charging roller. As for the factors with respect to the charging roller for the purpose of controlling the charging uniformity, the followings may be listed: the construction of charging roller such as layer thickness of the charging roller, the material of layer, and the like; roller diameter, bias applied to the roller such as Vpp, frequency, Vdc, and the like; gap between the charging roller and photoconductor, and the like. Further, as for the factors with respect to the photoconductor, the followings may be listed: process speed or linear speed of the photoconductor, photoconductor diameter, layer thickness, resistance of layer, dielectric constant of layer.

Thus, according to an orthodox approach, these factors are independently controlled, the charging roller and photoconductor are prepared experimentally and mounted to an actual image forming apparatus or experimental apparatus, then charging quantity on the photoconductor and surface potential are investigated according to necessities. Further, in order to investigate the adverse effect such as increased abrasion wear of the photoconductor as above explained, a running test including alternation with time is required in addition to the test of initial properties in terms of charging. Accordingly, time consuming and expensive laboratories are necessary in order to achieve the charging member or charging condition adapted to the image forming apparatus.

SUMMARY OF THE INVENTION

The object of the present invention to provide an image forming apparatus, an image forming process and a process cartridge, in which the charging hazard is controlled under repeated usage of the photoconductor, the charging uniformity is maintained, the abrasion wear of the photoconductor is reduced, and images may be formed stably even under repeated usage.

We have investigated and achieved the results with respect to the above noted problems as follows:

When the photoconductor is subjected to charging by means of a charging member of roller-like shape, the superimposed AC may improve the charging uniformity. In the charging process, the photoconductor takes place abrasion wear in higher rate while the repeated usage compared to DC charging as known previously. However, the reason has not been understood sufficiently.

Then, we examined the effect of the AC charging factors such as Vpp, frequency, Vdc and the like on the abrasion wear of the photoconductor, in a condition that the charging member and the photoconductor were fixed, and the factors were varied independently. The results are summarized in FIGS. 1 to 3. The results show that the respective factors effect the abrasion wear as independent factors, although the effects are somewhat different each other.

In addition, the effect of the gap between the charging member and the photoconductor was examined in non-contacting proximate charging, while alternating the gap as a variable factor. The results are summarized in FIG. 4. In this experiment also, the factor is found to affect significantly the abrasion wear of the photoconductor.

These results demonstrates that the independent alternations in the AC charging condition in order to stabilize uniform charging in the prior art have changed the abrasion wear of the photoconductor due to alternating the respective factors. Thus, the durability of the image forming apparatus may not be controlled in terms of the system of image forming apparatus; it is shown that the process to control the abrasion wear of photoconductor is necessary when the factors are altered independently or simultaneously.

Then, we investigated the mechanism and/or reason why the abrasion wear of photoconductor in AC charging is more than that in DC charging.

It is known that the wearing of the photoconductor in the image forming apparatus is caused mainly by mechanical stress due to a cleaning member. Various countermeasures have been made for the stress through constructing variously the surface layer such as charge-transporting layer or surface-protective layer of the photoconductor; for example, increasing the molecular weight of the binder resin to promote the entanglement of backbone, using the cross-linking polymer to suppress the defect of molecular chain, using polymer as charge-transporting material to decrease lower molecular weight components as low as possible, and using filler to enhance the mechanical strength. However, these countermeasures are designed on condition that the material employed at the surface layer does not undergo the changes of structure and/or composition even after the repeated usage.

Therefore, we have conducted chemical analysis with regard to the degradation in AC charging of the surface layer of photoconductor. As a result, we have found the fact that the photoconductor after the application of charging hazard exhibits higher chemical degradation in the surface compared to that of initial condition of the photoconductor, specifically, (i) the molecular weight of the binder resin at the surface layer decreases, (ii) the molecular chain is cut and organic carboxylic acid is formed, (iii) the degree of chemical degradation is higher in AC charging compared to DC charging, (iv) the degree of degradation changes depending on AC charging conditions, and the like.

From these facts, the reason why the abrasion wear of the photoconductor at AC charging is higher than that at DC charging is that the chemical degradation is more significant at AC charging compared to at DC charging, consequently, the mechanical strength is considerably decreased.

Then, we investigated the reason why the effect of chemical degradation of photoconductor is remarkably different between DC charging and AC charging. Considering the mechanism of charging, DC voltage applied to the roller is higher in DC charging, therefore, ions such as negative ions and positive ions are yielded due to discharging phenomenon derived by bias difference from the photoconductor, then the ions shower on or collide against the surface of photoconductor along the electric field induced between the charging roller and the photoconductor. Consequently, a potential of the same polarity with the polarity applied to the charging roller is charged on the surface of photoconductor. The discharging is ceased when the difference between the surface potential of the photoconductor and the applied voltage of the charging roller comes to lower than charge-initiating voltage, and the charging of the photoconductor is completed. Accordingly, the flowing direction of ions is essentially one way.

In the case of AC charging, on the other hand, a voltage corresponding the voltage intended to charge the photoconductor is applied as a offset component (Vdc), and Vpp and frequency are superimposed as AC components, thereby, the charge accumulated on the photoconductor surface returns to the discharging region or small space between the charging member and photoconductor, and the surface potential is smoothened by the repeated actions. Therefore, although the flowing direction of ions is essentially one way in DC charging, the flowing direction of the ions is back and forth in AC charging (finally the same direction with DC charging), the ions yielded from one to another at the discharging region collide against the surface of photoconductor repeatedly.

As such, at least the collision times against the photoconductor surface of the ions yielded at the discharging region within the charging nip are clearly different between the DC charging and the AC charging, i.e. the collisions in AC charging are a few times to a few decade times of that in DC charging. The difference of the collision condition is estimated to relate to the difference as to the charging hazard.

By the way, the recognition that the difference of ion collision times against the photoconductor corresponds to the difference of DC charging and AC charging may possibly be present in the prior development of image forming apparatuses. However, any investigations have not been conducted as to how the collision times change essentially. Although AC duplications have been carried out in order to assure the charging uniformity, the controls have been carried out through independent alternation of AC conditions in almost all the prior investigations. As a result, the fluctuations of the abrasion wear were experienced as shown in FIGS. 1 to 3.

We have continued the investigations, while aiming the number of ions that yield at the charging nip (defined as "discharging region" at the small gap) formed between the charging member and the photoconductor and collide against the photoconductor surface. The number of ions is sometimes referred to "number of charged particles" hereinafter. Many factors exists that affect the number of ions, although detailed explanations will be provided later; such factors exist as the type of charging member (diameter, layer thickness, resistivity, etc.), type of photoconductor (diameter, layer thickness, resistivity, dielectric constant, etc.), charging condition (Vpp, frequency, Vdc, etc.), process condition (linear velocity of photoconductor) and the like.

Accordingly, the chemical hazard against the photoconductor may not be determined solely based on the collided ion number, as long as one of the above noted conditions is altered and the charging uniformity is investigated, as the prior investigations in the art.

From the above explanations, two important items are understood. One is that (i) although AC superimposition is a key technology to determine the uniform charging on the photoconductor, it promotes the charging hazard on the photoconductor, and the alternation of AC conditions increases or decreases in principle the collided ion number against the photoconductor surface. However, the decrease of the ion number leads to the decrease of the smoothening effect on the surface potential; the charging uniformity and the charging hazard decrease display essentially and inevitably the trade-off relation. Another is that (ii) the collided ion number of the charging hazard varies with the AC conditions. The collided ion number is affected by many parameters, and is not controllable as long as the respective factors are adjusted independently. Accordingly, simultaneous adjustment and control of plural factors will be the only way to select the optimum condition without compensating the trade-off relation.

According to the above noted understanding or suggestion, we explored the way to determine simply and easily the optimum ion number at the charging nip, developed the analyzing way for charging, and found that the charging hazard amount is controllable through determining the ion number collided to the photoconductor based on the analyzing way.

Further, we found that a charging hazard absorber is supplied and the photoconductor surface is coated when the photoconductor is subjected to charging with AC duplication, the degradation of the photoconductor surface may be suppressed without the direct collision of ions against the photoconductor surface.

However, we also found that the feeding of the charging hazard absorber is not necessarily versatile; when the charging hazard amount is insufficient, photoconductor properties such as optical attenuation or charging properties may be deteriorated due to the effect of charging hazard absorber of non-photoconductive substance, when the charging hazard amount is excessive, the charging hazard absorber is likely to remain on the photoconductor surface due to excessive degradation of charging hazard absorber and the resulting images may be adversely effected.

As such, although the charging hazard absorber acts to prevent the photoconductor surface from the degradation due to the charging hazard, it may interfere the essential performance i.e. the image forming of image forming apparatus, when the usage is inappropriate, in spite that it may protect the photoconductor surface; the optimization of the charging hazard amount is recognized to be important. We have founded that the conditions may be determined by obtaining the charging hazard amount through the simultaneously variable simulation of AC conditions and by controlling the charging hazard amount, without losing the photoconductor protective performance and without affecting the resulting images, thereby the present invention has been completed.

The image forming apparatus according to the present invention comprises a photoconductor, a latent electrostatic image forming unit comprising a charging member configured to charge the photoconductor surface and an exposing member configured to irradiate light on the charged photoconductor surface, a developing unit configured to develop the latent electrostatic image by means of a toner to form a visible image, a transferring unit configured to transfer the visible image on a recording medium, and a fixing unit configured to fix the transferred image on the recording medium, wherein, the charging member is of roller shape disposed proximate to the photoconductor, the photoconductor is charged at the charging nip portion formed between the photoconductor and the charging member, in a condition that satisfies the following Equation (1), $$4.4\times10^{14} \leqq [(\text{Number of Charged Particles})\div(\text{Circumferential length of the photoconductor})] \leqq 17.7\times10^{14}$$

wherein the "Number of Charged Particles" refers to the number of charged particles accepted by the photoconductor surface per its unit surface area from the operated charging member, while the photoconductor rotates one round, thus the unit is [number/$m^2$]; and the unit of "Perimeter of Photoconductor" is [mm].

The image forming process according to the present invention comprises forming a latent electrostatic image on a photoconductor surface through charging the photoconductor surface and irradiating light on the charged photoconductor surface, developing the latent electrostatic image to form a visible image by means of a toner, transferring the visible image on a recording medium, and fixing the image transferred on the recording medium, wherein, the charging member is of roller shape disposed proximate to the photoconductor, the photoconductor is charged at the charging nip portion formed between the photoconductor and the charging member, in a condition that satisfies the above Equation (1).

A process cartridge according to the present invention comprises a photoconductor, a latent electrostatic image forming unit comprising a charging member configured to charge the photoconductor surface and an exposing member configured to irradiate light on the charged photoconductor surface, and at least one of: a developing unit configured to develop the latent electrostatic image by means of a toner to form a visible image, a transferring unit configured to transfer the visible image on a recording medium, and a cleaning unit configured to clean the toner remaining on the photoconductor, wherein, the charging member is of roller shape disposed proximate to the photoconductor, the photoconductor is charged at the charging nip portion formed between the photoconductor and the charging member, in a condition that satisfies the above Equation (1).

DESCRIPTION OF THE PREFERRED EMBODIMENTS (Image Forming Apparatus and Image Forming Process)

The image forming apparatus according to the present invention comprises a photoconductor, latent electrostatic image forming unit, developing unit, transferring unit and fixing unit, and may further comprise the other units, for example, charge-eliminating unit, cleaning unit, recycling unit and control unit, if required.

The image forming process according to the present invention comprises forming a latent electrostatic image, developing, transfer and fixing, and may further comprise the others, for example, charge-eliminating, cleaning, recycling and controlling, if required.

The image forming process according to the present invention may be properly carried out by the image forming apparatus according to the present invention. The latent electrostatic image forming may be performed by the latent electrostatic image forming unit, the developing may be performed by the developing unit, the transferring may be performed by the transfer unit, and the fixing may be performed by the fixing unit. The others may be performed by the other unit.

—Latent Electrostatic Image Forming—

In latent electrostatic image forming, a latent electrostatic image is formed on a photoconductor.

The latent electrostatic image may be formed, for example, by charging the surface of the photoconductor, and exposing it imagewise, which may be performed by the latent electrostatic image forming unit.

The latent electrostatic image forming unit, for example, comprises a charging member which uniformly charges the surface of the photoconductor, and an irradiating member which exposes the surface of the photoconductor imagewise.

The charging may be performed, for example, by applying a voltage to the surface of the photoconductor by means of the charging member.

Initially, The calculation of the number of charged particles and collision energy at the charging nip portion (sometimes summarily referring to "charging hazard values") will be discussed. The calculations of the charging hazard values include the calculation of the discharged amount and the calculation of charged particle energy. The calculation steps are as follows:

(1) Calculation of Discharged Amount

The calculation of the discharged amount include three steps, i.e. calculation of potential distribution, calculation of charge movement due to resistance and rotation, and calculation of charge movement due to discharge.

(i) Calculation of Potential Distribution

Figure 1:
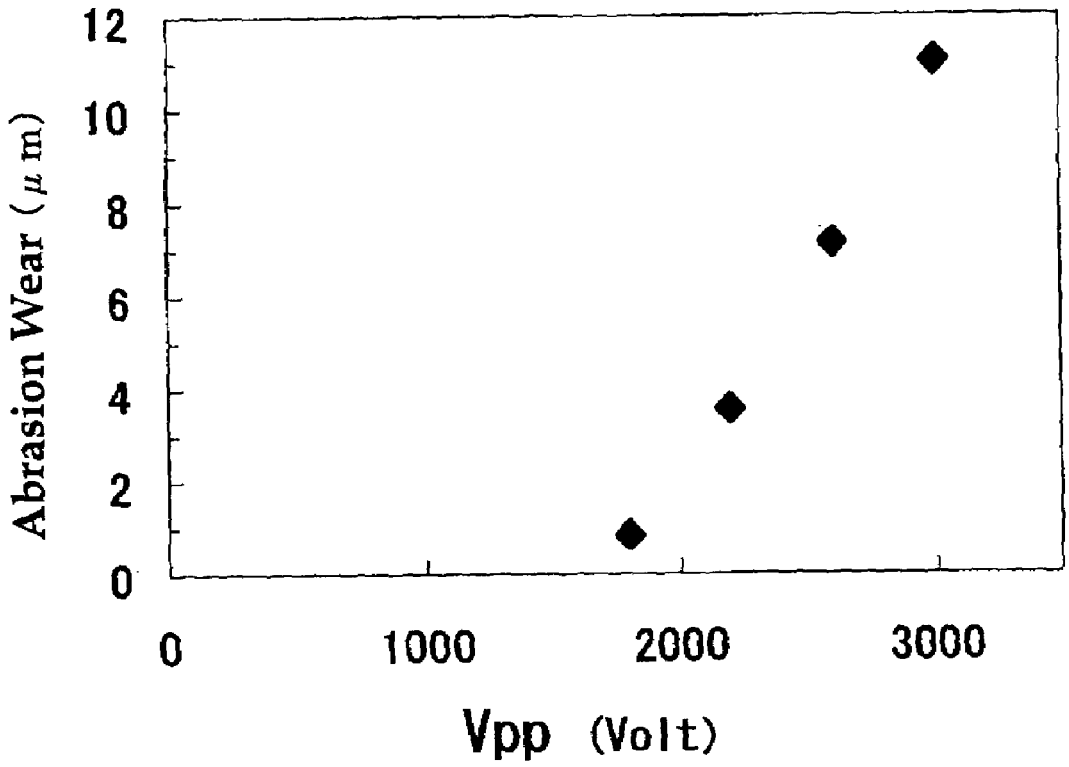
FIG. 1 schematically shows the relation between the peak-to-peak potential of AC (Vpp) and the abrasion wear of photoconductor.
Figure 2:
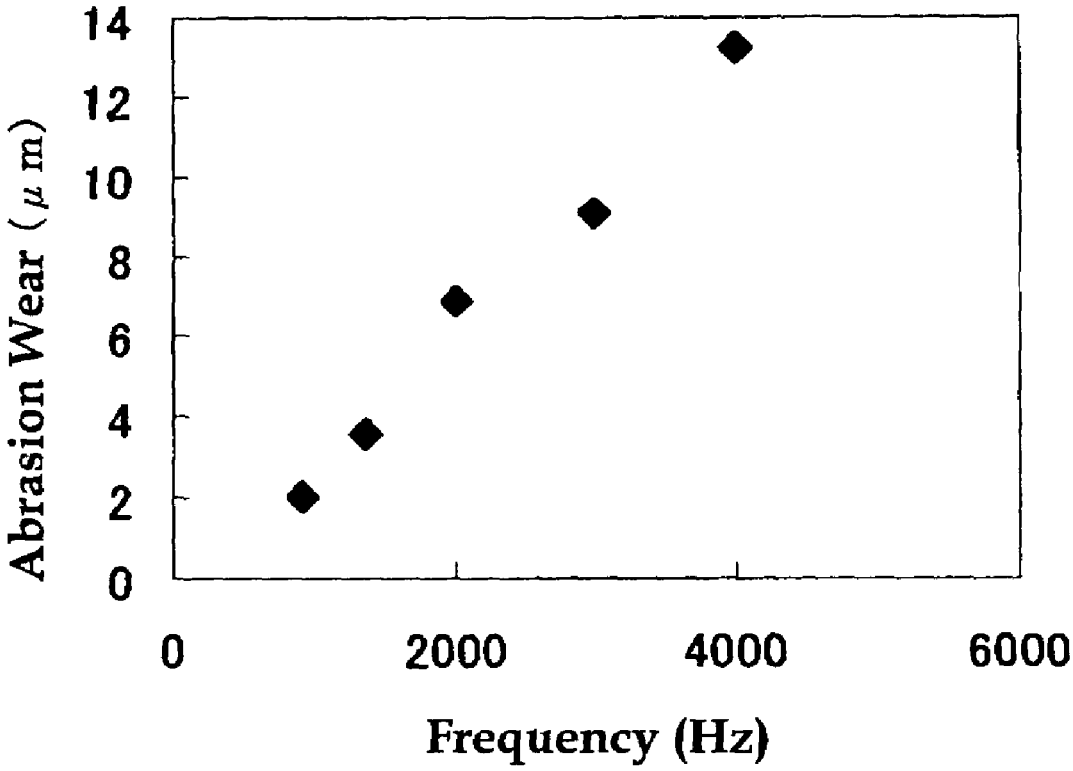
FIG. 2 schematically shows the relation between the frequency and the abrasion wear of photoconductor.
Figure 3:
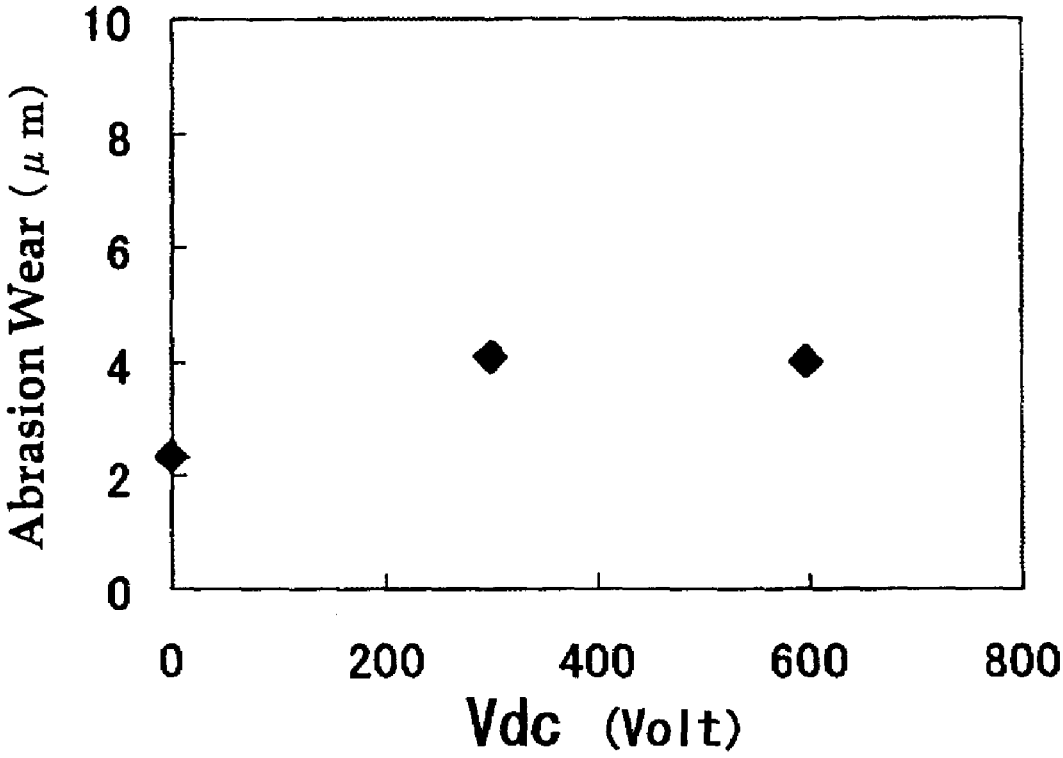
FIG. 3 schematically shows the relation between the offset potential of DC (Vdc) and the abrasion wear of photoconductor.
Figure 4:
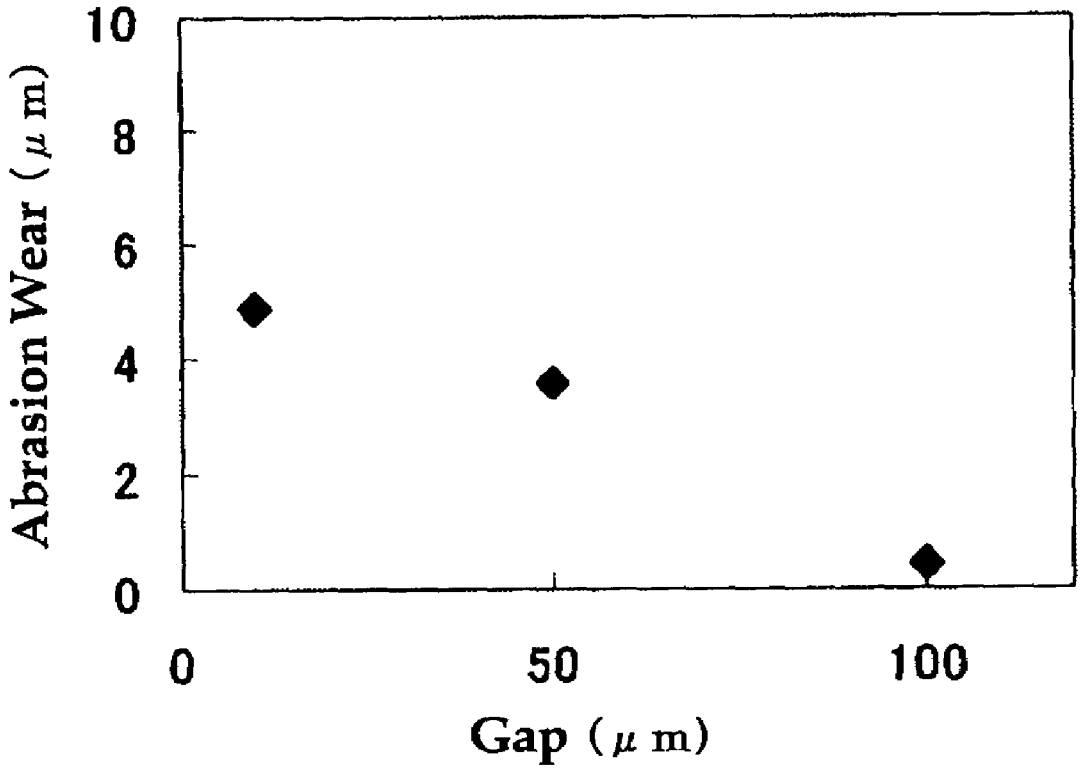
FIG. 4 schematically shows the relation between the gap of charging member and photoconductor, and the abrasion wear of photoconductor.
Figure 5:
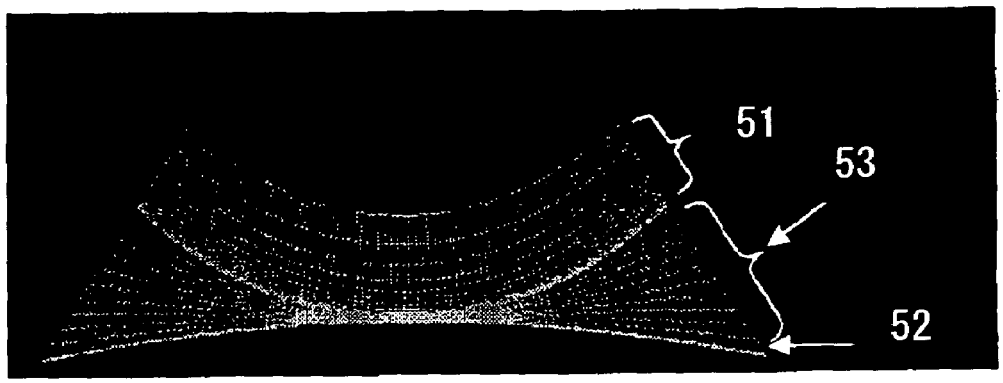
FIG. 5 schematically explains the divided air layer (calculation mesh) between the charging roller and the photoconductor.
Figure 5:
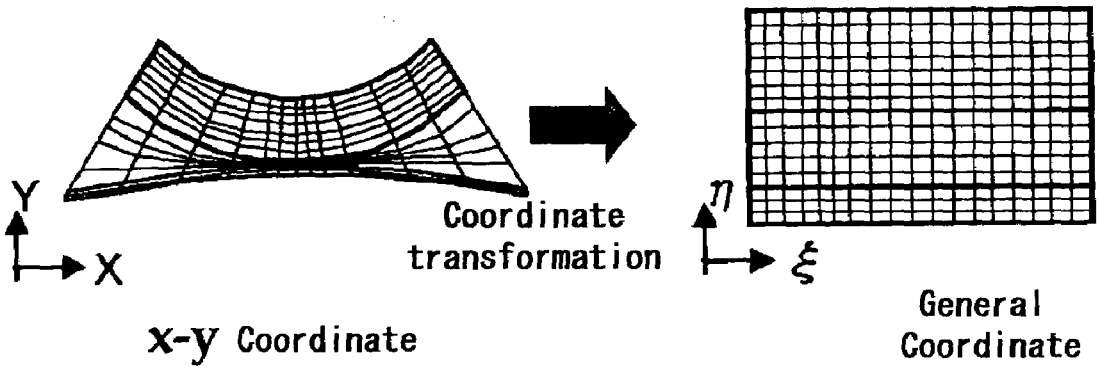
Figure 6:
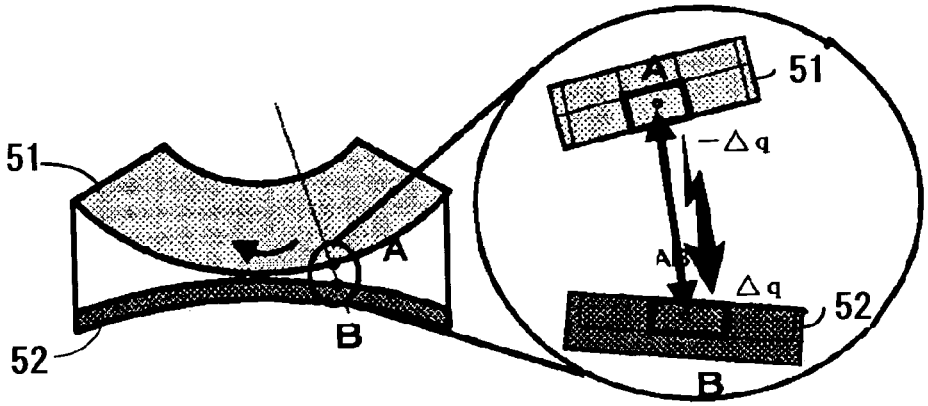
FIG. 6 schematically represents the charging condition at the region of air layer between the charging roller and the photoconductor.

The space 53 near the nip portion formed from the charging roller 51 and the photoconductor 52 is divided into mesh-like small spaces on a rectangular coordinate as shown in FIG. 5, and the rectangular coordinate is transferred to a generalized coordinate, then Poisson equation based on Gauss law is solved, thereby the potential distribution may be obtained.

Poisson equation is expressed by the following Formulae (3) to $$\frac{1}{\sqrt{g}}\cdot\frac{\partial}{\partial\xi}\cdot\sqrt{g}\cdot\left(\varepsilon\cdot g^{11}\cdot\frac{\partial\Phi}{\partial\xi}\right)+\frac{1}{\sqrt{g}}\cdot\frac{\partial}{\partial\xi}\cdot\sqrt{g}\cdot\left(\varepsilon\cdot g^{12}\cdot\frac{\partial\Phi}{\partial\eta}\right)+\frac{1}{\sqrt{g}}\cdot\frac{\partial}{\partial\eta}\cdot\sqrt{g}\cdot\left(\varepsilon\cdot g^{21}\cdot\frac{\partial\Phi}{\partial\xi}\right)+\frac{1}{\sqrt{g}}\cdot\frac{\partial}{\partial\eta}\cdot\sqrt{g}\cdot\left(\varepsilon\cdot g^{22}\cdot\frac{\partial\Phi}{\partial\eta}\right)=-q \tag{3}$$

$$(g^{ij})=\frac{1}{g}\begin{pmatrix} x_\eta^2+y_\eta^2 & -x_\xi\times x_\eta-y_\xi\times y_\eta \\ -x_\xi\times x_\eta-y_\xi\times y_\eta & x_\xi^2+y_\xi^2 \end{pmatrix} \tag{4}$$

$$\sqrt{g}=x_\xi\times y_\eta-x_\eta\times y_\xi \tag{5}$$

wherein $g^{ij}$ represents "calculation tensors".

$\sqrt{g}$ represents "Jacobian" for a coordinate transformation, q represents "volume-charge density", Φ represents "potential", ∈ represents "dielectric constant" of charging roller surface layer.

$\chi_\xi$ represents "partial differential" of χ by ξ.

$\gamma_\xi$ represents "partial differential" of y by ξ.

The mesh shown in FIG. 5 is made up, considering the diameters (meter) of photoconductor and charging roller, layer thickness (meter) of photoconductor or photoconductive layer, and layer thickness of charging roller.

(ii) Calculation of Charge Movement due to Resistance and Rotation

After calculating electric fields on the mesh at respective times, calculations are conducted according to Ohm's law with additional advection items. Thereby, the charge movement due to the resistance as well as the charge movement due to rotation of the roller and photoconductor are taken into consideration.

$$\frac{\partial q}{\partial t}=\frac{1}{\sqrt{g}}\cdot\frac{\partial}{\partial\xi}\left(\sqrt{g}\cdot\sigma\cdot g^{11}\frac{\partial\Phi}{\partial\xi}\right)+\frac{1}{\sqrt{g}}\cdot\frac{\partial}{\partial\xi}\left(\sqrt{g}\cdot\sigma\cdot g^{12}\frac{\partial\Phi}{\partial\eta}\right)+\frac{1}{\sqrt{g}}\cdot\frac{\partial}{\partial\eta}\left(\sqrt{g}\cdot\sigma\cdot g^{21}\frac{\partial\Phi}{\partial\xi}\right)+\frac{1}{\sqrt{g}}\cdot\frac{\partial}{\partial\eta}\left(\sqrt{g}\cdot\sigma\cdot g^{22}\cdot\frac{\partial\Phi}{\partial\eta}\right)-\frac{1}{\sqrt{g}}\cdot\frac{\partial}{\partial\xi}\cdot\sqrt{g}\cdot(q\cdot V^{\xi})-\frac{1}{\sqrt{g}}\cdot\frac{\partial}{\partial\eta}\cdot\sqrt{g}\cdot(q\cdot V^{\eta})$$

wherein "V" is the linear velocity (meter/sec) of the photoconductor or charging roller, "σ" is electric conductivity (reciprocal of volume resistivity).

(iii) Calculation of Charge Movement due to Discharge

Since discharge takes place along the electric line of force, the discharge occurs between a certain point A on the charging roller surface and point B on the photoconductor surface wherein the straight line passing through points A and B passes also the center of charging roller. Further, the discharge takes place when the potential difference between points A and B ($V_{AB}$) exceeds the Paschen's discharge-initiating voltage ($V_{Pa}$), and the charge of "Δq" moves to the photoconductor surface (at the same time, the reverse charge of "−Δq" moves to the roller surface).

$$\Delta q=(V_{AB}-V_{Pa})\times\frac{(D\times G)\times\varepsilon_0}{D\times G} \tag{7}$$

wherein "$V_{AB}$" is the potential difference between points A and B (Volt), "$V_{Pa}$" is the discharge-initiating voltage (Volt) according to Paschen's law, "G" is the gap distance between the charging roller and the photoconductor. "D" is the sum of the respective dielectric thicknesses obtained from dividing the respective thickness of charging roller or photoconductor by the respective dielectric constant.

$$D=\Sigma d_i/\in'_i \tag{8}$$

wherein "di" is the respective layer thicknesses of charging roller or photoconductor, "$\in'_i$" is the relative dielectric constant of charging roller or photoconductor.

The following Formulae (9) to (11) relate to Paschen's law; since the charge movement results from a mechanism other than discharging at 4.8 μm or less of G, it is different from Formula (5), and the quantity of charge movement is less than that of Formula (5). In our analysis, the discharge is estimated substantially not to occur at 4.8 μm or less of G. By the way, we ascertained that the calculation from Formula (7) at 4.8 μm or less of G results in the similar tendency, assuming that the charge movement depends on Formula (7).

when $G>8\times10^{-6}$ (meter)

$$V_{pa}=312+6.2\times10^6\times G \tag{9}$$

when $8\times10^{-6}\geqq G\geqq4.8\times10^{-6}$ (meter)

$$V_{pa}=362 \tag{10}$$

when $4.8\times10^{-6}$ (meter)$\geqq$G $$V_{pa}=75.4\times10^6\times G \tag{11}$$

The charge density q ($C/m^2$) accumulated on the photoconductor may be calculated through repeating the three steps above described. The potential of charged photoconductor (V) may be obtained as:

$$V(\text{volt})=qL/C$$

wherein photoconductor capacitance per unit area C ($F/m^2$)=$\in'_i\times\in_0/d_i$, the surface charge density at the most left side of the calculation region is qL ($C/m^2$).

In the above calculation, the charged particles under consideration are as follows:

Negative ion: electron $e^-$

Positive ion: $H^+(H_2O)_n$ n=4 to 8

(2) Calculation of Charging Hazard

The charging hazard amount will be calculated that is accepted at a point in the charging nip of the photoconductor. The calculation includes four steps as follows:

(i) Calculation of Discharged Electric Charge Number

By the first step, the discharged electric charge number may be calculated that generates at the mesh of the respective spaces between the charging roller and the photoconductor at each time. Since the charged particles are monovalent positive ions and/or electrons, the number of charged particles per unit area (n) that transports at the respective space is obtained from the following Formula (12).

$$n=\Delta q/e \tag{12}$$

wherein "Δq" is the discharged electric charge ($C/m^2$), "e" is unit electric charge $1.602\times10^{-19}C$.

(ii) Calculation of Average Velocity of Charged Particles Discharged at Space (Gap)

The average velocity of electrons (Ve) and the average velocity of positive ions (Vp) in normal discharge (electron moves toward the photoconductor) and reverse discharge (positive ion moves toward the photoconductor) are calculated by the following Formulae (13) and (14).

$$v_e=6.58\times10^{-2}\times E \tag{13}$$

$$v_p=\mu E \tag{14}$$

wherein "E" is electric field (V/cm), "μ" is mobility of positive ion ($1.32\times10^{-4}$ (mls)/(V/m)).

The average kinetic energy of charged particles, i.e. the kinetic energy of electron ($\mu_e$) and the kinetic energy of positive ion ($\mu_p$), are calculated from the following Formulae (15) and (16).

$$\mu_e=\frac{1}{2}\times m_e\times v_e^2 \tag{15}$$

$$\mu_p=\frac{1}{2}\times m_p\times v_p^2 \tag{16}$$

wherein $m_e$ is mass of an electron, $m_p$ is mass of a positive ion.

(iii) Calculation of Energy Accepted by Photoconductor Passing through Discharging Region The energy will be calculated that the photoconductor accepts from the charged particles when passing through the discharging region.

Figure 7:
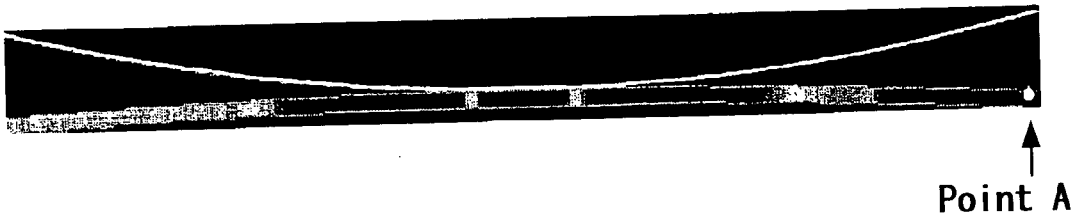
FIG. 7 schematically represents the condition at the discharging region inlet (starting point of calculation) of a certain point (point A) on photoconductor surface.

Attention is directed to point A on the photoconductor which existed on upper side of calculation region (right end of FIG. 7) at T=0 (sec). Point A moves toward left side with time at the linear velocity V of the photoconductor. The mesh where point A exists at the respective times may be easily calculated through a simulation. If the occurrence of discharge is recognized at the mesh where point A exists from the calculation of electric field, the charged particles that collide at point A are calculated as to the polarity, number, velocity, and energy.

The collision energy due to discharge in a space at a time (U) is (charged particle number)×(kinetic energy of one particle) as expressed by the Formula (17).

$$U=n_e\times\mu_e$$

or $$U=n_p\times\mu_p \tag{17}$$

Then, the collided positive ion number (ΣNp), collided negative ion number (ΣNe), total collision energy at a moment (ΣU) are integrated.

The total collision energy at a moment is expressed as:

$$\Sigma(U)=\Sigma(n_e\times\mu_e)+\Sigma(n_p\times\mu_p) \tag{18}$$

Figure 8:
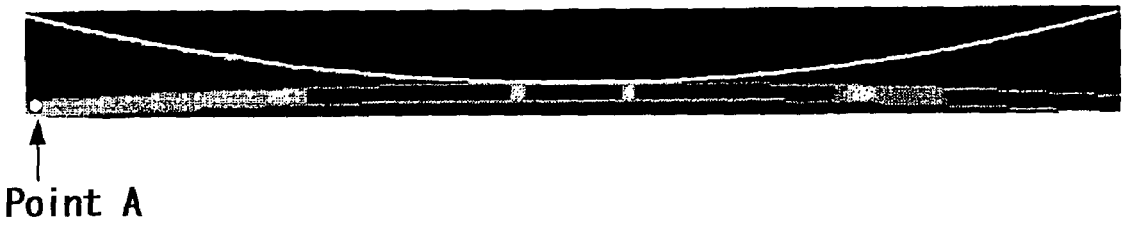
FIG. 8 schematically represents the condition at the discharging region outlet (ending point of calculation) of a certain point (point A) on photoconductor surface.

Then, the photoconductor is moved at a distance of V×ΔT, and the occurrence of discharge at point A is examined through the calculation of electric field. ΔT is the time step of calculation. When point A arrives to the left end of calculation region as shown in FIG. 8, the calculation is completed.

Figure 9:
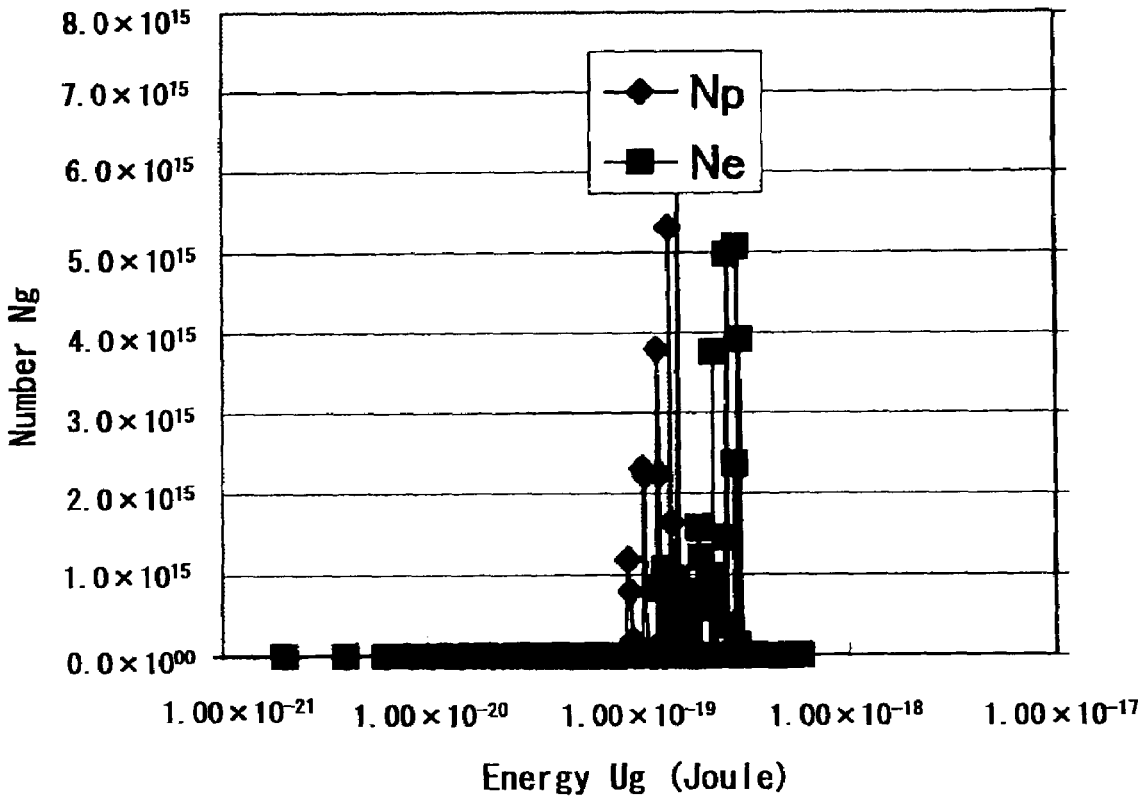
FIG. 9 schematically represents the energy distribution of charged particles without distribution width.

FIG. 9 shows the resulting energy distribution of charged particles. The horizontal axis of FIG. 9 is a logarithmic scale.

(iv) Consideration as to Energy Distribution

The above described calculations are based on an assumption that the respective energies of charged particles moving through discharging at the gap G are the same. However, the respective charged particles actually distribute in a radius of 1/e with a width of about kt. The charged particles having energy U exhibit the number distribution in width dU as follows, wherein the average kinetic energy is $U_g$ at gap G, the number of charged particles is $N_g$.

$$\Phi(U)dU=\frac{2N_g}{\sqrt{\pi}}\times\frac{U^{1/2}}{U_g^{1/2}}\times\exp\left(\frac{-U}{U_g}\right)\times d\left(\frac{U}{U_g}\right) \tag{19}$$

The number of electrons having $U=U_0$ may be integrated as following Formula (20), through integrating $\Phi(U_0)dU$ at $U=U_0$ in the entire range of $U_g$. The number of charged particles $N_g$ is a function of average kinetic energy $U_g$ as shown in FIG. 9.

$$\sum_{U_g}\Phi(U)dU \tag{20}$$

$$\int_{U_1}^{\infty}\sum_{U_g}\Phi(U)dU \tag{21}$$

The above Formula (21) is for calculating the number of charged particles having the energy of $U_1$ or more, wherein $U_1$ is lower limit of calculation, and the minimum value is zero. Actually, $U_1$ is defined to the lowest kinetic energy of particles obtained from the simulation.

Figure 10:
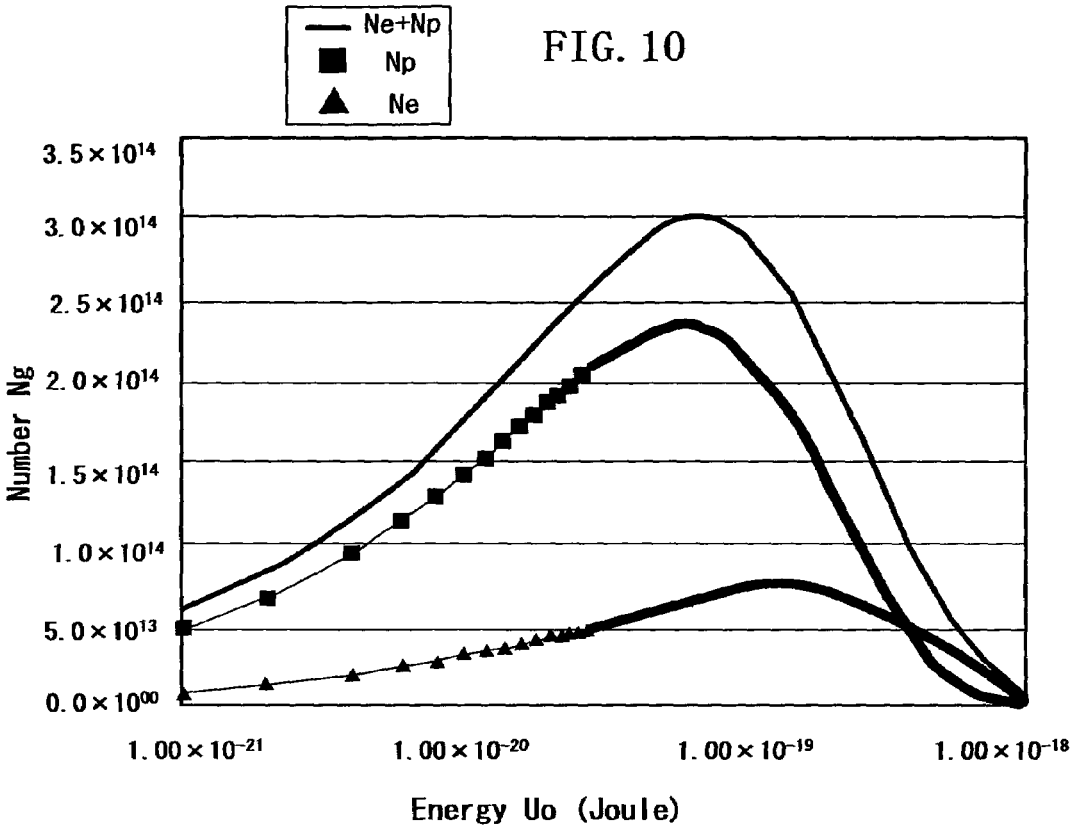
FIG. 10 schematically represents the energy distribution of charged particles with distribution width.

FIG. 10 shows the resulting number distribution, in which the number of positive particles $N_p$, number of electrons $N_e$, and total number of charged particles $N_p+N_e$ are plotted.

Figure 11:
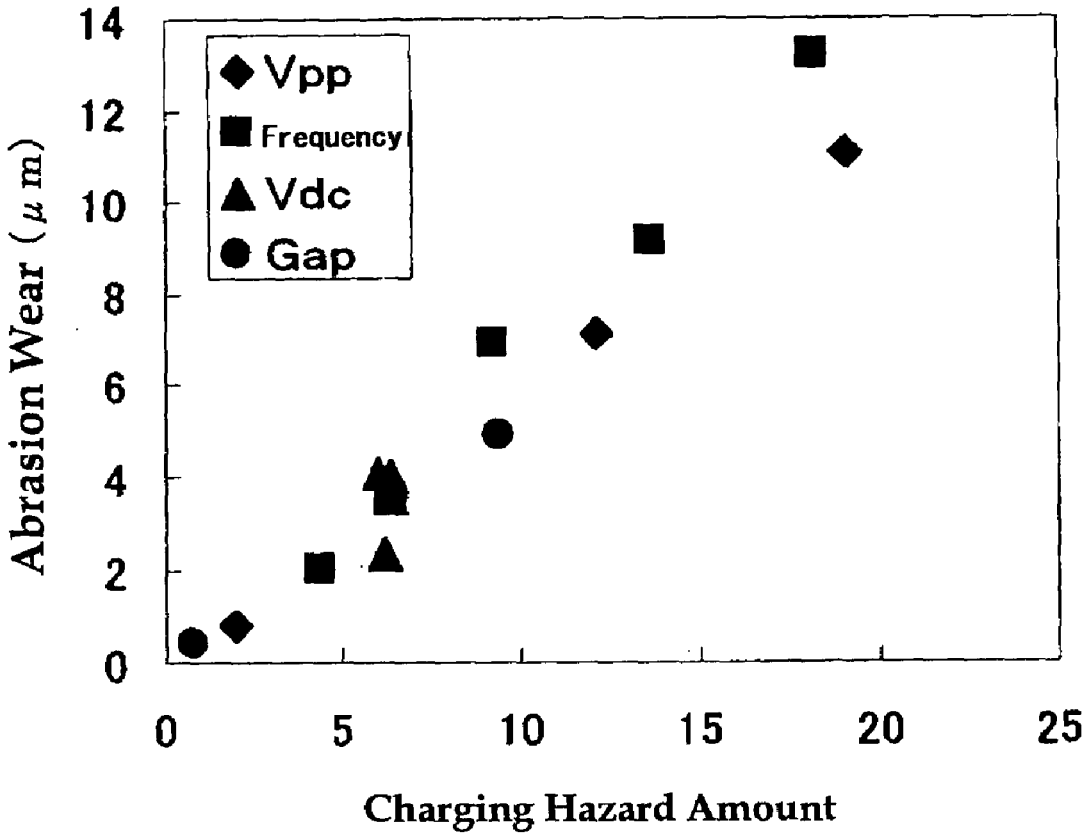
FIG. 11 schematically shows the relation between the charging hazard amount (charged particle number/photoconductor perimeter) and the abrasion wear of photoconductor.

FIG. 11 shows a relation between the abrasive wear of actual photoconductor wherein AC conditions are independently variable and charged particle numbers obtained from the above discussed simulation in the case that the charging hazard absorber is not fed. From FIG. 11, it is apparent that the abrasion wear of photoconductor varies when AC conditions and the gap or space between the charging member and photoconductor are altered independently; when the charging hazard amount expressed by the following Equation (1) is introduced, a correlation may be recognized between the charging hazard amount and the decrease of coating thickness, despite of the variable factors.

The calculation or simulation above discussed considers entirely such factors as layer thickness of charging roller, resistance of layer, dielectric constant of layer, diameter of roller, bias applied to roller (Vpp, frequency, Vdc), space or gap between charging roller and photoconductor, process speed or linear velocity of photoconductor, diameter of photoconductor, layer thickness, resistance of layer, and dielectric constant of layer. As for the number of charged particles, it is defined as "the number of charged particles accepted from a charging member in the unit area, while a point on a photoconductor passes through a charging nip during one cycle or one round of revolution, therefore, the charging hazard amount per unit surface area of photoconductor differs with respect to a certain sheets of images depending on the circumferential length of a photoconductor of the actual image forming apparatus.

Accordingly, the charging hazard amount accepted by the photoconductor per unit surface area ($/m^{2-}mm$) is expressed accurately as follows.

$$4.4\times10^{14} \leqq [(\text{Number of Charged Particles})\div(\text{Circumferential length of the photoconductor})] \leqq 17.7\times10^{14}$$

Conclusively, the relation between the abrasion wear of photoconductor and the number of charged particles may be expressed by the Equation (1) including the factor of the diameter of photoconductor.

By the way, the number of charged particles in FIG. 11 results from considering the total number generated at the charging nip without considering the energy level or kinetic energy of the charged particles. However, the energy distributions of the charged particles exhibit nearly orthomorphic patterns within the AC charging conditions shown in FIG. 11 in our investigations. Since the collision of charged particles to cut molecular chains results in the charging hazard, more correctly speaking, the consideration as to the bond dissociation energy of molecules is needed that constitute the surface layer of the photoconductor.

The bond dissociation energy of organic matter is about $3\times10^{-19}$ (Joule) with some differences depending on the type of bonding. The bond dissociation energy is represented by the dissociation energy of C—C bonding (single bonding) of the molecules that constitute the surface layer, since the bonding is usually represented by the backbone chain bonding of the polymer utilized as the binder resin in the surface layer. Therefore, the number of charged particles of which energy is larger than $3\times10^{-19}$ (Joule) is assigned into the Equation (1), thereby the relation between the abrasion wear of the photoconductor and the number of the charged particles may be expressed more precisely. In this case, Equation (1) is transformed into Equation (2) as follows.

$$1.5\times10^{14} \leqq [(\text{Number of Charged Particles having kinetic energy of } 3\times10^{-19} \text{ Joule or more})\div(\text{Circumferential length of the photoconductor})] \leqq 4.4\times10^{14} \qquad \text{Equation (2):}$$

wherein the "Number of Charged Particles having kinetic energy of $3\times10^{-19}$ Joule or more" refers to the number of charged particles accepted by the photoconductor surface per its unit surface area from the operated charging member, while the photoconductor rotates one round, and also the kinetic energy of each particle is $3\times10^{-19}$ Joule/number or more, thus the unit is [number/$m^2$]; and the unit of "Perimeter of Photoconductor" is [mm].

The light irradiation may be performed by irradiating light on the surface of the photoconductor imagewise, using the exposing member for example.

The exposing member may be properly selected depending on the application provided that the surface of the photoconductor charged by the charging member may be exposed the image to be formed; for example, such a exposing member as copy optical system, rod lens array system, laser optical system and liquid crystal shutter optical system may be exemplified.

In addition, in the present invention, a backlight system may be employed in which the photoconductor is exposed imagewise from its rear surface.

—Developing—

In the developing, the latent electrostatic image is developed using the toner or developer to form a visible image.

The visible image may be formed for example by developing the latent electrostatic image using the toner or developer, which may be performed by means of the developing unit.

The developing unit may be properly selected from those known in the art, provided that it may develop an image for example using a toner or developer; for example, such a member is preferable that contains a toner or developer and comprises an image-developer housing which may supply the developer with contact or without contact to the latent electrostatic image.

The developing unit may be of dry type or wet type, and may be a monochrome developing or multi-color developing unit. For example, such a member is preferable that comprises a stirrer that charges the toner or developer by friction stirring, and a rotatable magnet roller.

In the developing unit, for example, the toner and the carrier are mixed and stirred; the toner is thereby charged by friction and sustained in a condition of standing rice ears, and forms a magnetic brush on the surface of the rotating magnet roller. Since the magnet roller is arranged near the photoconductor, part of the toner in the magnetic brush formed on the surface of this magnet roller moves to the surface of the photoconductor due to the force of electrical attraction. As a result, this toner develops a latent electrostatic image, and a visible toner image is formed on the surface of the photoconductor.

The developer housed in the developing unit is the developer containing the toner; the developer may be single-component or double-component developer.

—Transfer—

In the transfer, the visible image is transferred to a recording medium. In a preferred aspect, the visible image is transferred to the intermediate transfer member as the primary transfer, then the visible image is transferred on the recording member as the secondary transfer. More preferably, using a toner of two or more colors and still more preferably using a full color toner, the visible image is transferred to the intermediate transfer member to form a complex-transfer image as the primary transfer, and the complex-transfer image is transferred to the recording medium as the secondary transfer.

The transfer may be achieved, for example, by charging the photoconductor using a transfer-charging member, which may be performed by the transfer unit. In a preferred aspect, the transfer unit comprises a primary transfer unit that transfers the visible image to the intermediate transfer member to form a complex-transfer image, and a secondary transfer unit that transfers the complex-transfer image to the recording medium.

The intermediate transfer member may be properly selected from transferring bodies known in the art, for example, a transferring belt may be exemplified.

The transfer unit (the primary transfer unit and the second transfer unit) preferably comprises an image transferor that conducts releasing charge the visible image formed on photoconductor to the side of recording medium. The transfer unit may be one or more.

Examples of the transferor include a corona transferor based on corona discharge, transfer belt, transfer roller, pressure transfer roller, adhesion transferor and the like.

The recording medium is typically plain paper, but is not limited to, and may be selected depending on the application; a polyethylene terephthalate (PET) base for overhead projector (OHP) may be employed.

In the fixing, the visible image transferred to the recording medium is fixed by means of a fixing device. The fixing may be carried out with respect to the individual toners of respective colors transferred to the recording medium, or may be carried out in one operation after the toners of entire colors have been laminated.

The fixing apparatus may be properly selected from heat-pressure units known in the art. Examples of heat-pressure units include a combination of heat roller and pressure roller, and a combination of heat roller, pressure roller and endless belt.

The heating temperature in the heat-pressure unit is preferably 80° C. to 200° C.

Also, in the present invention, an optical fixing unit known in the art may be used in addition to or instead of the fixing unit, depending on the application.

In the charge eliminating, a discharge bias is applied to the photoconductor to conduct the discharge, which may be performed by a charge-eliminating unit.

The charge-eliminating unit may be properly selected from those known in the art provided that a discharge bias may be applied to the photoconductor; for example, a discharge lamp is preferable.

In the cleaning, the electrophotographic toner remaining on the photoconductor is removed, and may be performed by means of a cleaning unit.

The cleaning unit may be properly selected from cleaning units known in the art, provided that the electrophotographic toner remaining on the photoconductor may be removed; examples thereof include a magnetic brush cleaner, electrostatic brush cleaner, magnetic roller cleaner, blade cleaner, brush cleaner, web cleaner and the like.

In the recycling, the electrophotographic toner removed by the cleaning step is recycled to the developing unit, and may be performed by a recycling unit.

The recycling unit may be properly selected from transport units and the like known in the art.

In the control, the respective steps or stages are controlled, and may be properly implemented by a control unit.

The control unit may be properly selected depending on the application provided that the respective steps or stages may be controlled; examples thereof include a device such as a sequencer or a computer.

Figure 12:
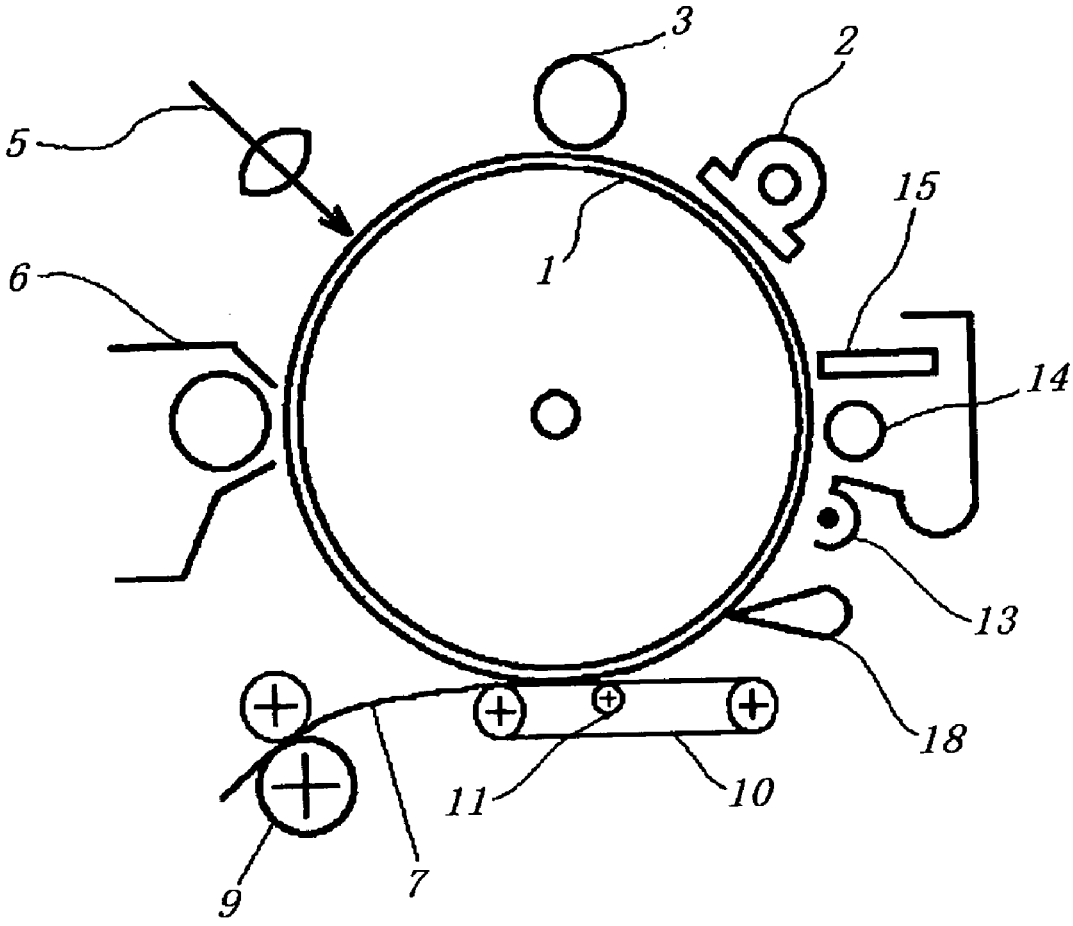
FIG. 12 schematically shows an exemplary image forming apparatus according to the present invention.

FIG. 12 shows a schematic view to explain an image forming apparatus according to the present invention; the modifications explained later should be within the scope of the present invention.

In FIG. 12, photoconductor 1 is provided with a photoconductive layer containing a charge-generating material and a charge-transporting material on a conductive support. The photoconductor 1 is of drum shape, the other shapes are also allowable such as sheet or endless belt shape.

The charging roller 3 is a non-contacting and proximately disposed charging roller. The charging member of non-contacting and proximately disposed type presents such merits as the charging efficiency is higher, the generation of ozone is less, and the size may be miniaturized.

The charging member of non-contacting and proximately disposed type refers to that a space or gap of 200 μm or less exists between the surface of photoconductor and the surface of charging member. When the gap is excessively wide, the charging is likely to be unstable, when the gap is excessively narrow, the surface of the charging member tends to be smeared by the existing remained toner on the photoconductor. Therefore, the minimum of the space depends on the toner particle size employed in the image forming apparatus, and the gap wider than the toner particle size is preferable. The gap is preferably 10 to 200 μm, more preferably 10 to 100 μm. From a view point of the gap distance, the charging member of non-contacting and proximately disposed type may be distinguished from known charging members, e.g. charging member of charge wire type such as corotoron and scorotoron, charging roller of contacting type, contacting charging member such as charging roller, charging brash, and charging blade.

The charging member of non-contacting and proximately disposed type takes the advantages of less toner smearing on the surface of charging member, less abrasion wear of the surface of charging member, and less physical and chemical degradation of the surface of charging member, since the surface is not contact with the photoconductor surface, resulting in the high durability of charging member itself.

When the aforesaid undesirable matters arise with a contacting charging member and the durability of the charging member is lowered, the charging ability possibly decreases, or the charging possibly comes to nonuniform, during the repeated use of the image forming apparatus. In order to avoid such charging troubles, the applied voltage to the charging member is adjusted to increase in some case depending on the decrease of charging capacity. In such a case, the charging hazard on the photoconductor comes to increase, resulting in the lowered durability of photoconductor or the occurrence of abnormal images. Further, the charging member itself decreases the durability along with the increase of applied voltage. On the contrary, the non-contacting charging member may improve the durability and stability of the charging member, the photoconductor, and the entire system owing to the increased charging stability of charging member along with the increased durability of the charging member.

Figure 13:
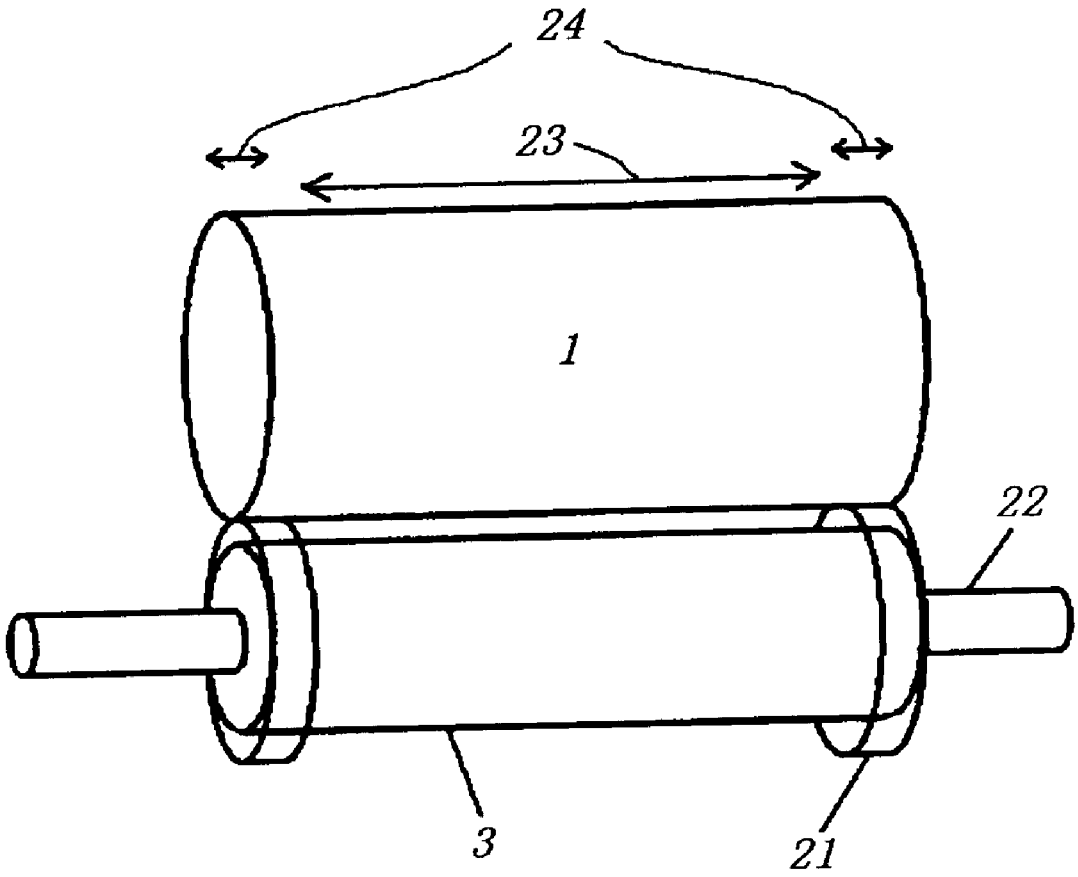
FIG. 13 schematically shows an exemplary mechanism of proximate charging wherein a gap forming member is disposed at the side of charging member.

The charging member of non-contacting and proximately disposed type may be properly selected depending on the application, provided that the member has a suitable mechanism to adjust the space from the photoconductor surface. For example, the charging member is disposed such that the rotation axes of photoconductor and charging member are mechanically fixed to form a suitable gap. In particular, such a way to dispose an image forming region in non-contacting condition may be recommended for easy and stable manner, as a charging member of roller shape is prepared, gap forming members are disposed at both the ends of non-image forming portion of the charging member, only the gap forming members are made to contact with the photoconductor surface, thereby the image forming region is disposed in non-contacting condition, alternatively, gap forming members are disposed at both the ends of non-image forming portion of the photoconductor, only the gap forming members are made to contact with the surface of charging member, thereby the image forming region is disposed in non-contacting condition. The contents of JP-A No. 2002-148904 and No. 2002-148905 are expressly incorporated herein by reference. FIG. 13 schematically shows an exemplary mechanism of proximate charging wherein a gap forming member is disposed at the side of charging member. Employing the mechanism, such merits may be successfully afforded as higher charging efficiency, lower ozone generation, smaller apparatus size, less smear by toner, and no abrasion wear due to mechanical contact.

As for the application of voltage, the duplicated AC may lead to advantages such as less charging nonuniformity. In the full-color image forming apparatus of tandem type explained later, there may arise a problem of concentration nonuniformity of half-tone image due to charging nonuniformity caused in a monochrome image forming apparatus, and also a serious problem of decreased color balance or color repeatability. By duplicating AC component to DC component, the aforesaid problems may be remarkably reduced; when the AC component is excessively effective as to frequency or peak-to-peak voltage, the charging hazard on the photoconductor comes to larger, resulting in premature degradation of photoconductor. Therefore, the duplication of AC is required to be minimum level within the demanded range.

As for the condition of superimposed AC, such factors may be exemplified as the layer thickness of the charging roller, resistance of layer, dielectric constant of layer, diameter of roller, bias applied to roller (Vpp, frequency, Vdc), space or gap between charging roller and photoconductor, process speed or linear velocity of photoconductor, diameter of photoconductor, layer thickness, resistance of layer, and dielectric constant of layer as set forth above. By adjusting these factors, the apparatus is utilized in a range of the charging hazard amount (number of charged particles at the charging nip) of $4.4\times10^{14}$ to $17.7\times10^{14}$ (number/$m^{2-}$mm). When the charging hazard amount is $4.4\times10^{14}$ (number/$m^{2-}$mm) or less, the charging nonuniformity is larger, the image nonuniformity at half tone image is severer, and is not practical. On the other hand, when the charging hazard amount is $17.7\times10^{14}$ (number/$m^{2-}$mm) or more, uniform charging may be provided so as to form proper images, however, the damage on the photoconductor is severer, resulting in remarkably lower durability of the photoconductor. Further, the image blur and image deletion are significant in higher humidity condition.

The specific conditions to adjust the charged particle number in a suitable range are variable with such factors as shape and properties of the charging member and photoconductor of the image, and may not be determined straightforwardly.

Regarding a general way to determine the conditions, the following combination of factors may optimize the condition, but the present invention is not limited to.

The frequency of AC component, which varies depending on linear velocity of the photoconductor and the like, is 3 kHz or less, preferably is 2 kHz or less. Concerning the peak-to-peak alternating voltage, when the voltage applied to charging member and the charging voltage on photoconductor is examined, a region appears where the photoconductor is not charged despite of applying a voltage, and a voltage is recognized from which the charging is arisen. In general, about two times of the arising voltage is the optimum voltage of the peak-to-peak alternating voltage, and is usually 1200 to 1500 V. However, the two times of the arising voltage may be insufficient when the charging ability of the photoconductor is lower or the linear velocity is considerably higher; lower than the two times of the arising voltage may provide sufficiently stable voltage when the charging ability is proper. As such, the peak-to-peak alternating voltage is preferably no more than three times as much as the arising voltage, more preferably no more than two times. In terms of absolute value, the peak-to-peak alternating voltage is preferably 3 kV or less, more preferably 2 kV or less, still more preferably 1.5 kV or less.

When a condition is achieved that satisfies the Equations (1) and (2) by adjusting the variable factors above explained, the charging uniformity as well as the decrease of charging hazard may be achieved, which are the substantial objects of the present invention.

At the image irradiating portion 5, such light sources with high brightness may be employed as a light emitting diode (LED), semiconductor laser (LD), and electro luminescence. The light emitting diode and semiconductor laser may irradiate with higher irradiation energy at wave length 600 to 800 (nano meter), and the phthalocyanine pigment of a certain crystalline type adapted to the present invention exhibits high sensitivity, therefore, may be suitably utilized.

The developing unit 6 may correspond optionally to a normal developing or a reverse developing depending on the charging polarity of the toner. When a toner of reverse polarity with the charging polarity of photoconductor is employed, the normal developing is conducted, whereas when a toner of the same polarity is employed, a latent electrostatic image is developed through a reverse developing. In the advanced digital light source, the reverse developing type is advantageous with respect to lower image area, in which type the toner developing is conducted at the writing portion. Further, it is applied to one-component developing in which the toner is employed, as well as double-component developing in which the toner and carrier are employed.

Further, there exist two ways to transfer the toner image on the photoconductor to the transfer paper. One way is to transfer the toner image, developed on the photoconductor surface as shown in FIG. 12, to a transfer paper directly; another way is to transfer the toner image once from a photoconductor to an intermediate transfer body, then to a transfer paper. The present invention may be applied to both the ways.

The transferring belt 10 shown in FIG. 12 as the transferring member may be a transferring charger or transferring roller. In particular, the transferring belt or transferring roller of contacting type, in which the generated amount of ozone is lower, is desirable. The transferring member may be selected from conventional ones, provided that it is suitable in construction.

As for the way to apply the current or voltage, the constant current type is more preferable in light of higher stability although any one of the constant voltage type and constant current type is applicable. Preferably, the current to the photoconductor is controlled by deducting the current that pass through the transferring member and the related portion and not pass through the photoconductor from the entire current of electric source member. Specifically, in order to determine the current passing through the roller that sustains the transferring belt, the current that passed through the related portions is returned to the high voltage source without directing the related portions to the earth directly; determining the difference from the high voltage source, wherein the high voltage source has a feedback property to maintain the difference constant, thereby the constant current control is conducted.

The larger transferring current is more advantageous, since the charge is taken in the amount over the electrostatic adhesion between the photoconductor and the toner. However, exceeding a threshold, a discharge occurs between the transferring member and the photoconductor, resulting in the dispersion of the too finely developed toner image. Therefore, the upper limit is below the discharging range. The threshold differs depending on the space or distance between the transferring member and the photoconductor and their materials, and the discharging may be avoided when the current is about 200 μA or less. Therefore, the upper limit of the transferring current is about 200 μA.

As for the light source of charge removing lamp 2, light emitters such as a fluorescent lamp, tungsten lamp, halogen lamp, mercury lamp, sodium lamp, light emitting diode (LED), semiconductor laser (LD), and electro luminescence may be employed. For providing light only at the desired spectral region, filters such as a sharply cutting filter, band-pass filter, near-infrared cutting filter, dichroicfilter, interference filter, and conversion filter for color temperature may be employed.

Employing such a light source, and providing a process for production that includes transferring, charge eliminating, cleaning, and pre-irradiating that utilize light irradiation in addition to the procedure shown in FIG. 12, the light is irradiated to the photoconductor.

When an AC component is superimposed at the charging, or when the remaining potential on the photoconductor is sufficiently low, the charge eliminating may be omitted. Further, electrostatic charge eliminating mechanism other than the optical mechanism, e.g. charge eliminating brush with applied bias or connected earth, may be employed.

The toner developed on the photoconductor 1 by the developing unit 6 is transferred to the transferring paper 7. When a toner remains on the photoconductor 1, it is removed from the photoconductor 1 by means of far blush 14 and blade 15. The cleaning may be conducted only by the cleaning brush, examples of the cleaning brush include a fur brush, magnetic fur brush and any other conventional brushes. Further, the reference numerals in FIG. 12 represent 9: resist roller, 10: transferring belt, 11: pressing roller, 13: pre-cleaning charger, 18: separating claw.

Figure 14:
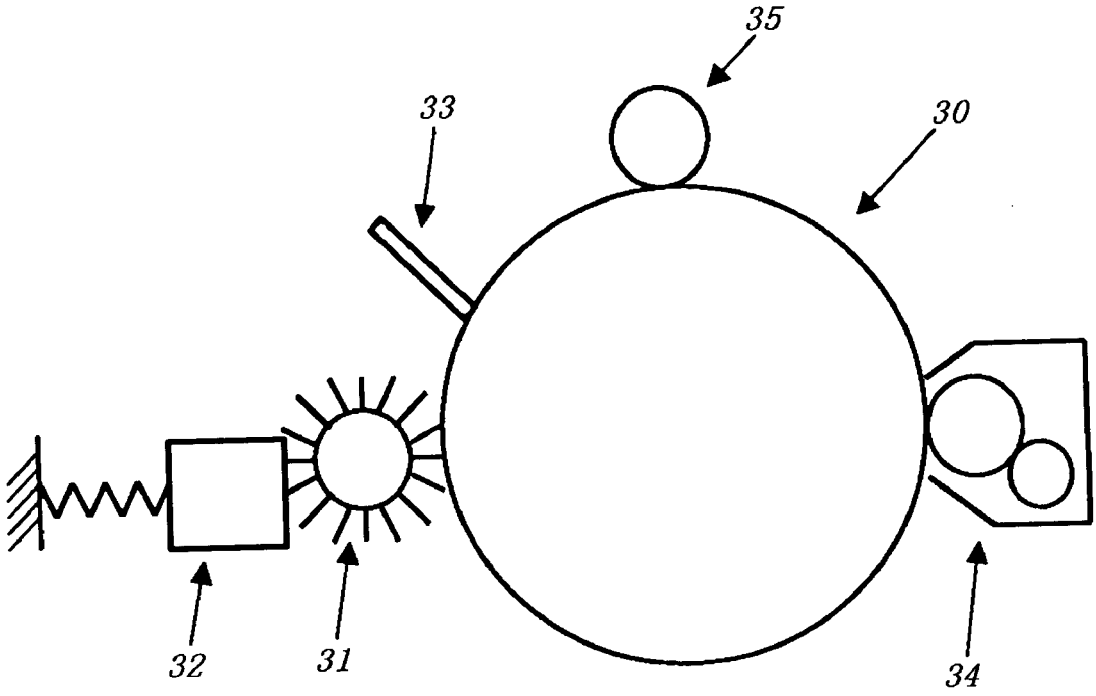
FIG. 14 schematically represents a unit to feed the charging hazard absorber.

As for the feeding way of the charging hazard absorber, the solidified charging hazard absorber may be pressed directly on the photoconductor surface, preferably, the charging hazard absorber is moved from a member that contact with the photoconductor to the photoconductor surface. For example, the charging hazard absorber is moved to the photoconductor surface through a brush-like member (preferably elastic), blade-like structural member, or roller-like member (preferably elastic). In particular, the brush-like member is preferably utilized considering the mechanical stress on the photoconductor surface. For example, the solidified charging hazard absorber is brought into contact with the brush-like member, the brush-like member is rotated, thereby the charging hazard absorber is shaved and removed gradually as a result is adhered with aid of pressing. By such processing, the charging hazard absorber 32 adheres to the photoconductor surface 30 as shown in FIG. 14; however, the charging hazard absorber 32 may adhere in powder condition to the photoconductor surface 30 in some cases; in such cases, preferably the blade-like member 33 is operated after the adhesion on the brush-like member 31, thereby the charging hazard absorber 32 is extended. As shown in FIG. 14, the brush-like member 31 should be disposed at upstream of charging member 35. The brush-like member 31 and the blade-like member 33 may be combined with a cleaning member that cleans the remaining toner.

Further, the charging hazard absorber may be effectively fed by means of the developing unit 34. In this case, the charging hazard absorber is incorporated into the developer or incorporated into the toner of the developer. In this case also, the charging hazard absorber may be adhere in powder condition to the photoconductor surface; in such cases, preferably the blade-like member is operated, thereby the charging hazard absorber is extended.

The brush-like member and the developing unit display the inherent merits and demerits in feeding the charging hazard absorber. When the brush-like member is employed, the charging hazard absorber may be easily and uniformly adhered on the photoconductor surface; however, the charging hazard absorber should be supplied during the operation of the image forming apparatus with the prolonged operation when the used amount of the charging hazard absorber is relatively large. On the other hand, when the feed is conducted by means of the developing unit, the charging hazard absorber may be supplied in the same manner as the supplied developer or toner without significant problems; however, uniform feed on the entire photoconductor is difficult when the resulting image density is considerably low or the printed area is extremely localized.

Accordingly, the combination of the brush-like member and the developing unit is very effective in feeding uniformly the charging hazard absorber so as to display the merits and compensate the demerit.

As for the opportunity to feed the charging hazard absorber, the charging hazard absorber needs to adhere on the photoconductor surface at charging the photoconductor. Accordingly, the feeding mechanism should be activated at least when the charging is conducted, regardless of forming an image; the feeding mechanism should be activated immediately before the activation of the charging member even on the preliminary operation prior to image forming, and the opportunity or timing should be controlled depending on the requirements.

A contacting and separating mechanism may be provided to the feeding mechanism of the charging hazard absorber depending on the requirements (not shown in FIG. 14). In this case, the charging member contacts with the photoconductor only when the photoconductor is subjected to charging; otherwise they are separated. Such a mechanism is effective in preventing unnecessary feed of the charging hazard absorber to the photoconductor, and in preventing the degradation of the members in contact.

As for the charging hazard absorber, any substances may be employed as long as the substance can be fed to the photoconductor and can adhere uniformly on the photoconductor surface. The charging hazard absorber performs at least to absorb the charging hazard during the passage of the photoconductor surface through the proximate region with the charging member and at least to prevent the arrival to the photoconductor surface. The charging hazard absorber may be removed from the photoconductor surface by means of the cleaning member after passing through the proximate region with the charging member. That is, the life of the charging hazard absorber is sufficient for the period corresponding to one round of the photoconductor. Accordingly, such a charging hazard absorber is preferred and available that is capable of adhering on the photoconductor surface as thin as possible with high stretchability. For example, the properties of waxes and lubricants are preferable.

As for the waxes, ester waxes and olefin waxes are preferable. The ester waxes mean the waxes having an ester bonding, for example, include natural waxes such as carnauba wax, candelira wax, and rice wax, and montan wax and the like. Examples of the olefin waxes include synthetic waxes such as polyethylene wax, polypropylene wax.

Examples of the lubricant include various fluoride resins such as PTFE, PFA, and PVDF; silicone resins, polyolefin resins; fatty metal stearates such as zinc stearate, zinc laurate, zinc myristiate, calcium stearate, aluminum stearate and the like. Among these, zinc stearate is most preferable.

When images are formed through providing the mechanism to supply a charging hazard absorber on a photoconductor surface as discussed before, such undesirable phenomena may be induced as image blurs, if the condition at the image forming apparatus is of extremely high humidity. In order to avoid such undesirable phenomena effectively, the atmosphere surrounding the charging nip is conditioned to reduce the humidity, specifically, to 50% or less of relative humidity. The available two ways will be explained.

Figure 15:
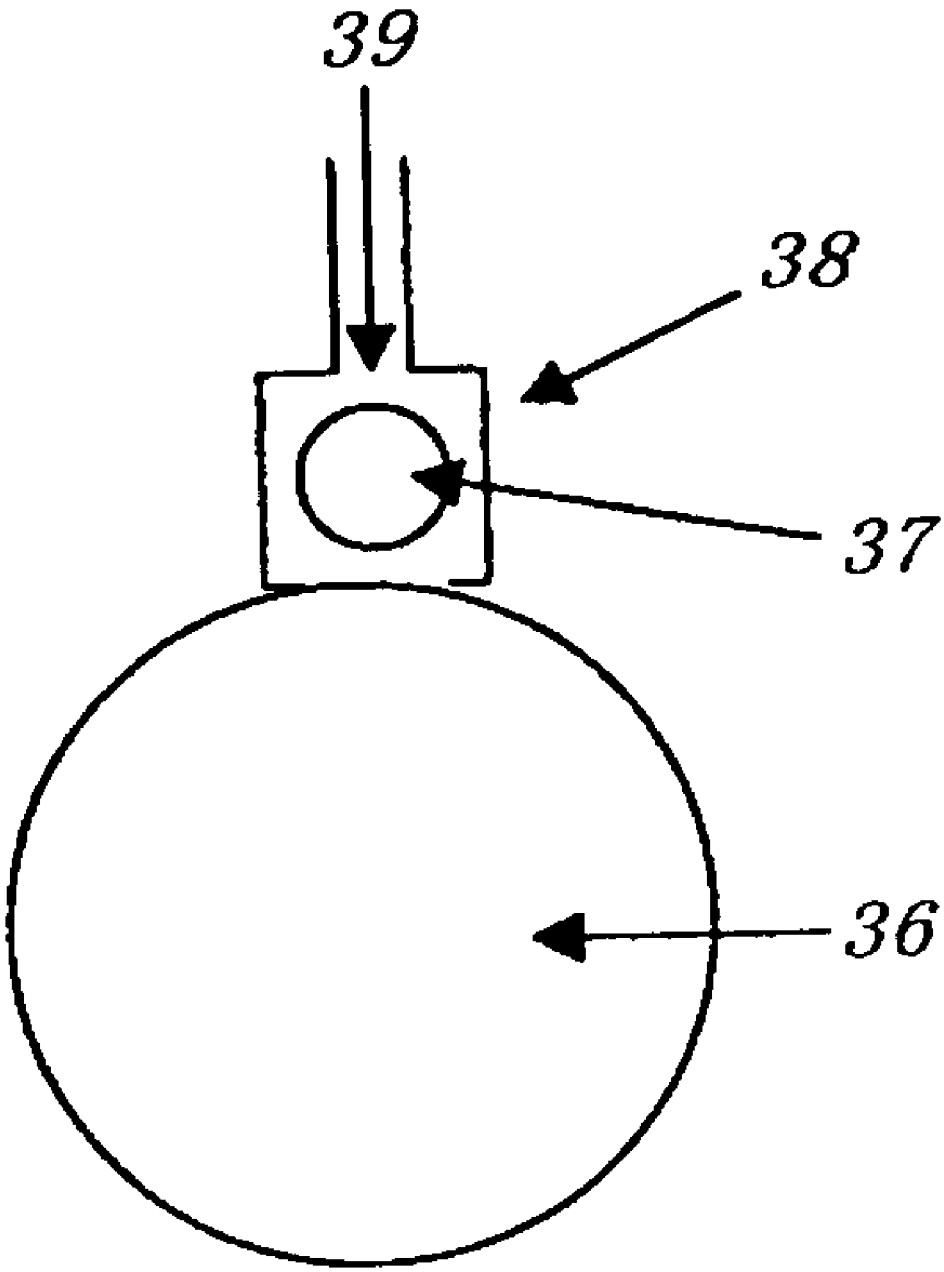
FIG. 15 schematically shows an exemplary charging member having a shield that covers the charging nip.

As for one way, a shield is provided to cover the charging nip formed between the charging member and the photoconductor, thereby the atmosphere at the charging nip is conditioned or controlled to 50% or less of relative humidity. One exemplary constitution is shown in FIG. 15 that may achieve such a condition at the charging nip. The shield 38 is disposed to cover charging roller 37 in contact with photoconductor, an inlet to introduce gas 39 is prepared at upper site of shield 38. Shied 38 may be present in contact or not in contact with photoconductor 36, as long as the atmosphere is conditioned or controlled to lower humidity. When shield 38 contacts with photoconductor 36, preferably, at least the contacting portion with photoconductor 36 is constituted by elastic material such as rubber or sponge, so as not to wear the photoconductor surface by shield 38. When shield 38 does not contact with photoconductor 36, the gap between shield 38 and photoconductor 36 is constructed as narrow as possible and the flowing rate of the introduced gas 39 is set larger, so as to maintain the lower humidity condition. The shield 38 is required to cover at least charging member 37 and charging nip portion as shown in FIG. 15, alternatively the shield may cover the entire electrophotographic portion, i.e. at least the unit of photoconductor, charging member and developing unit. In this case, the flowing rate of the introduced gas is larger, therefore, the construction is made as compact as possible. Specifically, the relative humidity (RH) at the charging nip is conditioned to 50% or less by introducing the gas with 50% or less relative humidity or with higher temperature than the room temperature.

Another way is to dispose a heating unit such as a drum heater at the inside of photoconductor, the drum heater is operated when the atmospheric humidity is above 50% RH, thereby the atmosphere at the charging nip is maintained in lower humidity. In this case, the heating unit may be effective in an open construction of the charging nip, preferably, the charging nip is covered by a shield, since the effect is more remarkable and the temperature of drum heater is relatively low, resulting in lower adverse effect on image forming and the lower electric power consumed by the drum heater.

In addition, such a way is effectively conducted as providing a shield that covers the charging nip formed between the charging member and the photoconductor, and decreasing the oxygen concentration at the charging nip lower than that of atmosphere.

The effect of reducing the oxygen concentration at the charging nip is as follows. The fractions of molecular chain resulted from the material of the photoconductor surface layer by the action of the charging hazard can create carboxylic acid by an oxidation reaction with atmospheric oxygen or ozone. The reaction proceeds in a manner of chain reaction while the activated condition or radical condition is maintained in terms of cutting the molecular chains in sequence. Although the oxidation reaction is one of solid-gas reactions, the chain reaction is a solid-solid reaction, therefore the reaction rate or efficiency of the chain reaction is much less than the former reaction. The rate of the chain reaction may be made significantly low through relaxing the subsequent oxidation reaction. The oxidation reaction is of a solid-gas reaction, the rate of which depends on the oxygen concentration. Our experiments have confirmed that the reduction of oxygen concentration can remarkably reduce the oxidative destruction, in particular at the oxygen concentration of 10% by volume or less.

The oxygen concentration in the shield may be effectively reduced by introducing a gas of lower oxygen concentration to make the atmosphere inactive. Examples of the gas include nitrogen gas, rare gas such as argon or helium. The effects of the present invention may be remarkably enhanced by the introduction of the gas in a rate corresponding to the oxygen concentration at the charging nip significantly lower than atmosphere, preferably 10% by volume or less, most preferably nearly 0% by volume.

Figure 16:
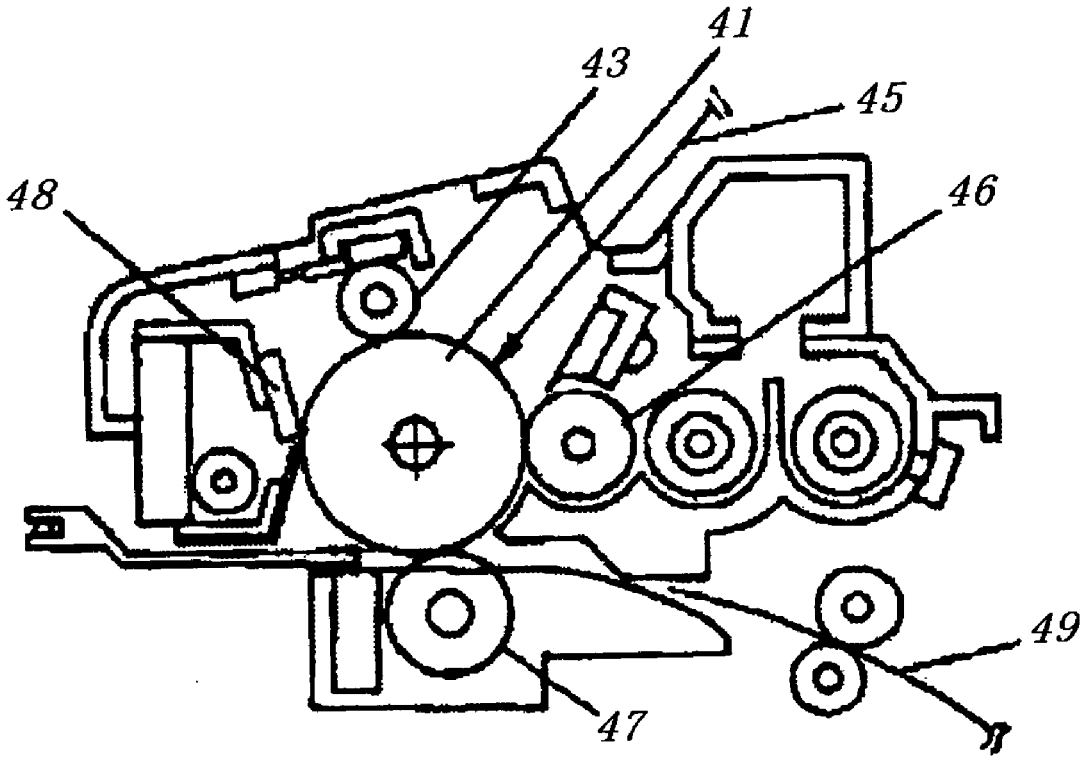
FIG. 16 schematically shows an exemplary process cartridge according to the present invention.

The image forming unit explained above may be incorporated and fixed into such apparatuses as a copier system, facsimile, and printer, alternatively, may be incorporated into a form of a process cartridge. The process cartridge means an apparatus or part into which a photoconductor is built, and also contains a charging member, exposing unit, developing unit, transferring unit, cleaning unit, charge-eliminating unit and the like. FIG. 16 shows a typical construction of the process cartridge, wherein various constructions may be present within the scope of the present invention. Regarding the numerals in FIG. 16, 41 is a photoconductor, 43 is a charging member or charging roller, 45 is an exposed image, 46 is a developing unit, 47 is a transferring member, 48 is a cleaning member, and 49 is a transferred body. Photoconductor 41 is constructed by disposing a photoconductor layer containing at least a charge-generating material and charge-transporting material on a conductive support. On the process cartridge shown in FIG. 16, a non-contacting charging member is disposed in a proximate arrangement, and AC charging is conducted. The condition of applying AC is defined in accordance with Equations (1) and (2) depending on the shape or property of the charging member, and the shape or property of the photoconductor.

Figure 17:
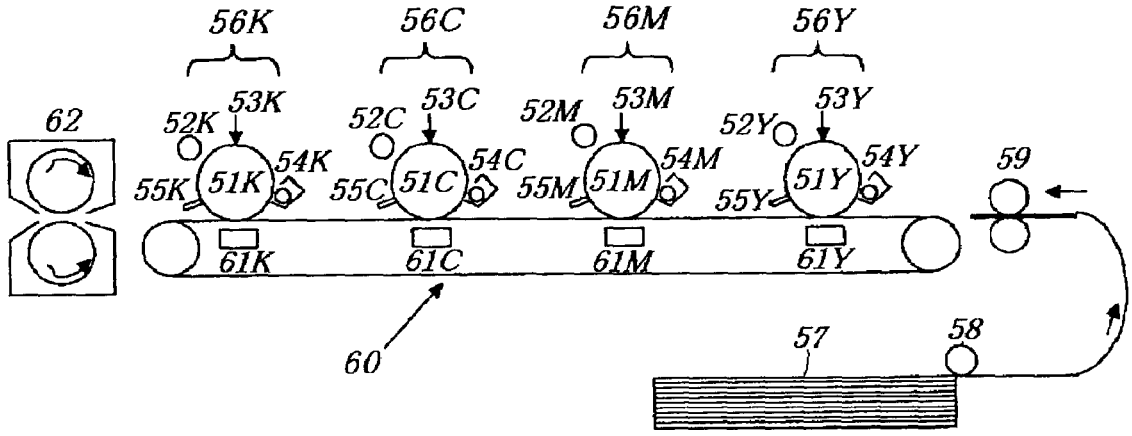
FIG. 17 schematically shows an exemplary full-color image forming apparatus of tandem type according to the present invention.

FIG. 17 schematically shows a full-color electrophotographic apparatus of tandem type according to the present invention, the following modifications are included in the present invention.

In FIG. 17, 51C, 51M, 51Y, and 51K are drum-like photoconductors, the photoconductors are constructed by providing a photoconductive layer containing a charge-generating material and a charge-transporting material on a conductive support. The photoconductors 51C, 51M, 51Y, 51K rotates in the direction indicated by the arrow in FIG. 17, and charging members 52C, 52M, 52Y, 52K, developing units 54C, 54M, 54Y, 54K, and cleaning members 55C, 55M, 55Y, 55K are disposed. The charging members 52C, 52M, 52Y, 52K are arranged to charge uniformly the photoconductor surfaces. The charging members are situated proximate to and non-contact with the photoconductor and apply charging on the photoconductor surface in a condition that satisfies the Equation (1) and (2). From the back side of the photoconductor between the charging members 52C, 52M, 52Y, 52K and developing units 54C, 54M, 54Y, 54K, laser light 53C, 53M, 53Y, 53K is irradiated from the light irradiating member (not shown), thereby latent electrostatic images are formed on photoconductors 51C, 51M, 51Y, 51K.

The four image forming elements 56C, 56M, 56Y, 56K, of which the center are photoconductors 51C, 51M, 51Y, 51K respectively, are arranged in parallel along transfer conveying belt 60. The transfer conveying belt 60 contacts with photoconductors 51C, 51M, 51Y, 51K between the developing units 54C, 54M, 54Y, 54K and the cleaning members 55C, 55M, 55Y, 55K of the respective image forming units 56C, 56M, 56Y, 56K, and transferring brushes 61C, 61M, 61Y, 61K are arranged at the rear side or rear face of the photoconductor side of the transfer conveying belt 60 in order to apply transferring bias. The constitutions of 56C, 56M, 56Y, 56K are substantially the same except that the colors in the developing apparatuses are different each other. In the constitutions, the supplying mechanism or member for charging hazard absorber 32 as shown in FIG. 14 is mounted, thereby the photoconductor surface is protected from the charging hazard.

In the constitution of the color electrophotographic apparatus shown in FIG. 17, the image forming is achieved as follows. At first, photoconductors 51C, 51M, 51Y, 51K are charged by charging members 52C, 52M, 52Y, 52K rotating as the arrow direction, i.e. co-rotating direction with the photoconductor in the respective image forming elements 56C, 56M, 56Y, 56K, then the latent electrostatic images of the respective colors are produced through laser lights 53C, 53M, 53Y, 53K irradiated from the light-exposing part (not shown). In the charging on the photoconductor surface by means of charging members, the charging is carried out in a condition that the charging hazard absorber is adhered on the photoconductor surface. Then, toner images are formed through developing the latent images by developing units 54C, 54M, 54Y, 54K. The developing units 54C, 54M, 54Y, 54K respectively conduct developing by the toner of C(cyan), M(magenta), Y(yellow), K(black), and the toner images of the respective colors formed on the four photoconductors 51C, 51M, 51Y, 51K are overlapped on the transferring paper. The transferring paper 57 is sent from the tray by means of feeding paper roller 58, is stopped at a moment by means of a pair of resist roller 59, then is sent to transfer conveying belt 60 while adjusting a timing with the image forming on the photoconductor. The transferring paper 57 sustained on transfer conveying belt 60 is conveyed, and the transfer with the respective color images is carried out at the contacting site or position with the respective photoconductor 51C, 51M, 51Y, 51K.

The toner images on the photoconductors are transferred on transferring paper 57 by the electric field formed by the potential difference between the transferring bias applied on transferring brush 61C, 61M, 61Y, 61K and photoconductor 51C, 51M, 51Y, 51K. Then, recording paper 57 having toner images of four colors overlapped at the four transferring portions is conveyed to fixing apparatus 62, where the toner is fixed, then the recording paper 57 is conveyed out to the discharged paper portion (not shown). The residual toner on the respective photoconductors 51C, 51M, 51Y, 51K, having not been transferred at the transferring portions, is recovered by the cleaning devices 55C, 55M, 55Y, 55K.

As for the image forming elements shown in FIG. 17, the color is arranged Y(yellow), M(magenta), C(cyan), K(black) in order from upstream to downstream of the conveying direction of the recording paper. The order is not necessarily defined as such and may be arranged optionally. In addition, when the prints with only black color are required, the mechanism that the colors other than black (56C, 56M, 56Y) being stopped may be effectively arranged in the present invention. Further, in FIG. 17, the charging member is of the non-contacting charging mechanism disposed proximate to the photoconductor as shown in FIG. 13 and a suitable gap (about 10 to 200 μm) is provided, therefore, the abrasion wear may be reduced for both of the members, and the toner filming on the charging member may also be reduced successfully.

(Photoconductor)

The photoconductor employed in the present invention will be explained referring to Figures.

Figure 18:
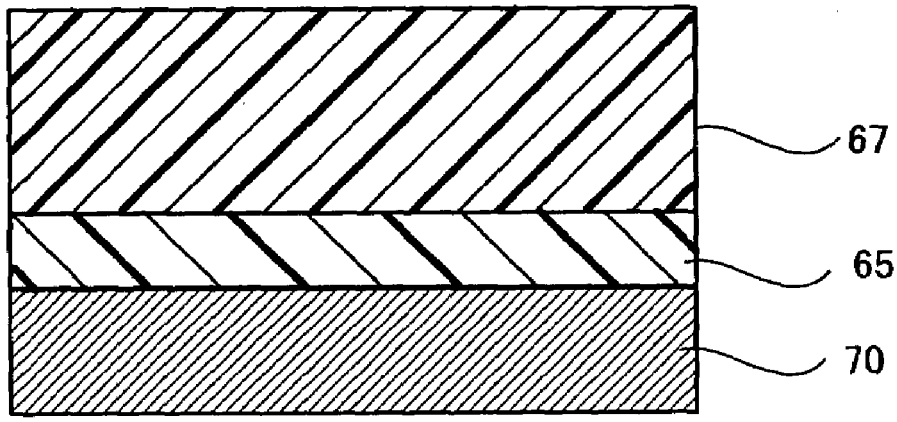
FIG. 18 schematically shows an exemplary layer construction of photoconductor according to the present invention.

FIG. 18 shows a cross-sectional view of a photoconductor adapted to the present invention, in which charge-generating layer 65 based on a charge-generating material and charge-transporting layer 67 based on a charge-transporting material are provided on conductive support 70. A photoconductive layer is exemplified that exhibits a laminate construction comprising charge-generating layer 65 and charge-transporting layer 67 in FIG. 18. By the way, the mono-layer construction of the photoconductive layer is within the scope of the present invention in which the charge-generating material and the charge-transporting material are incorporated into the momo-layer.

Figure 19:
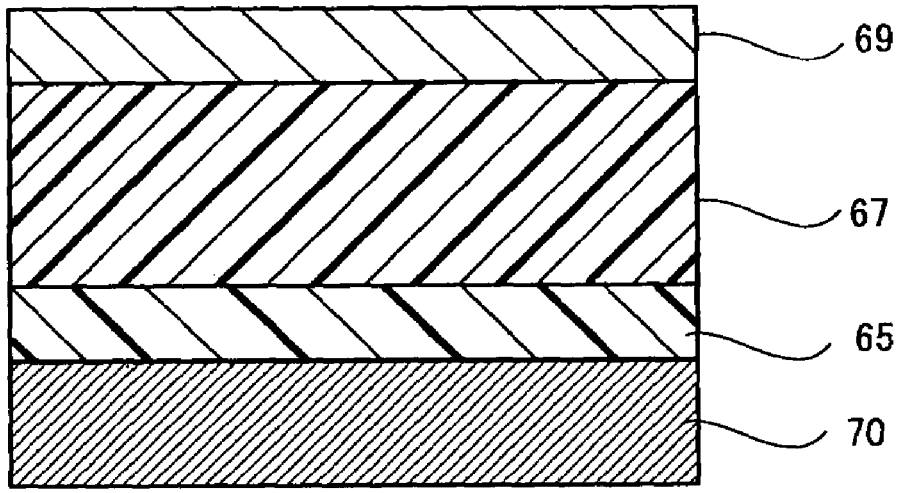
FIG. 19 schematically shows another exemplary layer construction of photoconductor according to the present invention.

FIG. 19 shows a cross-sectional view of anther photoconductor adapted to the present invention, in which protective layer 69 is laminated over the charge-generating layer 65 and charge-transporting layer 67.

As for the conductive supporter 70, a product may be used of a plastic in the form of film or a cylinder or a paper coated with a material having conductivity specified with volume resistivity equal to or less than $10^{10}$ Ω·cm, which is for example, a metal such as aluminum, nickel, chromium, nichrome, copper, gold, silver, and platinum or a metal oxide such as tin oxide and indium oxide, formed by vapor deposition or sputtering. Also, a plate made from aluminum, aluminum alloy, nickel, or stainless etc. and a pipe may be utilized which is roughly formed by extrusion and drawing process from the plate followed by surface processing such as cutting, super finishing, and polishing. An endless nickel belt and an endless stainless belt may be utilized as the conductive supporter 70, as is disclosed in JP-A No. 52-36016.

Also, a cylindrical support made from aluminum may be utilized most preferably to which anodizing can be easily applied. The term "aluminum" includes both pure aluminum and an aluminum alloy. Specifically, aluminum selected from JIS No. 1000, 3000, and 6000 groups or an aluminum alloy is most appropriate. An oxide film on an anode is formed by anodizing each kind of metal or each kind of metal alloy in electrolyte solution. In particular, the coating called alumite in which aluminum or an aluminum alloy is anodized in electrolyte solution is most appropriate for a photo conductor used in the present invention. The above conductive supports are preferable with respect to preventing the occurrences of point defects such as black void or background smear especially when it is applied to a reverse development i.e. a negative or positive development. Further, the reference numerals in FIG. 13 represent 21: spacer, 22: electrode, 23: image forming region, 24: non-image forming region.

The anodic oxide coating is carried out in acid solution of chromic acid, sulfuric acid, oxalic acid, phosphoric acid, boric acid, sulfamic acid, or the like. Among these, anodic oxide coating in a sulfuric acid bath is most appropriate. For example, anodic oxide coating is carried out under the conditions in which the concentration of sulfuric acid is 10 to 20%, bath temperature is 5 to 25° C., current density is 1 to 4 A/dm$^2$, bath voltage is 5 to 30V, and time period for anodizing is about 5 to 60 minutes, but not limited to these conditions. The resulting oxidation film on the anode is porous and exhibits a high insulating property, and the surface of the film is considerably unstable. Therefore, the anodic oxide coating tends to vary with time, and physical properties of the coating are likely to vary. In order to prevent the variation, it is preferable to further apply a sealing treatment to the anodized film. As the sealing treatment, several processing may be employed, that is, immersing the anodized film in a solution including nickel fluoride or nickel acetate, immersing the anodized film in boiling water, and treating the film by pressurized steam. Among the processing, immersing in a solution including nickel acetate is most preferable. A washing treatment is applied to anodized film following the sealing treatment. A main object of the washing treatment is to remove residual metal salt and the like, adhering due to the sealing treatment. When the excessive metal salt remains on the surface of the support (the anodic oxide coating), since low resistance components in the salt generally remain, the components cause generation of stains on image background as well as adverse effects on the quality of coating film formed on the surface. Although the washing treatment may be accomplished with purified water, multi-step washing is commonly performed. In this case, it is preferable for cleaning liquid to be used at final washing to be as clean (de-ionized) as possible. Also, it is desirable to physically rub the conductive supporter during washing by using a contact member in a process within a multi-step washing process. It is preferable that film thickness of the anodized film formed like above be about from 5 to 15 μm. If the thickness is thinner than 5 μm, the effect of barrier property of the anodized film is not enough. When the thickness is over 15 μm, the time constant of the film as an electrode become too large, and generation of residual potential and deterioration of response of a photo conductor may occur.

Furthermore, a coated support which is prepared by dispersing conductive fine particles and a suitable binder resin and coating the same onto the above-mentioned conductive support may also be utilized as the conductive support 70 in the present invention. Examples of the conductive fine particles include carbon black, acetylene black, metal power fine particles, such as aluminium, nickel, iron, nichrome, copper, zinc and silver, and metal oxide fine particles, such as conductive tin oxide, ITO, etc. As for the binder resin which is used together with the conductive fine particles, any of the following resin may utilized: polystyrene, styrene acrylonitrile copolymer, styrene butadiene copolymer, styrene maleic anhydride copolymer, polyester, polyvinyl chloride, vinyl chloride vinyl acetate copolymer, polyvinyl acetate, polyvinylidene chloride, polyacrylate resin, phenoxy resin, polycarbonate, cellulose acetate resin, ethyl-cellulose resin, polyvinyl butyral, polyvinyl formal, polyvinyl toluene, poly-N-vinylcarbazole, acrylate resin, silicone resin, epoxy resin, melamine resin, urethane resin, phenol resin, alkyd resin, etc.

The conductive layer can be prepared by dispersing and coating the conductive fine particles and the binder resin to a suitable solvent, for example, tetrahydrofuran, dichloromethane, methyl ethyl ketone, toluene, etc.

Further, the conductive support which is prepared by forming the conductive layer on a suitable cylinder base with a thermal-contraction inner tube which is made of a suitable material, such as polyvinyl chloride, polypropylene, polyester, polystyrene, polyvinylidence chloride, polyethylene, chlorinated rubber, Teflon (registered trade name), etc. and contain the conductive fine particles may also be utilized as the conductive support 70 in the present invention.

The photoconductive layer will be explained in the following. The photoconductive layer may be any of monolayer or laminated-layer. Initially, the construction containing the charge-generating layer 65 and the charge-transporting layer 67 as shown in FIG. 19 will be discussed.

The charge-generating layer 65 is based on a charge-generating substance. The charge-generating layer 65 may be formed from conventional charge-generating materials, examples thereof include monoazo pigments, disazo pigments, trisazo pigments, perylene pigments, perynone pigments, quinacridone pigments, quinone type condensed polycyclic compounds, squaric acid type dyes, phthalocyanine pigments, naphthalocyanine pigments, azulenium salt dyes, and the like pigments. These charge-generating substances may be used alone or in combination.

Among these pigments and dyes, azo pigments having the formula (XI) set forth later in particular, and titanyl phthalocyanine having an X-ray diffraction spectrum in which the highest peak is observed at Bragg 2θ angle of 27.2°±0.2° when a specific X-ray of CuKα having a wavelength of 1.541 Å irradiates the titanyl phthalocyanine pigment are preferably employed in the full-color image forming apparatus according to the present invention since they are highly sensitive and highly durable, in particular resistant against light irradiation.

Further, since the compounds in which $C_{p1}$ and $C_{p2}$ are different exhibit high sensitivity in particular among the compounds of formula (XI), therefore, are preferably utilized as the charge-generating substance in the present invention.

The charge-generating substances of azo pigment may be those expressed by the following Formula (XI):

Formula (XI)

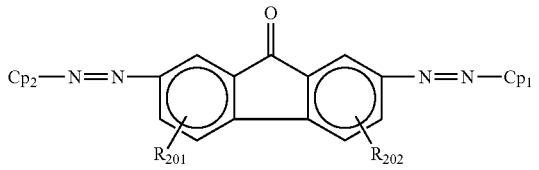

in the Formula (XI), $R_{201}$, $R_{202}$ may be identical or different, may be hydrogen atom, halogen atom, cyano group, alkyl group that may be substituted, or alkoxy group that may be substituted; Cp1 and Cp2 are coupler residues that may be identical or different, being expressed by the following Formula (XII), Formula (XII)

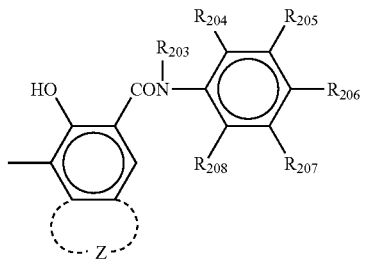

in Formula (XII), $R_{203}$ is an alkyl group that may be substituted or an aryl group that may be substituted; $R_{204}$, $R_{205}$, $R_{206}$, $R_{207}$, and $R_{208}$ may be identical or different, may be hydrogen atom, nitro group, cyano group, halogen atom, trifluoromethyl group, hydroxyl group, alkyl group that may be substituted, alkoxy group that may be substituted, or dialkylamino group that may be substituted; and Z is an aromatic carbon ring that may be substituted, or an aromatic hetero ring that may be substituted.

Among the titanyl phthalocyanines exhibiting the highest diffraction peak at Bragg 2θ angle of 27.2°, the titanyl phthalocyanine crystals exhibiting main peaks at 9.4°, 9.6°and 24.0°, at 7.3° as the lowest angle, and does not exhibit any peak between 7.3° and 9.4°, and does not exhibit at 26.3° demonstrates higher sensitivity in particular, lower decrease of charging property after the repeated usage of the photoconductor, therefore, are properly available charge-generating substances for the photoconductor in the present invention. Such titanyl phthalocyanines are disclosed in JP-A No. 2001-019871.

The charge-generating layer 65 may be formed by dispersing the charge-generating substance, and binder resin optionally used in a suitable solvent, by means of a ball mill, attriter, sand mill, ultrasonic, coating on the conductive support, and drying it.

Suitable binder resins, which are optionally used for the charge-generating layer 65, include polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins. The content of the binder resin in the charge-generating substance is preferably from 0 to 500 parts by mass, and preferably from 10 to 300 parts by mass, per 100 parts by mass of the charge-generating substance.

Examples of the suitable solvent for use include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used. The way to coat the coating liquid is for example immersion coating, spray coating, beat coating, spinner coating, ring coating or the like.

The thickness of charge-generating layer 65 is preferably 0.01 to 5 μm, more preferably 0.1 to 2 μm.

The charge-transporting layer 67 may be formed by dissolving or dispersing the charge-transporting substance and binder resin in a suitable solvent, the solution or dispersion is coated on as a charge-generating layer, and drying. Optionally, plasticizer, leveling agent, and antioxidant and the like may be added.

The charge transferring-substance is classified into hole transporting substance and electron transporting substance. Examples of the electron transporting substance include chloroanil, bromoanil, tetracyanoethylene, tetracyano quinodimethan, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indino[1,2-b]thiophene 4-on, 1,3,7-trinitro-dibenzothiophene-5,5-dioxide, and benzoquinone. These are electron accepting substances.

Examples of the positive-hole transporting substance include poly-N-carbazole and its derivatives, poly-y-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bis-stilbene derivatives, enamine derivatives, and the like. These charge-transporting substances may be used alone or in combination.

Examples of the binder resin include polystyrene, styrene-acrylonitrile copolymer, styrene-butadiene copolymer, styrene-maleicanhydride copolymer, polyester, polyvinyl chloride, vinylchloride-vinylacetate copolymer, polyvinyl acetate, polyvinylidene chloride, polyacrylate resin, phenoxy resin, polycarbonate, celluloseacetate resin, ethyl-cellulose resin, polyvinyl butyral, polyvinyl formal, polyvinyl toluene, poly-N-vinylcarbazole, acrylate resin, silicone resin, epoxy resin, melamine resin, urethane resin, phenol resin, alkyd resin, and the like. In addition, the polymer charge-transferring substances may be properly utilized for the binder resin of the charge-transferring layer. When the charge-transferring layer of polymer charge-transferring substance is employed, appropriate results may be often achieved at laminating the surface protective layer since the solution of the charge-transferring layer into the upper layer is lower due to the polymer property.

The amount of the charge transferring substance is preferably 20 to 300 parts by mass, more preferably 40 to 150 parts by mass based on the 100 parts by mass of the binder resin. The layer thickness of the charge transferring layer is preferably 5 to 100 μm.

Examples of the suitable solvent for use include tetrahydrofuran, dioxane, toluene, dichloromethane, monochlorobenzene, dichloroethane, cyclohexanone, methyl ethyl ketone, acetone and the like.

In the photoconductor adapted to the present invention, the charge-transporting layer 67 may include additives such as plasticizers and leveling agents. Specific examples of the plasticizers include known plasticizers, which are used for plasticizing resins, such as dibutyl phthalate, dioctyl phthalate and the like. The added quantity of the plasticizer is 0 to 30% by mass based on the binder resin. Specific examples of the leveling agents include silicone oils such as dimethyl silicone oil, and methyl phenyl silicone oil; polymers or oligomers including a perfluoroalkyl group in their side chain, and the like. The added quantity of the leveling agents is 0 to 1% by mass of the binder resin included in the binder resin.

The object of the present invention relate to achieve the charge uniformity as well as charging hazard reduction, in connection with the increment of charging hazard on the photoconductor surface due to AC charging. As discussed before, the increment of charging hazard causes the increment of abrasion wear along with the decrease of mechanical durability due to the cut of molecular chain that constitutes the components in particular the polymer components of the photoconductor surface layer.

Against the undesirable phenomena, the charging conditions are determined in terms of the photoconductor type such as diameter, composition and the like, thereby the object may be achieved. By the way, with respect to the decrease of wear resistance due to the charging hazard, the wear resistance at initial stage may be improved by the material or construction of the photoconductor surface layer.

In other words, provided that a superior wear resistance is designed at the initial stage, the photoconductor may maintain the superior condition even if the wear resistance is decreased due to the charging hazard, and the photoconductor may perform the effect of the present invention.

For example, there exist two ways. One way is to increase the wear resistance of photoconductive layer or charge-transporting layer corresponding to the photoconductor surface layer without employing the protective layer. As for the way, the usage of lower molecular components is avoided as low as possible; for example, the polymer charge-transporting substance is employed as the binder resin of the photoconductive layer or charge-transporting layer. As such, the decrease of the wear resistance is prevented through maintaining the engaging density of the molecular chain as much as possible even though a portion of the molecular chains is cut off. Another way is to employ the protective layer. As discussed forth later, the contacting member such as cleaning member is improved with respect to wear resistance by means of filler material, the polymer charge-transporting substance may prevent the decrease of wear resistance similarly to the photoconductive layer, and further the decrease of wear resistance may be decreased through using the binder resin having three-dimensional cross-linking structure and preventing the defect of the molecule due to molecular chain cut, and relaxing the decrease degree of the wear resistance. These technologies may be effectively utilized to additionally enhance the effect of the present invention.

A polymer charge transport material having both a function of charge transport material and a function of binder resin, may conveniently be used in the charge transport layer. The charge-transporting layer that comprises such a polymer of charge-transporting material may exhibit a superior wear resistance. The polymer of charge-transporting material may be a known material, particularly, a polycarbonate having a triarylamine structure in the main chain and/or side chain performs well. In particular, the polymer charge-transporting substances expressed by Formulas (I) to (X) are appropriately utilized; these substances will be specifically explained.

In Formula (I), $R_1$, $R_2$, $R_3$ are respectively substituted or unsubsituted alkyl groups or halogen atoms, $R_4$ is a hydrogen atom or a substituted or unsubsituted alkyl group, $R_5$, $R_6$ are substituted or unsubsituted aryl groups, o, p, q are integers in the range of 0 to 4, k, j represent compositional fractions where $0.1 \leqq k \leqq 1$, $0 \leqq j \leqq 0.9$, n represents the number of repeating units and is an integer in the range of 5 to 5000. X is an aliphatic divalent group, a cyclic aliphatic divalent group, or the divalent group expressed by the following two formulas. In addition, the two units in Formula (I) may be repeated alternatively or arranged in random in the polymer.

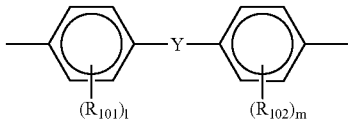

In the above formula, $R_{101}$, $R_{102}$ are respectively substituted or unsubsituted alkyl groups, an aryl group, or a halogen atom, l, m are integers in the range of 0 to 4, Y is a single bond, straight-chain, branched or cyclic alkylene group having 1 to 12 carbon atoms, —O—, —S—, —SO—, —$SO_2$—, —CO—, —CO—O-Z-O—CO— (Z is an aliphatic divalent group), or:

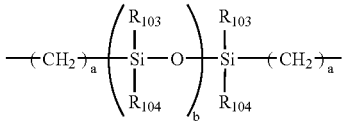

a is an integer in the range of 1 to 20, b is an integer in the range of 1 to 2,000, $R_{103}$, $R_{104}$ are substituted or unsubstituted alkyl groups or aryl groups. $R_{101}$, $R_{102}$, $R_{103}$, $R_{104}$ may be respectively identical or different.

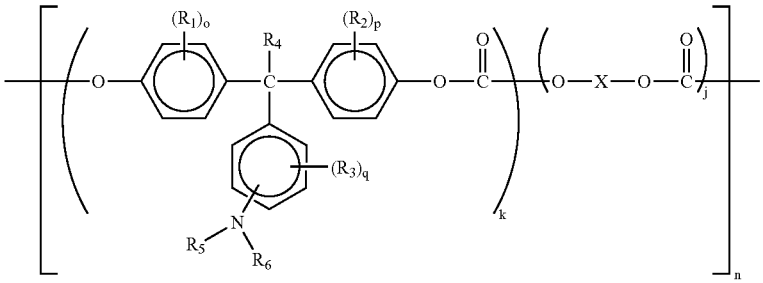

Formula (I)

Formula (II)

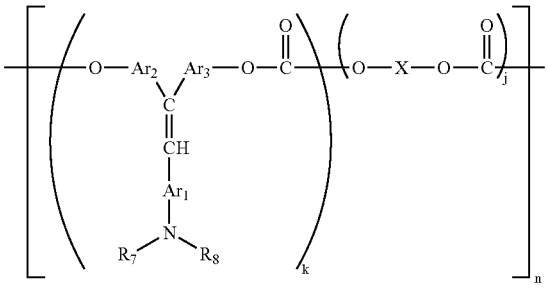

In Formula (II), $R_7$, $R_8$ are substituted or unsubstituted aryl groups, $Ar_1$, $Ar_2$, $Ar_3$ are arylene groups which may be identical or different, X, k, j and n are the same as in Formula (I). In addition, the two units in Formula (II) may be repeated alternatively or arranged in random in the polymer.

Formula (III)

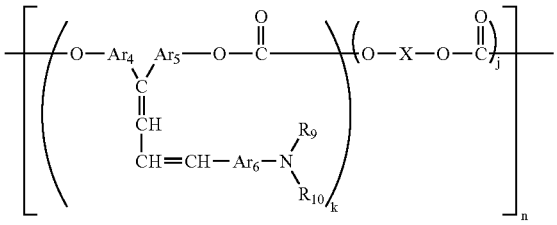

In Formula (III), $R_9$, $R_{10}$ are substituted or unsubstituted aryl groups, $Ar_4$, $Ar_5$, $Ar_6$ are arylene groups which may be identical or different, X, k, j and n are the same as in Formula (II). In addition, the two units in Formula (I) may be repeated regularly or arranged in random in the polymer.

Formula (IV)

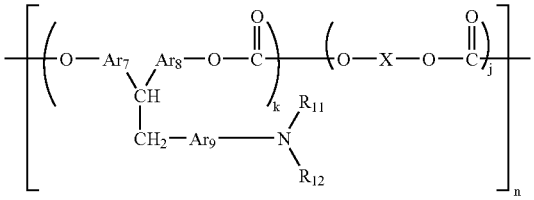

In Formula (IV), $R_{11}$, $R_{12}$ are substituted or unsubstituted aryl groups, $Ar_7$, $Ar_8$, $Ar_9$ are arylene groups which may be identical or different, p is an integer in the range of 1 to 5, X, k, j and n are the same as in Formula (I).

Formula (V)

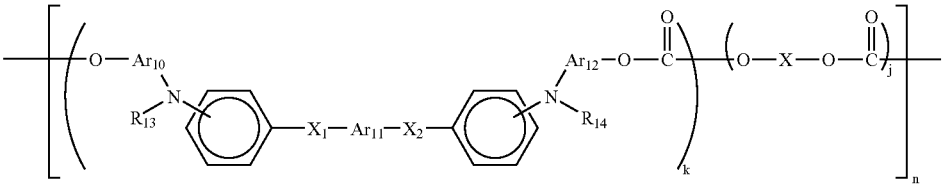

In Formula (V), $R_{13}$, $R_{14}$ are substituted or unsubstituted aryl groups, $Ar_{10}$, $Ar_{11}$, $Ar_{12}$ are arylene groups which may be identical or different, $X_1$, $X_2$ are substituted or unsubstituted ethylene groups, or substituted or unsubstituted vinylene groups. X, k, j and n are the same as in Formula (I).

Formula (VI)

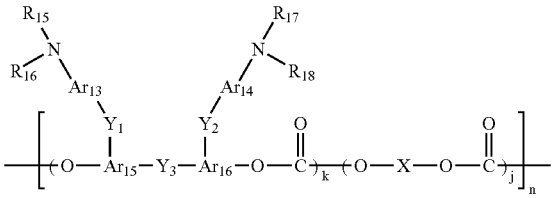

In Formula (VI), $R_{15}$, $R_{16}$, $R_{17}$, $R_{18}$ are substituted or unsubstituted aryl groups, $Ar_1$, $Ar_2$, $Ar_3$ are arylene groups which may be identical or different, $Y_1$, $Y_2$, $Y_3$ are single bond, substituted or unsubstituted alkylene groups, substituted or unsubstituted cycloalkylene groups, substituted or unsubstituted alkylene ether groups, oxygen atoms, sulfur atoms or vinylene groups. X, k, j and n are the same as in Formula (I).

Formula (VII)

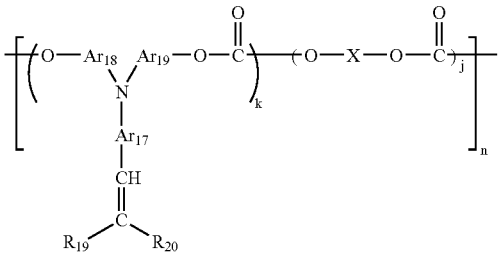

In Formula (VII), $R_{19}$, $R_{20}$ are hydrogen atoms, or substituted or unsubstituted aryl groups, and $R_{19}$, $R_{20}$ may form a ring. $Ar_{17}$, $A_{18}$, $A_{19}$ are arylene groups which may be identical or different. X, k, j and n are the same as in Formula (I).

Formula (VIII)

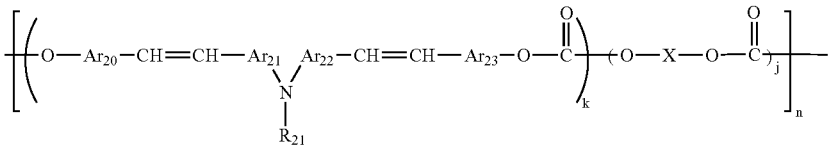

In Formula (VIII), $R_{21}$ is a substituted or unsubstituted aryl group, $Ar_{20}$, $Ar_{21}$, $Ar_{22}$, $Ar_{23}$ are arylene groups which may be identical or different, X, k, j and n are the same as in Formula (I).

Formula (IX)

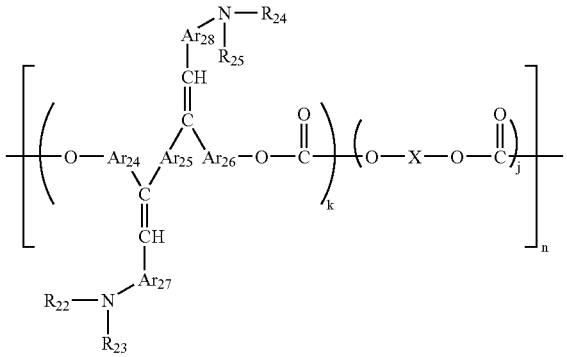

In Formula (IX), $R_{22}$, $R_{23}$, $R_{24}$, $R_{25}$ are substituted or unsubstituted aryl groups, $Ar_{24}$, $Ar_{25}$, $Ar_{26}$, $Ar_{27}$, $Ar_{28}$ are arylene groups which may be identical or different. X, k, j and n are the same as in Formula (I).

Formula (X)

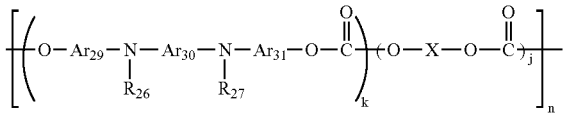

In Formula (X), $R_{26}$, $R_{27}$ are substituted or unsubstituted aryl groups, $Ar_{29}$, $Ar_{30}$, $Ar_{31}$ are arylene groups which may be identical or different. X, k, j and n are the same as in Formula (I).

As for the polymer charge-transporting substance utilized in the charge transferring layer, the following two or three dimensional cross-linking structure may be included as forming a film of charge-transporting layer in a condition of monomer or oligomer having electron-donating groups, allowing a hardening reaction or cross-linking reaction after forming a film, resulting in a polymer with the two or three dimensional cross-linking structure.

The charge-transporting layer formed from such a polymer having an electron donating group or the polymer with such cross-linking structure may exhibit superior abrasion resistance. Since the charging voltage or the voltage of the un-exposing portion is constant in the image forming apparatus, the electric field exposed to the photoconductor comes to higher as the abrasion wear of the surface layer of photoconductor increases with the repeated usage. Higher wear resistance of the photoconductor is advantageous for the background smear, since the occurrence of the background smear comes to more frequent along with the increase of the field intensity. The charge transferring layer, formed of the polymer having an electron donating group, exhibits superior film-forming ability since it is a polymer compound itself, at the same time the charge-transporting portion may be made higher dense and exhibit higher charge-transporting ability compared with the charge-transporting layer formed of the polymer with lower molecular weight. Therefore, the photoconductor having a charge-transporting layer of polymer charge transferring substance may present higher responsibility.

As for other polymers having electron donating groups, copolymers of known monomers, block copolymers, graft copolymers, star polymers, and crosslinking polymers having electron-donating groups, for example disclosed in JP-A No. 3-109406, No. 2000-206723, and No. 2001-34001 are included in the materials and may be utilized satisfactorily.

The photoconductive layer will be explained in terms of mono-layer construction. The photoconductor is usable in which the charge-generating substance discussed above is dispersed into the binder resin. The mono-layer photoconductive layer may be formed by dissolving or dispersing the charge-generating substance, charge-transporting substance and binder resin into a suitable solvent, then coating and drying. In addition, the photoconductive layer may be of function-separating type with suitable application by adding the charge-transporting substance. Further, plasticizer, leveling agent, anti-oxidant and the like depending on the requirements.

As for the binder resin, the binder resins exemplified with the charge-transporting substance 67 may be utilized solely, or the binder resins exemplified with the charge-generating substance 65 may be utilized in combination. In addition, the polymer charge-transporting substance may be properly utilized as binder resin and/or charge-transporting substance. The amount of the charge-generating substance is preferably 5 to 40 parts by mass based on 100 parts by mass of binder resin, the amount of the charge-transporting substance is preferably 0 to 190 parts by mass, more preferably 50 to 150 parts by mass. The mono-layer photoconductive layer may be formed by dispersing charge-generating substance, binder resin, charge-transporting substance if necessary, and solvent such as tetrahydrofuran, dioxane, dichloroethane, cyclohexane are dispersed by means of a mixer to prepare a coating liquid, then coating it by immersion coating, spray coating, bead coating, and the like. The film thickness of the mono-layer photoconductive layer is preferably 5 to 100 μm.

In the photoconductor available for the present invention, an under-coating layer may be provided between the conductive support 70 and photoconductive layer (charge-generating layer). The under-coating layer is usually based on a resin, preferably the resin is of solvent resistance against common organic solvents since the photoconductive layer is coated on the resin by means of solvents. Examples of the resin include water-soluble resins such as a polyvinyl alcohol, casein, a poly(sodium acrylate) and the like; alcohol-soluble resins such as a nylon copolymer, a methoxymethylated nylon and the like; curing-type resins which form three-dimensional network structure, such as a polyurethane, a melamine resin, an alkyd-melamine resin, an epoxy resin and the like. Further, fine powders such as metal oxides, for example, titanium oxide, silica, alumina, zirconium oxide, stannic oxide, indium oxide, and the like, may be added to the under-coating layer in order to prevent moiré pattern or to decrease residual potential.

These under-coating layers may be formed using an appropriate solvent and a coating method in the same manner as the photosensitive layer. Further, a silane coupling agent, titanium coupling agent, chromium coupling agent, and the like may be applied to the under-coating layer. In addition, as for the under-coating layer, $Al_2O_3$ coating may be applied by anodic oxide, or organic matters such as a poly(p-xylene) (parylene) or inorganic matters such as $SiO_2$, $SnO_2$, $TiO_2$, ITO, $CeO_2$ or the like may be applied by a thin-film preparing process using vacuum. The thickness of the under-coating layer is preferably 0 to 5 μm.

In addition, in order to improve the durability, in particular, to prevent the decrease of sensitivity and to prevent the increase of residual potential, anti-oxidant, plasticizer, lubricant, UV-rays absorber, charge-transporting substance of lower molecular weight, leveling agent and the like may be incorporated into the respective layers in the present invention. The representative compounds will be exemplified as follows.

The anti-oxidant available for the respective layers may be exemplified as follows, but not limited to.

(a) Phenol Compounds:

2,6-di-t-butyl-p-cresol, butyl hydroxy anisole, 2,6-di-t-butyl-4-ethyl phenol, n-octadecyl-3-4'-hydroxy-3-5-di-t-butyl phenol, 2,2-methylene-vis-(4-methyl-6-t-butyl phenol), 2,2-methylene-vis-(4-ethyl-6-t-butyl phenol), 4,4-thiovis-(3-methyl-6-t)-butyl phenol, 4,4-butylydenevis-(3-methyl-6-t-butyl phenol), 1,1,3-tri-(2-methyl-4-hydroxy 5-t-butyl phenyl)butane, 1,3,5-tri-methyl-2,4,6-tri-(3,5-di-t-butyl-4-hydroxy benzyl)benzene, tetrakis-[methylene 3-(3,5-di-t-butyl-4-hydroxy-phenyl)propionate]methane, vis-[3,3-vis-(4-hydroxy 3-t-butyl phenyl) butylic acid]glycolester, tocopherol, etc.

(b) Paraphenylene Diamine Compounds:

N-phenyl-N-isopropyl-p-phenylene diamine, N,N-di-sec-butyl-p-phenylene diamine, N-phenyl-N-sec-butyl-p-phenylene diamine, N,N-di-isopropyl-p-phenylene diamine, N,N-dimethyl-N,N-di-t-butyl-p-phenylene diamine, etc.

(c) Hydroquinone Compounds:

2,5-di-t-octyl hydroquinone, 2,6-di-dodecyl hydroquinone, 2-dodecyl hydroquinone, 2-dodecyl 5-chloro hydroquinone, 2-t-octyl 5-methyl hydroquinone, 2-(2-octadecenyl)-5-methyl hydroquinone, etc.

(d) Organosulfur Compounds:

Dilauril-3,3-thiodipropionate, distearil-3,3-thiodipropionate, tetradecyl-3,3-thiodipropionate, etc.

(e) Organophosphorus Compounds:

Triphenyl phosphine, tri(nonyl phenyl) phosphine, tri(dinonyl phenyl) phosphine, tri-cresil phosphine, tri(2,4-dibutyl phenoxy) phosphine, etc.

The plasticizer available for the respective layers may be exemplified as follows, but not limited to.

(a) Phosphate Ester Plasticizer:

Triphenyl phosphate, tricresyl phosphate, trioctyl phosphate, octyl diphenyl phosphate, trichloro ethyl phosphate, cresyl diphenyl phosphate, tributyl phosphate, tri-2-ethyl hexyl phosphate, triphenyl phosphate, etc.

(b) Phthalate Ester Plasticizer:

Dimethyl phthalate, diethyl phthalate, diisobutyl phthalate, dibutyl phthalate, diheptyl phthalate, di-2-ethyl hexyl phthalate, di-isooctyl phthalate, di-n-octyl phthalate, di-nonyl phthalate, di-isononyl phthalate, di-isodecyl phthalate, di-undecyl phthalate, di-tridecyl phthalate, di-cyclohexyl phthalate, benzyl butyl phthalate, butyl lauryl phthalate, methyl oleil phthalate, octyl decyl phthalate, di-butyl fumarate, di-octyl fumarate, etc.

(c) Aromatic Carboxylate Ester Plasticizer:

Trioctyl trimellitate, tri-n-octyl trimellitate, octyl benzoate, etc.

(d) Aliphatic Dibasic Acid Ester Plasticizer:

Dibutyl adipate, di-n-hexyl adipate, di-2-ethyl hexyl adipate, di-n-octyl adipate, n-octyl n-decyl adipate, di-isodecyl adipate, di-capryl adipate, di-2-ethyl hexyl azelate, di-methyl sebacate, di-ethyl sebacate, dibutyl sebacate, di-n-octyl sebacate, di-2-ethyl hexyl sebacate, di-2-ethoxy ethyl sebacate, di-octyl succinate, di-isodecyl succinate, tetrahydro dioctyl phthalate, di-n-octyl tetrahydro phthalate, etc.

(e) Fatty-acid Ester Derivative:

Butyl oleate, a glycerol monochrome oleate, an acetyl methyl ricinoleate, pentaerythritol ester, dipentaerythritol hexa ester, triacetin, tributylin, etc.

(f) Oxyacid Ester Plasticizer:

Acetyl methyl ricinoleate, butyl acetyl ricinoleate, butyl phthalyl butyl glycolate, acetyl tributyl citrate, etc.

(g) Epoxy Plasticizer:

Epoxy soybean oil, epoxy linseed oil, epoxy butyl stearate, epoxy decyl stearate, epoxy octyl stearate, epoxy benzyl stearate, epoxy hexa hydro dioctyl phthalate, epoxy hexa hydro di-decyl phthalate, etc.

(h) Dihydric Alcohol Ester Plasticizer:

Diethylene glycol di-benzoate, tri-ethylene-glycol di-2-ethyl butyrate, etc.

(i) Chlorine-containing Plasticizer:

Chlorinated paraffin, chlorinated diphenyl, chlorination fatty acid methyl, methoxy chlorination fatty acid methyl, etc.

(j) Polyester Plasticizer:

Polypropylene adipate, polypropylene sebacate, polyester, acetylation polyester, etc.

(k) Sulfonic Acid Derivatives:

p-toluenesulfonamide, o-toluenesulfonamide, p-toluene sulfone ethyl amide, o-toluene sulfone ethyl amide, toluene sulfone-N-ethyl amide, p-toluene sulfone-N-cyclohexyl amide, etc.

(l) Citric Acid Derivatives:

Citric acid tri-ethyl, acetyl citric acid tri-ethyl, tri-butyl citrate, an acetyl tri-butyl citrate, an acetyl citric acid tree 2-ethyl hexyl, acetyl citric acid-n-octyl decyl, etc.

(m) Others:

Tarphenyl, camphor, 2-nitroglycerine diphenyl, dinonylnaphthalene, methyl abietate, etc.

The lubricants available for the respective layers may be exemplified as follows, but not limited to.

(a) Hydrocarbon Compounds:

Liquid paraffin, paraffine wax, micro wax, low polymerization polyethylene, etc.

(b) Fatty Acid Compounds:

Lauric acid, myristic acid, palmitic acid, stearic acid, arachidic acid, behenic acid, etc.

(c) Fatty Acid Amide Compounds:

Stearoyl amide, palmityl amide, olein amide, methylene vis stearoyl amide, ethylene vis stearoyl amide, etc.

(d) Ester System Compounds:

A lower-alcohol ester of fatty acid, polyhydric alcohol ester of fatty acid, fatty acid polyglycol ester, etc.

(e) Alcoholic System Compounds:

Cetyl alcohol, stearoyl alcohol, ethylene glycol, polyethylene glycol, poly glycerol, etc.

(f) Metal Soap:

Lead stearate, cadmium stearate, barium stearate, calcium stearate, zinc stearate, magnesium stearate, etc.

(g) Natural Wax:

Carnauba wax, montan wax, candelilla wax, bees wax, whale wax, etc.

(h) Others:

Silicone compound, fluorine compound, etc.

The UV ray absorber available for the respective layers may be exemplified as follows, but not limited to.

(a) Benzophenone Compounds:

2-hydroxy-benzophenone, 2,4-dihydroxy-benzophenone, 2,2,4-trihydroxy-benzophenone, 2,2,4,4-tetrahydroxy-benzophenone, 2,2-dihydroxy4-methoxy-benzophenone, etc.

(b) Salicylate Compounds:

Phenyl salicylate, 2,4-di-t-butylphenyl-3,5-di-t-butyl-4-hydroxybenzoate, etc.

(c) Benzotriazol Compounds:

(2-hydroxy phenyl)benzotriazol, benzotriazol(2-hydroxy-5-methylphenyl), benzotriazol(2-hydroxy 5-methyl henyl), (2-hydroxy-3-tartialbutyl-5-methylphenyl)-5-chrolobenzotriazol, etc.

(d) Cyano-acrylate Compounds:

Ethyl-2-cyano-3,3-diphenylacrylate, methyl-2-calbomethoxy-3-(paramethoxy)acrylate, etc.

(e) Kuenchar (Metallic-complex Compounds):

Nickel (2,2-thiovis (4-t-octyl)phenolate)normalbutyl amine, nickel dibutyl di-thio-carbamate, nickel dibutyl di-thio-carbamate, cobalt di-cyclohexyl di-thio-phosphate, etc.

(f) HALS (Hindered Amine):

Vis(2,2,6,6-tetramethyl-4-piperidyl)sebacate, vis(1,2,2,6,6-penthametyl-4-pieridyl)sebacate, 1-[2-[3-(3,5-di-t-butyl-4-hydroxyphenyl)propionyloxy]ethyl]-4-[3-(3,5-di-t-butyl-4-hydroxy phenyl)propionyloxy]-2,2,6,6-tetramethylpyridine, 8-benzyl-7,7,9,9-tetramethyl-3-octyl-1,3, 8-triazaspilo [4, 5] undecane 2,4-dion, 4-benzoyloxy-2,2,6,6-tetramethyl piperidine, etc.

Further, in the photoconductor adapted to the present invention, surface protective layer 69 is provided on the photoconductive layer in order to protect the photoconductive layer.

Suitable materials for use in the protective layer 69 include ABS resins, ACS resins, olefin-vinyl monomer copolymers, chlorinated polyethers, aryl resins, phenolic resins, polyacetal, polyamides, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins and the like. In particular, polycarbonate and polyacrylate are most preferable.

In addition to the binder resin, thermo-setting resins or photosetting resins may be utilized. As for the thermosetting resins or photosetting resins, any conventional ones may be utilized as long as they achieve high wear resistance and does not effect adversely on the electrophotographic properties. In particular, the protective layer formed by cross-linking or hardening the multi-functional monomer or oligomer that has three or more functional groups in the molecule exhibits higher mechanical strength than those of linear polymer; when a portion of the bonding in the molecule is cut off, the molecule is not divided into small fractions, consequently, the protective layer tends to resist to the decrease of wear resistance, which is effective in the present invention.

In the protective layer, fluoride resin such as polytetrafluoroethylene, silicone resin, and additionally inorganic filler such as titanium oxide, tin oxide, potassium titanate, silica, or organic filler may be incorporated in order to improve mechanical strength.

Further, as for the organic filler among the filler materials utilized in the protective layer of the photoconductor, examples thereof include powder of fluoro-resin like polytetrafluoroethylene, silicone resin powder and a-carbon powder. As for the inorganic filler, examples thereof include powder of a metal like copper, tin, aluminum and indium, or powder of a metal oxide like silica, tin oxide, zinc oxide, titanium oxide, indium oxide, antimony oxide, bismuth oxide, tin oxide doped with antimony and indium oxide doped with tin, and potassium titanate, etc. Particularly, in consideration of the hardness of the filler, the inorganic materials are preferably used among all of the aforementioned materials. Specifically, silica and alumina can be used effectively.

The volume average particle diameter of the filler used is preferably set to the range of 0.1 to 2 μm, and preferably to the range of 0.3 to 1 μm. When the average particle diameter is too small, the wear resistance cannot be sufficiently exhibited, and when it is too large, the surface property of the coating is deteriorated, or the coating itself cannot be formed.

The average particle diameter of the filler in the present invention means a volume average particle diameter as long as it is not specially described, and determined using an ultracentrifugal automatic particle diameter distribution measuring device: CAPA-700 (made by HORIBA). It is calculated as a particle diameter (Median series) corresponding to 50% of the cumulative distribution. The respective standard deviation of simultaneously measured particles is preferably 1 μm or less. When the standard deviation exceeds this range, the particle diameter distribution is too large to clearly obtain an effect of the present invention.

Moreover, the pH of the filler, which is one of the requirements of the present invention, has great effects on the resolution of the image or on the dispersibility of the filler. One of the reasons is considered to be that HCl or the like may remain on the filler after the fabrication of the filler, especially the metal oxide filler. If the residual amount is large, the occurrence of the image blur may not be prevented. The residual amount will also affect the dispersibility of the fillers.

Another reason is the charge variation of the surface of the fillers, especially the metal oxide fillers. Usually, the particles dispersed in a liquid have plus charges or minus charges on the surfaces thereof, while the ions having counter charges (the counter ions) gather near the surfaces of the particles to form an electric bilayer, so that the dispersing states of the particles are stabilized. For an electric bilayer system, the potential (Zeta potential) slowly decreases with the increasing distance from the particle and becomes zero at an electrically neutral region where the distance from the particle is sufficiently large. Accordingly, when the absolute value of the Zeta potential is increased, the repulsive force between the particles becomes higher and the stability of the particles are higher, which means that the aggregation of the particles from a distance where the Zeta potential approaches to zero is not stable. On the other hand, the pH of the system will significantly change the Zeta potential and an isoelectric point where the Zeta potential equals zero will form under certain pH. The isoelectric point should be set as far as possible away from the particle by adjusting the pH, so that the absolute value of the Zeta potential can be increased to attain stabilization of the dispersed system.

In the scheme of the present invention, the pH of the filler corresponding to the aforesaid isoelectric point is preferably at least 5 or more in order to prevent the occurrence of image blur, and it is ascertained that the fillers of higher basic tend to exhibit greater effects. As compared with the acidic filler, the filler that presents basic with a high pH at the isoelectric point show an improved dispersibility and a higher stability of particle, since the Zeta potential comes to higher when the system is acidic.

By the way, the pH of the filler in the present invention is recorded as the pH corresponding to the isoelectric point of the Zeta potential curve. Zeta potential is measured by means of Laser Zeta Potential Meter (by Otsuka Electronics Co., Ltd.).

Moreover, in order to prevent the occurrence of image blur, the filler preferably having high electrically insulating ability (specific resistance$\geqq 10^{10}$ Ω·cm), the filler having a pH of 5 or more or a dielectric constant of 5 or more may be effectively employed. Further, a filler having a pH of 5 or more or a dielectric constant of 5 or more may be used alone; two or more kinds of fillers among which one has a pH of 5 or more and the other does not can be mixed in use. Similarly, two or more kinds of fillers among which one has dielectric constant of 5 or more but the other does not can also be mixed in use. Moreover, among these fillers, the α-alumina having a hexagonal close packed structure with high insulating ability, high thermal stability and high wear resistance is particular effective in inhibiting the image blur or in improving the wear resistance.

In the present invention, the specific resistance of the used filler is defined as follows. Since the filler is in the form of powder and the specific resistance varies with the filling ratio of the powder, the specific resistance of the filler must be measured under certain conditions. The present invention uses a measuring device having the same structure as that described in JP-A No. 5-94049 and No. 5-113688 to measure the specific resistance of the filler, and then uses the measured values. In the measuring device, the electrode area is 4.0 $cm^2$. Before the measurement, one side of the electrode is applied with a load of 4 kg for one minute and the distance of the electrodes is maintained at 4 mm, and the amount of the sample is thus adjusted. During the measurement, the top electrode is applied with a load of one kg and the applied voltage is 100V. When the specific resistance exceeds $10^6$ Ω·cm, the measurement can be done by using HIGH RESISTANCE METER (by Yokogawa HEWLETT PACKARD), otherwise a digital multimeter (Fluke) is used. The specific resistance such determined is defined as the specific resistance mentioned in the description of the present invention.

The dielectric constant of the filler is measured with the method described below. The same cell as in the measurement of the specific resistance is used, a load is applied and then an electrostatic capacitance is measured, and the dielectric constant is thereby determined. The electrostatic capacitance is measured by using a Dielectric loss measuring set TR-10C manufactured by Ando Electric Co., Ltd.

Moreover, the filler can be subjected to a surface treatment with at least one surface-treating agent to have a higher dispersibility. If the dispersibility of the filler is low, the residual voltage rises, the transparency of the coating decreases, the coating defects occur and the wear resistance decreases. This will cause severe problems that obstruct the achievement of high durability and high resolution. The surface-treating agent can be any of those used in the prior art, but is preferably one that can maintain the insulating ability of the filler. The surface treatment includes the treatment with titanate-type coupling agents, aluminum-type coupling agents, zircoaluminate-type coupling agents or higher aliphatic acids, and a hybrid treatment with aforementioned agents and silane coupling agents. The surface treatment also includes the treatment with $Al_2O_3$, $TiO_2$, $ZrO_2$, silicone or aluminum stearate, and a hybrid treatment with at least two of the aforementioned agents. Thus the dispersibility of the filler and the image blur problem can be improved. The reason that the silane coupling agents are used in combination with another surface treating agent is that a surface treatment using only silane coupling agents has strong effects on the occurrence of the image blur, and the addition of any other surface treating agent mentioned above can inhibit the effects. The amount of the surface treatment varies with the mean primary grain size and is preferably 3 to 30% by mass, more preferably 5 to 20% by mass. If the surface treating amount is less than the lower limit, the dispersing effect of the filler can not be obtained, while an surface treating amount exceeding the upper limit will cause the rise of the residual voltage. Moreover, each filler material can be used alone or in combination with at least one of the other filler materials. The surface-treating amount of the filler is defined as the weight ratio of the surface-treating agent to the filler.

The filler material is dispersed by using a suitable disperser. Moreover, in order to maintain the transparency of the protective layer, the used filler is dispersed to the primary particle level and preferably has few aggregates.

The protective layer 69 may contain the charge-transporting substance in order to decrease the residual potential and to improve response ability. The charge transferring substance is set forth before. Lower molecular weight compound is utilized as the charge transferring substance, a concentration gradient may be provided. Lowe concentration at the front side is effective for increasing the wear resistance. In this connection, the term "concentration" means the mass ratio of the lower molecular weight compound based on the total mass of the protective layer, and "concentration gradient" indicates the concentration is lower at the front side with respect to the mass ratio.

(Toner)

Toners adapted to the present invention is as follows. In the present invention, those produced by conventional known process may be utilized. The toners are usually produced by melting and kneading a mixture comprising a binder resin, colorant, polarity controlling agent, then cooling and solidifying the product, followed by pulverizing and classifying the product.

Specifically, the toner is comprised of a binder resin, colorant, polarity controlling agent, and other additives depending on the requirements.

In this case, as for a binder resin, all well-known materials can be used. For example, a homopolymer of styrene or a substituted one thereof such as polystyrene, poly-p-styrene, polyvinyl toluene, a styrene-based copolymer such as copolymer of (styrene/chlorostyrene), copolymer of (styrene/propylene), copolymer of (styrene/vinyltoluene), copolymer of (styrene/methyl acrylate), copolymer of (styrene/ethyl acrylate), copolymer of (styrene/butyl acrylate), copolymer of (styrene/methyl methacrylate), copolymer of (styrene/ethyl methacrylate), copolymer of (styrene/butyl methacrylate), copolymer of (styrene/α-methyl chloromethacrylate), copolymer of (styrene/acrylonitrile), copolymer of (styrene/methyl vinyl ether), copolymer of (styrene/methyl vinyl ketone), copolymer of (styrene/butadiene), copolymer of (styrene/isoprene), copolymer of (styrene/maleic acid), and copolymer of (styrene/maleate), poly (methacrylate), polybutyl methacrylate, polyvinyl chloride, polyvinyl acetate, polyethylene, polypropylene, polyester, polyurethane, polyamide, epoxy resin, polyvinyl butyral, polyacrylate resin, rosin, modified rosin, terpene resin, phenol resin, aliphatic hydrocarbon resin, aromatic petroleum resin, chlorinated paraffin, and paraffin wax, etc. may be used independently or as a mixture thereof.

As for the polarity controlling agent, the following substances may be employed for example.

As for the polarity controlling agent that controls the toner at negative polarity, organic metallic complexes and chelate compounds are effective, specifically, mono-azo metallic complexes, acetylacetone metallic complexes, metallic complexes of aromatic hydroxycarboxylic acid, metallic complexes of aromatic dihydroxycarboxylic acid and the like are exemplified. Further, aromatic hydroxycarboxylic acid, aromatic mono- or poly-carboxylic acid, metallic salts, anhydrides, esters, phenol derivatives such as bisphenol thereof.

As for the polarity controlling agent that controls the toner to positive polarity, such substances may be exemplified as denatured products of nigrosines or metallic salts of fatty acid; tributyl benzylammonium-1-hydroxy-4-naphthosulfonate; quaternary ammonium salt such as tetrabutylammonium tetrafluoroborate; onium salt such as phosphonium salt, and lake pigments thereof, triphenylmethane dyes and lake pigments thereof, and the agents for lake formation include phosphorus tungstic acid, phosphorus molybdic acid, phosphorus tungstic molybdic acid, tannic acid, lauric acid, gallic acid, ferricyanides, and ferrocyanides.

The amount of the polarity controlling agent utilized for a toner is decided depending on the type of binder resin, the existence of optional additives, and process for producing toner such as dispersing way; usually the amount is 0.1 to 20 parts by mass based on the binder resin, but not limited to. When the amount is less than 0.1 part by mass, the charging of toner is often insufficient and impractical. When the amount is over 20 parts bay mass, the charging of toner is excessive, resulting in insufficient fluidity of developer and decrease of image concentration due to the increased absorbing electrostatic affinity with the carrier.

As for a black coloring agent included in the toners, for example, carbon black, aniline black, furnace black, and lamp black may be used. As for a cyan coloring agent, for example, phthalocyanine blue, methylene blue, Victoria blue, methyl violet, aniline blue, and ultramarine blue may be used. As for a magenta coloring agent, for example, rhodamine 6G lake, dimethylquinacridone, watching red, rose bengal, rhodamine B, and alizarin lake may be used. As for a yellow coloring agent, for example, chrome yellow, benzidine yellow, hansa yellow, naphthol yellow, molybdenum orange, quinoline yellow, and tartrazine may be used.

To the toner available in the present invention, the wax and lubricant may be incorporated as the charging hazard absorber in addition to the binder resin and the colorant.

As for the wax, such waxes may be exemplified as polypropylene wax of lower molecular weight and polyethylene wax of lower molecular weight. Preferably, the waxes are of esters or olefins in the present invention. These waxes exhibit non-compatibility with the employed binder resin in general, and tend to be finely dispersed in the binder. The ester waxes mean the waxes having an ester bonding;

examples thereof include natural waxes such as carnauba wax, candelira wax, and rice wax; and montan wax and the like.

The averaged dispersed size of the wax in the binder resin is preferably 0.2 to 5.0 μm. When the size is less than 0.2 μm, the bleeding effect of the wax hardly appears, thus the effect of the present invention may not be obtained. Further, in order to make the wax disperse into the size of 0.2 μm or less, an excessively large dispersing energy should be applied to the binder resin at melting and kneading, thereby the binder molecules may be cut and the binder may loss the inherent property. On the other hand, when the size is over 5.0 μm, the fixing property, the flowing property, preserving property, and the durability may be deteriorated. The added amount of the wax is preferably 10% by mass or less based on the binder resin. When it is over the level, the flowing property and offset ability may be deteriorated.

As for the lubricant added to the toner, examples thereof include various fluoride resins such as PTFE, PFA, and PVDF; silicone resins, polyolefin resins; fatty metal stearates such as zinc stearate, zinc laurate, zinc myristiate, calcium stearate, aluminum stearate and the like. Among these, zinc stearate is most preferable. The added amount of the lubricant is preferably 0.001 to 0.2% by mass based on the toner in the developer.

The toner may contain a magnetic material; thereby the toner may be utilized as a magnetic toner. Examples of the magnetic material used for preparation of the magnetic toner include iron oxides such as magnetite, hematite, and ferrite; metals such as iron, cobalt, and nickel; alloys of the above-mentioned magnetic metals with the following metals such as aluminum, cobalt, copper, lead, magnesium, tin, zinc, antimony, beryllium, bismuth, cadmium, calcium, manganese, selenium, titanium, tungsten, and vanadium; and mixtures thereof. As for the ferromagnetic material, the average particle size is 0.05 to 2 μm, the content in the toner is about 20 to 200 parts by mass based on the 100 parts by mass of the resin component, more preferably 40 to 150 parts by mass based on the 100 parts by mass of the resin component.

In addition, a fluidizing agent may be added to the toner. Examples of the fluidizing agent include colloidal silica, hydrophobic silica, Teflon (trade mark), fluoro polymers, polyolefin of lower molecular weight, fatty acid metal salts such as zinc stearate, aluminum stearate and calcium stearate, metal oxides such as titanium oxide, aluminum oxide, tin oxide and antimony oxide, and the like compounds, conductivity-imparting agent such as carbon black and tin oxide, magnetic material, and surface-treated products thereof. Among these, inorganic fine particles such as silica, titania, alumina, cerium oxide, strontium titanate, calcium carbide, magnesium carbide, and calcium phosphate; and fine particles of organic resin such as fine particles of fluorine-containing resin, fine particles of silica-containing resin, and fine particles of nitrogen-containing resin are preferred. These fluidizing agent may be used alone or in combination. The content is preferably 0.1 to 10 parts by mass based on 100 parts by mass of toner. A surface treating may be applied on the surface of the external fluidizing agent depending on the application. Examples of the surface treating agent to render hydrophobic include silane coupling agents, silicone oils and the like.

Further, the fluidizing agent is preferably composed of two or more external additives having different particle sizes, more preferably one particle size is two to five times the other particle size. When the fluidizing agent is not composed of two or more external additives, the external additive tends to be buried prematurely into the toner with time, and the fluidity of the toner is likely to decrease rapidly. Therefore, the image nonuniformity tends to occur due to the deteriorated toner fluidity; the adhesion of toner is hardly increased; and the desorption easily occurs from the toner, resulting in a cause of the flaw of photoconductor material or hole of image. When the fluidizing agent is composed of two or more external additives with different particle sizes, the external additive with larger particle size performs the roll of spacer, preventing the bury of the external additive with smaller particle size that is effective in the fluidity of toner, thereby the toner fluidity may be maintained.

(Developer)

The developer according to the present invention comprises the toner according to the present invention, and the other ingredients such as carrier selected properly. The developer may be a single-component or double-component developer; however, the developer is preferably of single-component type in light of such factor as prolonged life, in order to be applied to high-speed printers for the purpose of nowadays-increased information processing rate.

In the case of the single-component developer comprising the toner according to the present invention, even after consumption and addition of the toner, the variation of the toner particle diameter is minimized, filming of the toner to a development roller, and toner fusion to members such as a toner blade which controls the toner thickness on the development roller are also prevented, and also excellent and stable developing properties and images may be obtained even after the developing apparatus is utilized (stirred) for a long period. Further, in the case of the double-component developer comprising the toner according to the present invention, even after prolonged consumption and addition of the toner, the variation of the toner particle diameter is minimized, and even after the developing apparatus is stirred for a long period, excellent and stable developing properties may be obtained.

The carrier may be properly selected, without particular limitations, depending on the application, preferably the carrier is one having core and resin layer coating on the core material.

The material for the core may be properly selected from conventional materials without particular limitations; for example, the material based on manganese-strontium (Mn—Sr) of 50 to 90 emu/g and the material based on manganese-magnesium (Mn—Mg) are preferable, high magnetizing materials such as iron powder (100 emu/g or more) and magnetite (75 to 120 emu/g) are preferable from the standpoint of securing image density. Also, weak magnetizing materials such as of copper-zinc (Cu—Zn) (30 to 80 emu/g) are preferable from the standpoint for aiming higher-grade images by means of softening the contacts of the toner to the photoconductor where the toner is standing. Each of these materials may be employed alone or in combination.

As for the particle diameter of the core material, preferably the average particle diameter (volume-average particle diameter ($D_{50}$)) is 10 to 150 μm, more preferably 40 to 100 μm. When the average particle diameter ($D_{50}$) is less than 10 μm, the carrier particle distribution contains fine particle in significant fraction, which may cause carrier scattering due to lowered magnetization per one particle; on the other hand, when it exceeds 150 μm, the specific surface area comes to lower, which may cause toner scattering and may deteriorate the reproducibility at the solid parts particularly in full-color printing that contains a number of solid parts.

The material for the resin layer may be properly selected from conventional materials depending on the application without particular limitations; examples of the material for the resin layer include amino resins, polyvinyl resins, polystyrene resins, halogenated olefin resins, polyester resins, polycarbonate resins, polyethylene resins, polyvinyl fluoride resins, polyvinylidene fluoride resins, polytrifluoro ethylene resins, polyhexafluoropropylene resins, copolymers of vinylidene fluoride with acrylic monomer, copolymers of vinylidene fluoride with vinyl fluoride, fluoroterpolymers such as the terpolymer of tetrafluoroethylene, vinylidene fluoride and a non-fluoride monomer, and silicone resins. Each of these resins may be used alone or in combination.

The amino resins include, for example, urea-formaldehyde resins, melamine resins, benzoguanamine resins, urea resins, polyamide resins, epoxy resins, and the like. The polyvinyl resins include acrylic resins, polymethyl methacrylate resins, polyacrylonitrile resins, polyvinyl acetate resins, polyvinyl alcohol resins, polyvinyl butyral resins, and the like. The polystyrene resins include polystyrene resins, styrene-acryl copolymer resins and the like. The halogenated olefin resins include polyvinyl chloride and the like. The polyester resins include polyethylene terephthalate resins, polybutylene terephthalate resins and the like.

The resin layer may be contained such material as conductive powder depending on the application; as for the conductive powder, metal powder, titanium oxide, tin oxide, zinc oxide, and the like are exemplified. These conductive powders preferably have an average particle diameter of 1 μm or less. When the average particle diameter is more than 1 μm, it may be difficult to control electrical resistance.

The resin layer may be formed by first dissolving the silicone resins into a solvent to prepare a coating solution, then uniformly coating the surface of the core material with the coating solution by means of the immersion process, the spray process, the brush painting process and the like, and baking it after drying.

There is no particular limitation for the solvent and it may be selected suitably from toluene, xylene, methylethylketone, methylisobutylketone, celsorbutylacetate, and the like.

The baking process may be an externally heating process or an internally heating process, and can be selected from, for example, a process using either a fixed type electric furnace, fluid type electric furnace, rotary type electric furnace, and burner furnace, or process of using microwave and the like.

The ratio of the resin layer (resin coating amount) in the carrier is preferably 0.01 to 5.0% by mass base on the entire amount of the carrier. When the ratio is less than 0.01% by mass, it is difficult to form a uniform resin layer, on the other hand, when the ratio exceeds 5.0% by mass, the resin layer becomes too thick and the carrier particles tend to grow due to the consolidation of carriers, as a result the uniform carrier of fine particles may not be obtained.

When the developing agent for electrophotography is one of the double-component developing agents, the contents of the carrier in the double-component developing agent is not particularly restricted and may be properly selected depending on the application, for example it is preferably 90 to 98% by mass, more preferably 93 to 97% by mass.

Since the developer according to the present invention comprises the toner according to the present invention, both of the electrostatic property and the fixing property may be maintained during the image forming process in a well-balanced manner, and images of high quality may be achieved stably.

The present invention will be illustrated in more detailed with reference to examples given below, but these are not to be construed as limiting the present invention. All percentages and parts are by mass unless indicated otherwise.

<Synthesis of Titanyl Phthalocyanine A>

Initially, 292 g of 1,3-diiminoiso indoline and 2000 ml of sulfolane were mixed, and 20.4 g of titanium tetrabutoxide was dripped in nitrogen gas atmosphere. After the drip-feed was completed, the temperature was raised to 180° C. gradually, and allowed to react for five hours with stirring while keeping the temperature 170 to 180° C. After the reaction was completed and allowed to cool, the resulting precipitation was filtered, the filter cake was washed with chloroform till the cake turned to blue. Then the filter cake was washed a few times with methanol, and was washed a few times with 80° C. hot water then dried, thereby crude titanyl phthalocyanine was prepared.

Then the crude titanyl phthalocyanine was dissolved into concentrated sulfuric acid having a mass of twenty times the mass of the crude titanyl phthalocyanine, the solution was dripped into ice-water having one hundred times the mass of the solution while the solution being stirred, the precipitated crystals were filtered, then water washings were repeated till pH of the filtrate came to neutral, thereby titanyl phthalocyanine pigment was prepared as the wet cake. 20 g of the resulting wet cake was put into 200 g of tetrahydrofuran, was stirred for four hours, then filtered and dried, resulting in titanyl phthalocyanine A powder.

<Synthesis of Titanyl Phthalocyanine B>

Crude titanyl phthalocyanine was prepared, then being carried out the acid paste processing with concentrated sulfuric acid in the same manner as titanyl phthalocyanine A thereby to prepare a wet cake of titanyl phthalocyanine pigment. 20 g of the resulting wet cake was put into 200 g of 2-butanone, was stirred for four hours, then filtered and dried, resulting in titanyl phthalocyanine B powder.

<Synthesis of Titanyl Phthalocyanine C>

The resulting 20 g of titanyl phthalocyanine B powder and 200 g of tetrahydrofuran were subjected to milling by means of a ball mill for twenty four hours, then filtered and dried, resulting in titanyl phthalocyanine C powder.

The resulting titanyl phthalocyanine A, B and C were measured as to X-ray diffraction spectrum.

(Measuring Conditions for X-ray Diffraction Spectrum)

X-ray tube: Cu

Voltage: 50 kV

Current: 30 mA

Scanning speed: 2°/min

Scanning range: 3° to 40°

Time constant: 2 seconds.

Figure 20:
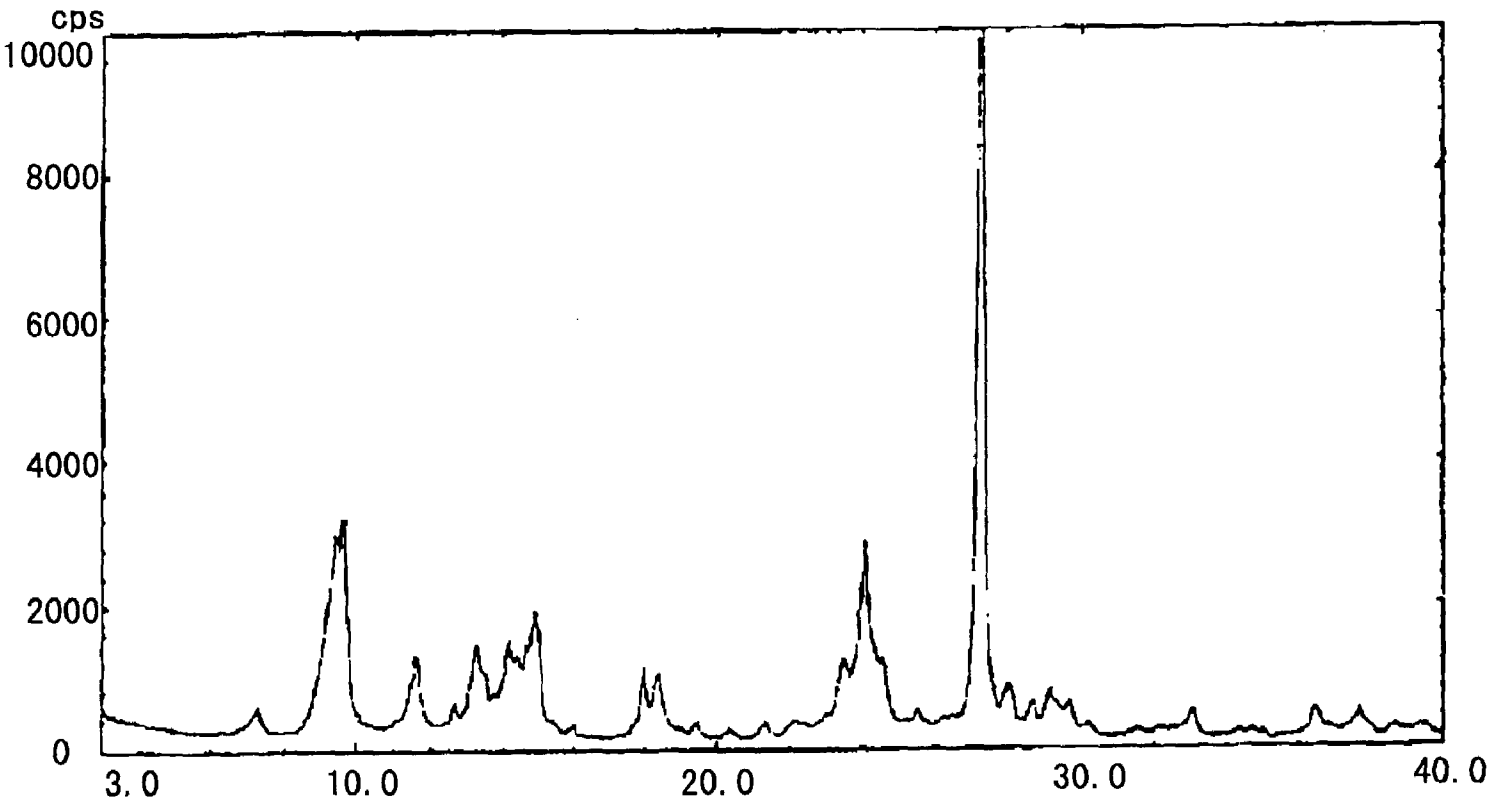
FIG. 20 shows an X-ray diffraction pattern of titanyl phthalocyanine A.
Figure 21:
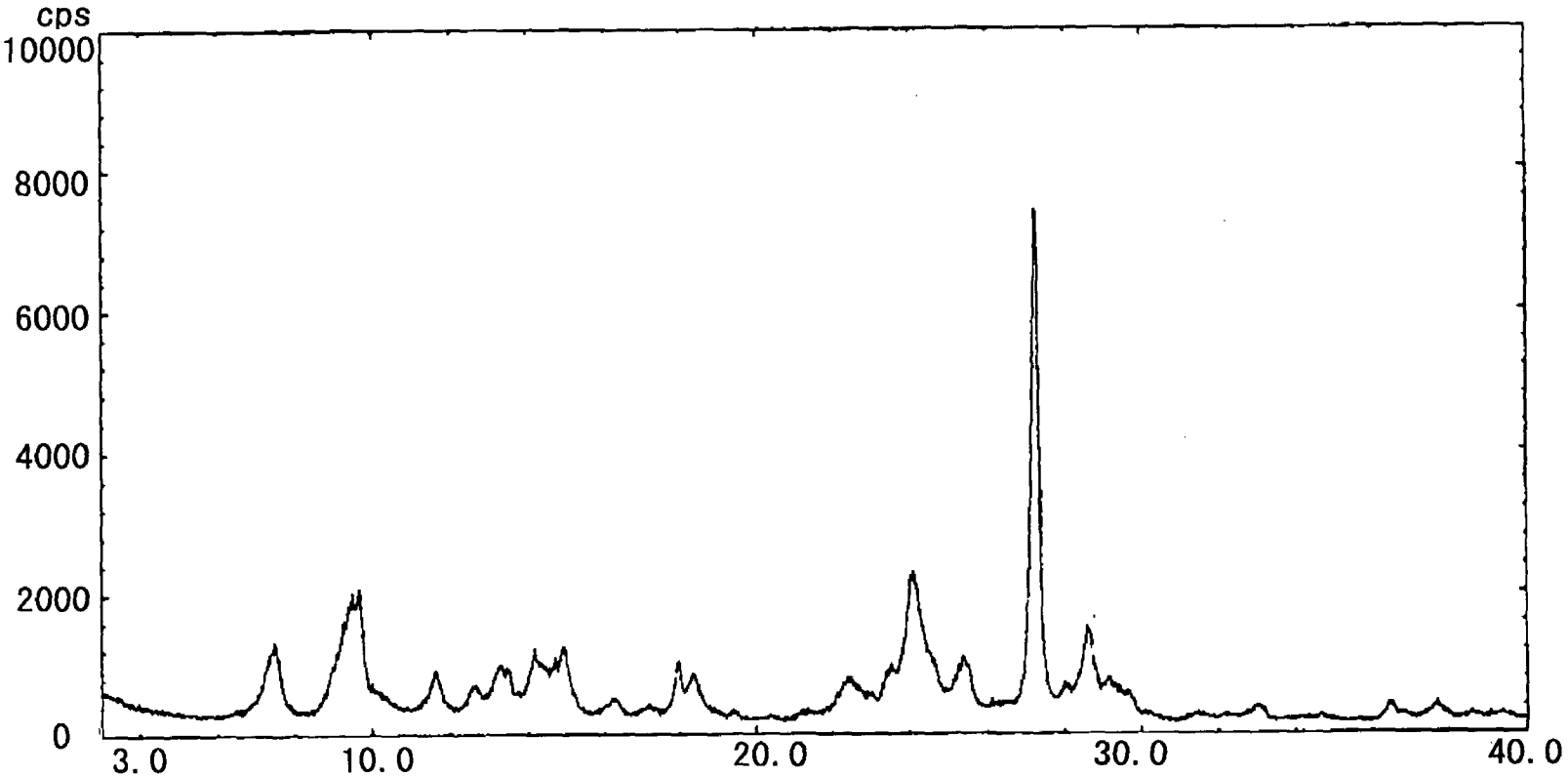
FIG. 21 shows an X-ray diffraction pattern of titanyl phthalocyanine B.
Figure 22:
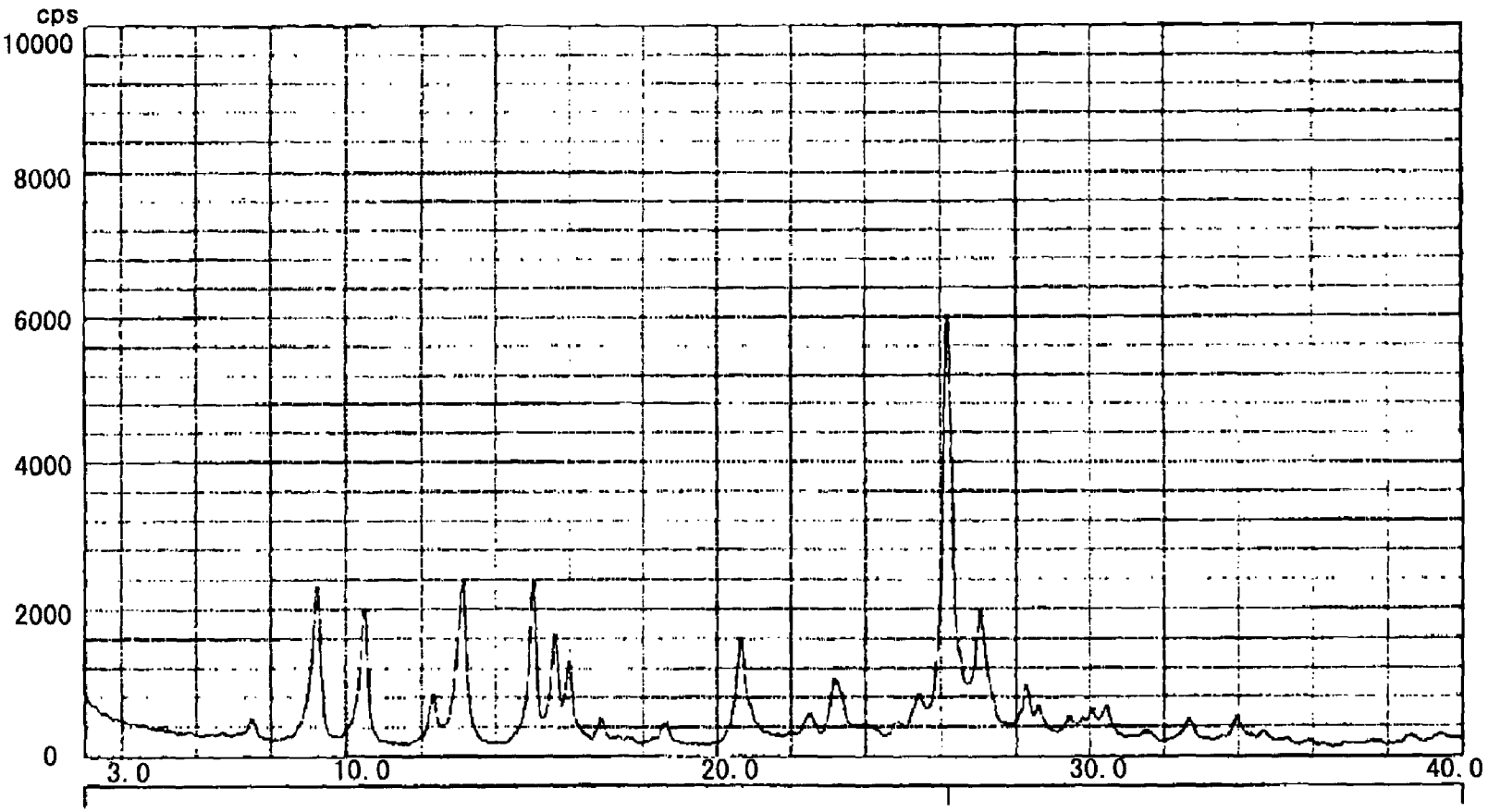
FIG. 22 shows an X-ray diffraction pattern of titanyl phthalocyanine C.

The X-ray diffraction spectra of titanyl phthalocyanines A, B and C were shown in FIGS. 20 to 22. Referring to FIG. 20, X-ray diffraction spectrum of titanyl phthalocyanine A showed a maximum peak at 27.2±0.2°, main peaks at 9.4°, 9.6°, and 24.0° and a peak as a lowest-angle peak at 7.3° and showed no peak in a range between 7.3° and 9.4°, and at 26.3° in terms of Bragg (2θ) angles to the CuK-α characteristic X-ray wavelength at 1.542 Å.

Referring to FIG. 21, X-ray diffraction spectrum of titanyl phthalocyanine B showed a maximum peak at 27.2±0.20 and a peak as a lowest-angle peak at 7.4° in terms of Bragg (2θ) angles to the CuK-α characteristic X-ray wavelength at 1.542 Å.

Referring to FIG. 22, X-ray diffraction spectrum of titanyl phthalocyanine C showed a maximum peak at 26.3±0.2° in terms of Bragg (2θ) angles to the CuK-α characteristic X-ray wavelength at 1.542 Å.

As such, titanyl phthalocyanines A, B and C demonstrated that they were different each other in their crystalline structure.

<Preparation of Photoconductor 1>

The coating liquids for under-coating layer, charge-generating layer, and charge-transporting layer, and optional coating layer having the following compositions respectively, were coated and dried in turn on an aluminum cylinder of 340 mm in length and 30 mm in diameter (JIS H3010), thereby an electrophotographic photoconductor was prepared with an intermediate layer of 3.5 μm thick, charge-generating layer of 0.2 μm thick, and charge-transporting layer of 25 μm thick.

| Coating Liquid for Under-Coating Layer | |
|---|---|
| Titanium dioxide | 400 parts |
| Melamine resin | 65 parts |
| Alkyd resin | 120 parts |
| 2-butanone | 400 parts |

Coating Liquid for Charge-Generating Layer

Disazo pigment of following formula 8 parts

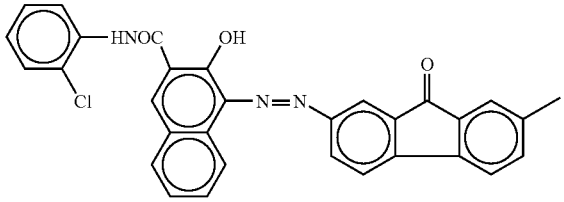

-continued

Coating Liquid for Charge-Generating Layer

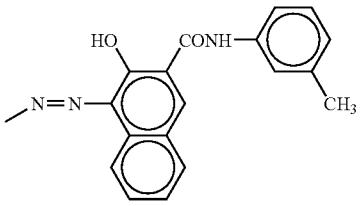

| | |
|---|---|
| Polyvinyl butyral | 5 parts |
| 2-butanone | 200 parts |
| Cyclohexanone | 400 parts |

Coating Liquid for Charge-Transporting Layer

| | |
|---|---|
| Z-type polycarbonate (about 50000 of viscosity-average molecular weight) | 10 parts |
| Charge-transporting substance of following formula | 7 parts |

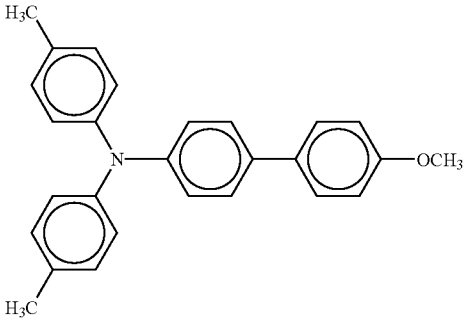

| | |
|---|---|
| Tetrahydrofuran | 80 parts |

The resulting photoconductor showed a specific dielectric constant of 2.73 and a volume resistivity of $2\times10^{14}$ Ω·cm$^2$.

<Preparation of Photoconductor 2>

Photoconductor 2 was prepared in the same manner as photoconductor 1, except that the aluminum cylinder was changed to that of 40 mm in diameter.

The resulting photoconductor showed a specific dielectric constant of 2.73 and a volume resistivity of $2\times10^{14}$ Ω·cm$^2$.

<Preparation of Photoconductor 3>

Photoconductor 3 was prepared in the same manner as photoconductor 1, except that the aluminum cylinder was changed to that of 60 mm in diameter.

The resulting photoconductor showed a specific dielectric constant of 2.73 and a volume resistivity of $2\times10^{14}$ Ω·cm$^2$.

<Preparation of Photoconductor 4>

Photoconductor 4 was prepared in the same manner as photoconductor 1, except that the coating liquid for charge-transporting layer was changed to that of following.

| Coating Liquid for Charge-Transporting Layer | |
|---|---|
| Polymer of charge-transporting substance of following formula | 15 parts |

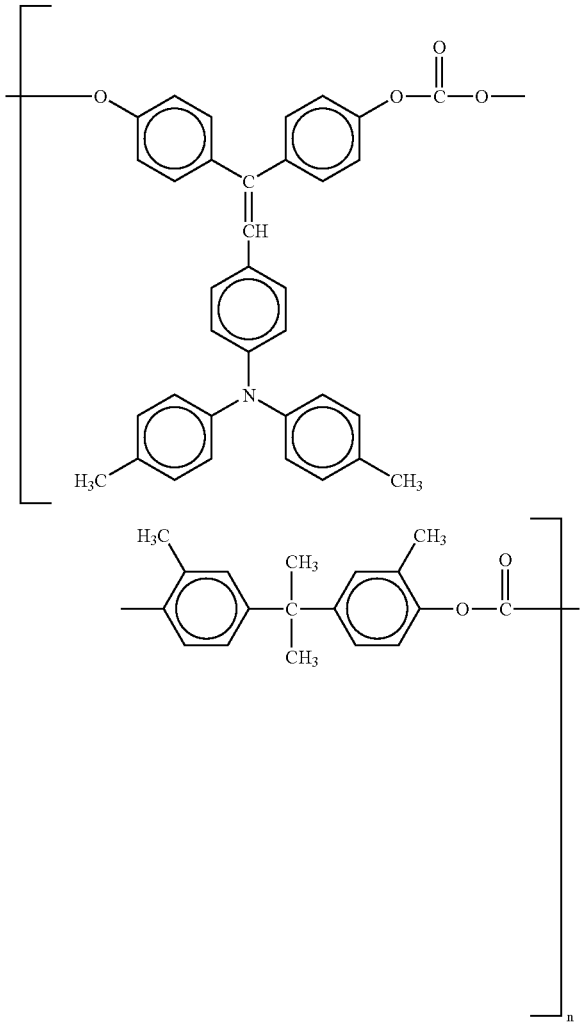

n = 250 from GPC

| | |
|---|---|
| Tetrahydrofuran | 150 parts |

The resulting photoconductor showed a specific dielectric constant of 2.74 and a volume resistivity of $2.5\times10^{14}$ Ω·cm$^2$.

<Preparation of Photoconductor 5>

Photoconductor 5 was prepared in the same manner as photoconductor 1, except that the layer thickness of the charge-transporting layer was changed to 20 μm, and the coating liquid for protective layer of the following composition was coated and dried to laminated a protective layer of 5 μm thick on the charge-transporting layer.

| Coating Liquid for Protective Layer | |
|---|---|
| Polycarbonate*1) | 10 parts |
| Charge-transporting substance of following formula | 7 parts |

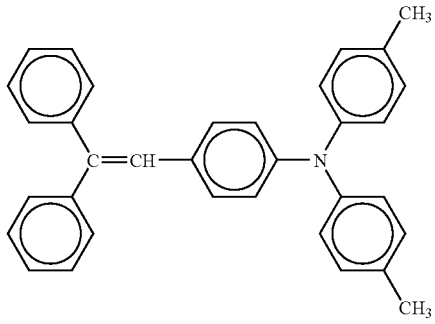

| | |
|---|---|
| α-alumina fine particles*2) | 6 parts |
| Cyclohexanone | 150 parts |
| Tetrahydrofuran | 500 parts |

*1)Iupilon Z300, Mitsubishi Gas Chemical Co.

*2)specific resistance of $2.5 \times 10^{12}$ Ω · cm, average particle size of 0.4 μm The resulting photoconductor showed a specific dielectric constant of 2.86 and a volume resistivity of $1.5\times10^{14}$ Ω·cm$^2$.

<Preparation of Photoconductor 6>

Photoconductor 6 was prepared in the same manner as photoconductor 5, except that the coating liquid for protective layer was changed to that of following.

| Coating Liquid for Protective Layer | |
|---|---|
| Polymer of charge-transporting substance of following formula | 17 parts |

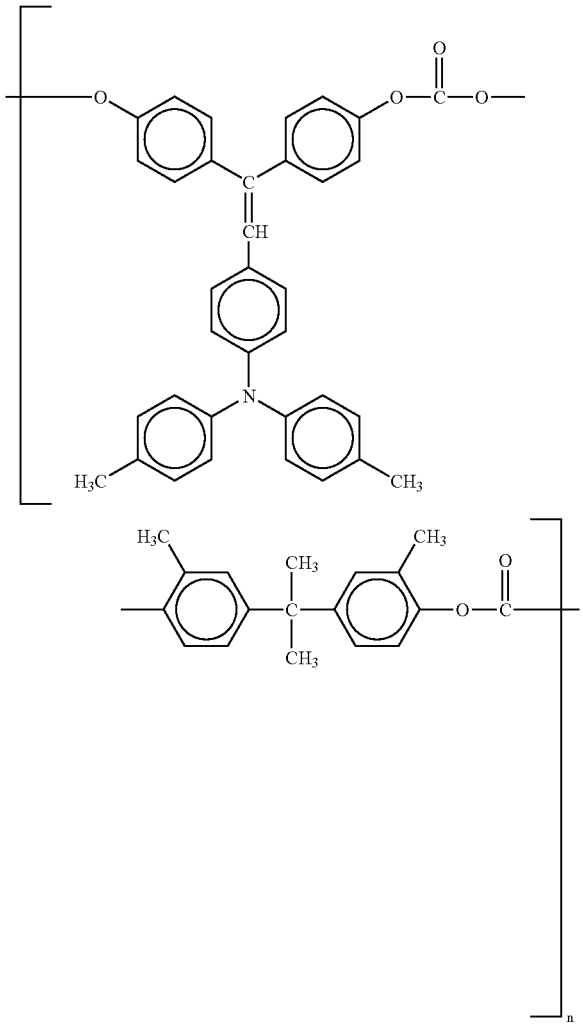

n = 250 from GPC

| | |
|---|---|
| α-alumina fine particles*1) | 6 parts |
| Cyclohexanone | 300 parts |
| Tetrahydrofuran | 800 parts |

*1)specific resistance of 2.5 × $10^{12}$ Ω · cm, average particle size of 0.4 μm The resulting photoconductor showed a specific dielectric constant of 2.86 and a volume resistivity of $2.0\times10^{14}$ Ω·cm$^2$.

<Preparation of Photoconductor 7>

Photoconductor 7 was prepared in the same manner as photoconductor 5, except that the coating liquid for protective layer was changed to that of following.

| Coating Liquid for Protective Layer | |
|---|---|
| Polycarbonate*1) | 10 parts |
| Charge-transporting substance of following formula | 7 parts |

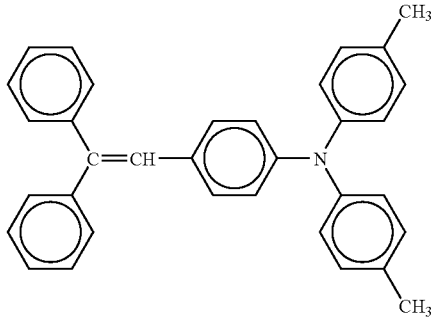

| | |
|---|---|
| Silica fine particles*2) | 8 parts |
| Cyclohexanone | 150 parts |
| Tetrahydrofuran | 500 parts |

*1)lupilon Z300, Mitsubishi Gas Chemical Co.
*2)specific resistance of 4.0 × $10^{13}$ Ω · cm, average particle size of 0.3 μm The resulting photoconductor showed a specific dielectric constant of 2.86 and a volume resistivity of $2.0\times10^{14}$ Ω·cm$^2$.

<Preparation of Photoconductor 8>

Photoconductor 8 was prepared in the same manner as photoconductor 5, except that the coating liquid for protective layer was changed to that of following.

| Coating Liquid for Protective Layer | |
|---|---|
| Polycarbonate*1) | 10 parts |
| Charge-transporting substance of following formula | 7 parts |

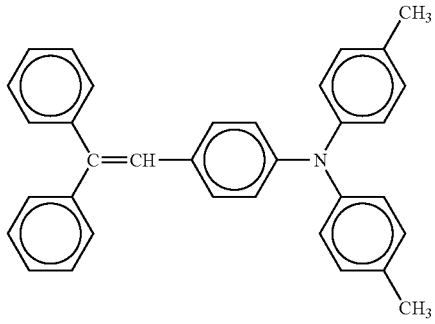

| | |
|---|---|
| Titanium oxide fine particles*2) | 7 parts |
| Cyclohexanone | 150 parts |
| Tetrahydrofuran | 500 parts |

*1)lupilon Z300, Mitsubishi Gas Chemical Co.
*2)specific resistance of 1.5 × $10^{10}$ Ω · cm, average particle size of 0.5 μm The resulting photoconductor showed a specific dielectric constant of 2.93 and a volume resistivity of $1.0\times10^{14}$ Ω·cm$^2$.

<Preparation of Photoconductor 9>

Photoconductor 9 was prepared in the same manner as photoconductor 5, except that the coating liquid for protective layer was changed to that of following.

| Coating Liquid for Protective Layer | |
|---|---|
| Polycarbonate*1) | 10 parts |
| Charge-transporting substance of following formula | 7 parts |

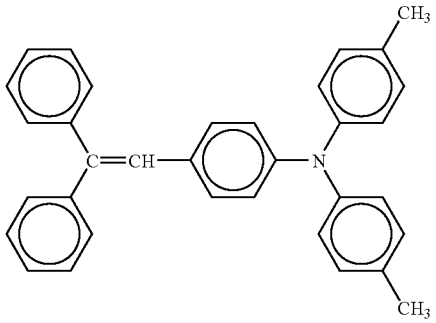

| | |
|---|---|
| Titanium oxide-antimony oxide powder*2) | 6 parts |
| Cyclohexanone | 150 parts |
| Tetrahydrofuran | 500 parts |

*1)Iupilon Z300, Mitsubishi Gas Chemical Co.
*2)specific resistance of $1.0 \times 10^6$ Ω · cm, average particle size of 0.4 μm The resulting photoconductor showed a specific dielectric constant of 3.45 and a volume resistivity of $1.0\times10^{13}$ Ω·cm$^2$.

<Preparation of Photoconductor 10>

Photoconductor 10 was prepared in the same manner as photoconductor 1, except that the coating liquid for charge-generating layer was changed to that of following.

| Coating Liquid for Charge-Generating Layer | |
|---|---|
| Disazo pigment of following formula | 8 parts |

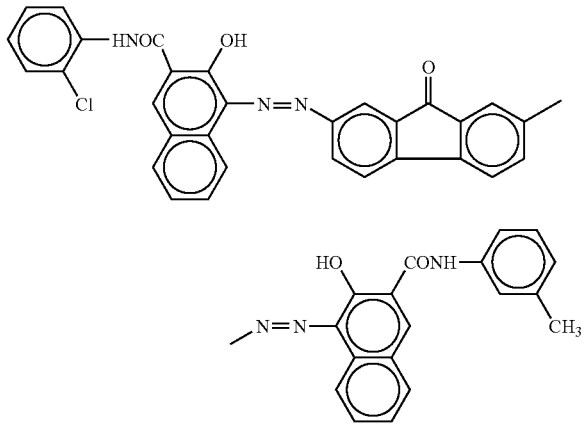

| | |
|---|---|
| Polyvinyl butyral | 5 parts |
| 2-butanone | 200 parts |
| Cyclohexanone | 400 parts |

The resulting photoconductor showed a specific dielectric constant of 2.73 and a volume resistivity of $2.0\times10^{14}$ Ω·cm$^2$.

<Preparation of Photoconductor 11>

Photoconductor 11 was prepared in the same manner as photoconductor 1, except that the coating liquid for charge-generating layer was changed to that of following.

| Coating Liquid for Charge-Generating Layer | |
|---|---|
| Disazo pigment of following formula | 8 parts |

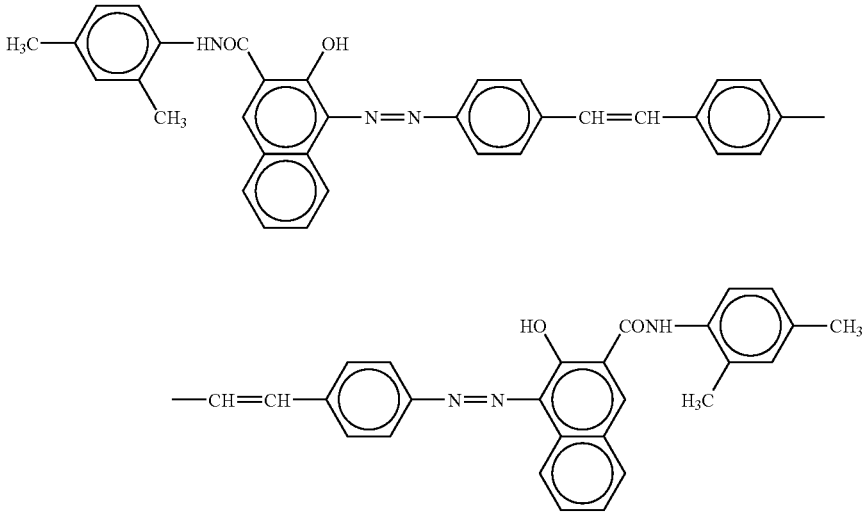

| | |
|---|---|
| Polyvinyl butyral | 5 parts |
| 2-butanone | 200 parts |
| Cyclohexanone | 400 parts |

The resulting photoconductor showed a specific dielectric constant of 2.73 and a volume resistivity of $2.0\times10^{14}$ Ω·cm$^2$.

<Preparation of Photoconductor 12>

Photoconductor 12 was prepared in the same manner as photoconductor 5, except that the coating liquid for protective layer was changed to that of following.

| Coating Liquid for Protective Layer | |
|---|---|
| Methylmethoxysilane | 100 parts |
| 3% aqueous solution of acetic acid | 20 parts |
| Charge-transporting substance of following formula | 35 parts |

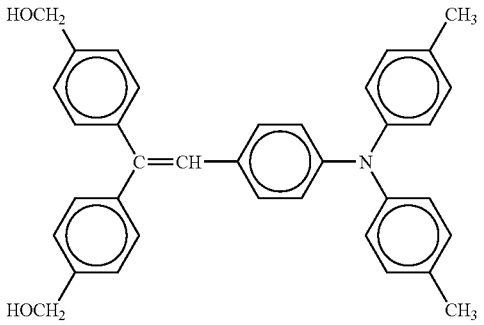

| | |
|---|---|
| Anti-oxidant*1) | 1 part |
| Curing agent (dibutyl tinacetate) | 1 part |
| 2-propanol | 200 parts |

*1)Sanol LS2626, by Sankyo chemical Co. Ltd.

The resulting photoconductor showed a specific dielectric constant of 2.75 and a volume resistivity of $2.0\times10^{14}$ Ω·cm$^2$.

<Preparation of Photoconductor 13>

Photoconductor 13 was prepared in the same manner as photoconductor 5, except that the coating liquid for protective layer was changed to that of following.

| Coating Liquid for Protective Layer | |
|---|---|
| Methyltrimethoxysilane | 100 parts |
| 3% aqueous solution of acetic acid | 20 parts |
| Charge-transporting substance of following formula | 35 parts |

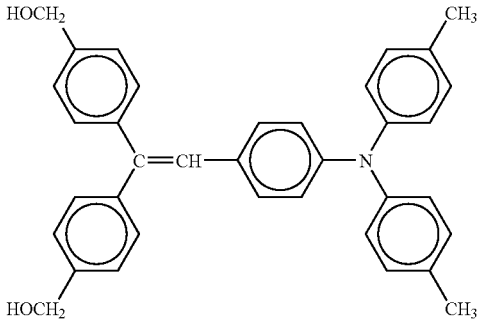

| | |
|---|---|
| α-alumina particles*1) | 15 parts |
| Anti-oxidant*2) | 1 part |
| Polycarboxylic acid compound*3) | 0.4 part |

-continued

| Coating Liquid for Protective Layer | |
|---|---|
| Curing agent (dibutyl tinacetate) | 1 part |
| 2-propanol | 200 parts |

*1)Sumicorundum AA-03, by Sumitomo chemical Co. Ltd.
*2)Sanol LS2626, by Sankyo chemical Co. Ltd.
*3)BYK P104, by BYK-Chemie Co. Ltd.

The resulting photoconductor showed a specific dielectric constant of 2.87 and a volume resistivity of $1.0\times10^{14}$ Ω·cm$^2$.

<Preparation of Photoconductor 14>

The coating liquids for under-coating layer, charge-generating layer, and charge-transporting layer, having the following compositions respectively, were coated and dried in turn on an aluminum cylinder of 340 mm in length and 30 mm in diameter (JIS H3010), thereby an electrophotographic photoconductor was prepared with an intermediate layer of 3.5 μm thick, charge-generating layer of 0.2 μm thick, charge-transporting layer of 20 μm thick, and protective layer of 5 μm thick.

| Coating Liquid for Under-Coating Layer | |
|---|---|
| Titanium dioxide | 400 parts |
| Melamine resin | 65 parts |
| Alkyd resin | 120 parts |
| 2-butanone | 400 parts |
| **Coating Liquid for Charge-Generating Layer** | |
| Titanyl phthalocyanine A*1) | 15 parts |
| Polyvinyl butyral | 10 parts |
| 2-butanone | 280 parts |

*1)synthesized in the same manner as earlier

| Coating Liquid for Charge-Transporting Layer | |
|---|---|
| Z-type polycarbonate | 10 parts |
| (about 50000 of viscosity-average molecular weight) | 7 parts |
| Charge-transporting substance of following formula | |

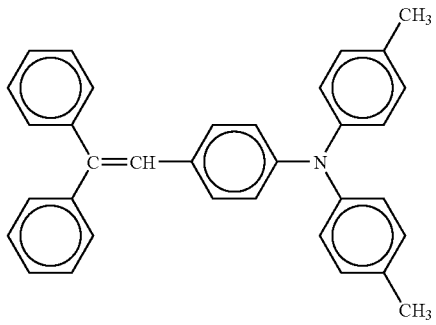

| | |
|---|---|
| Tetrahydrofuran | 80 parts |

| Coating Liquid for Protective Layer | |
|---|---|
| Polycarbonate*1) | 10 parts |
| Charge-transporting substance of following formula | 7 parts |

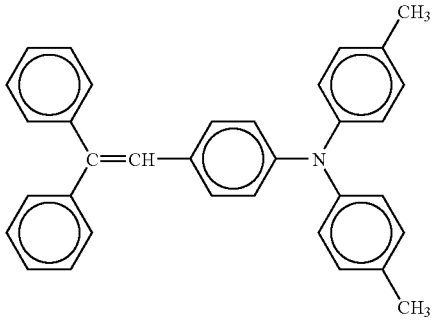

| | |
|---|---|
| α-alumina fine particles*2) | 6 parts |
| Cyclohexanone | 150 parts |
| Tetrahydrofuran | 500 parts |

*1)Iupilon Z300, Mitsubishi Gas Chemical Co.
*2)specific resistance of 2.5 × $10^{12}$ Ω-cm, average particle size of 0.4 μm The resulting photoconductor showed a specific dielectric constant of 2.86 and a volume resistivity of $1.5\times10^{14}$ Ω·cm$^2$.

<Preparation of Photoconductor 15>

Photoconductor 15 was prepared in the same manner as photoconductor 14, except that the coating liquid for charge-generating layer was changed to that of following.

| Coating Liquid for Charge-Generating Layer | |
|---|---|
| Titanyl phthalocyanine B*1) | 15 parts |
| Polyvinyl butyral | 10 parts |
| 2-butanone | 280 parts |

*1)synthesized in the same manner as earlier

The resulting photoconductor showed a specific dielectric constant of 2.86 and a volume resistivity of $1.5\times10^{14}$ Ω·cm$^2$.

<Preparation of Photoconductor 16>

Photoconductor 16 was prepared in the same manner as photoconductor 14, except that the coating liquid for protective layer was changed to that of following.

| Coating Liquid for Charge-generating Layer | |
|---|---|
| Titanyl phthalocyanine C*1) | 15 parts |
| Polyvinyl butyral | 10 parts |
| 2-butanone | 280 parts |

*1)synthesized in the same manner as earlier

The resulting photoconductor showed a specific dielectric constant of 2.86 and a volume resistivity of $1.5\times10^{14}$ Ω·cm$^2$.

Photoconductor 17 was prepared in the same manner as photoconductor 14, except that the aluminum cylinder (JIS H1050) was subjected to anodic oxidation coating on the surface as follows, then the charge-generating layer, charge-transporting layer, and protective layer were provided in the same manner as photoconductor 14 without providing the under-coating layer.

—Anodic Oxidation Coating—

The surface of the support was subjected to the finish of mirror grinding, then the surface was washed for eliminating waxes, followed by washing with water, then the support was immersed in an electrolytic bath of 15% sulfuric acid at 20° C., and subjected to anodic oxidation at 15 V of electrolytic voltage for 30 minutes. After washing with water, hole-sealing processing was conducted using 7% nickel acetate aqueous solution at 50° C. After washing with de-ionized water, the support was prepared with anodic oxidation coating of 6 μm thick.

The resulting photoconductor showed a specific dielectric constant of 2.86 and a volume resistivity of $1.5\times10^{14}$ Ω·cm$^2$.

The specific dielectric constants of the photoconductor were determined according to Xerographic method. Specifically, the photoconductor was charged, the charged potential and the drum current were measured simultaneously, current-voltage property was taken, the electric capacity was calculated based on the gradient, then the dielectric constant was determined in conjunction with the film thickness of the photoconductor.

$$C=Q/V=\in\times\in_0/d$$

wherein "C" is electric capacity, "Q" is charging amount, "V" is surface potential, "∈" is dielectric constant, "$\in_0$" is specific dielectric constant, and "d" is film thickness.

Further, the resistances of the surface layer of the photoconductor were determined as follows: a film of which the composition is the same with the surface layer of a photoconductor was coated on an ITO substance, a sandwich cell was prepared and on which gold was vapor-deposited for forming a counter electrode, then the bulk resistance was determined by means of the cell.

Similarly, the film thickness of the surface layer was determined as to the charging roller, then the current-voltage property was evaluated, thereby the dielectric constant and the resistivity were determined.

| <Preparation of Black Toner Developer K-1> (Black Toner) | |
|---|---|
| Polyester resin | 95 parts |
| Carbon black | 10 parts |
| Zinc salicylate derivative | 2 parts |

The composition of the above ingredients were melted and kneaded, pulverized, and classified, thereby the toner having a particle size of 8.0 μm was obtained.

To 100 parts by mass of magnetite, prepared by a wet process, 2 parts by mass of polyvinyl alcohol and 60 parts by mass of de-ionized water were added in a ball mill, and mixed for 12 hours to prepare a slurry of magnetite. The slurry was processed by a spray drier to prepare spherical particles. The particles were heated at 1000° C. for 3 hours in nitrogen atmosphere and allowed cooling to prepare particles for core material.

Then, the following ingredients were dispersed using a homomixer for 20 minutes to prepare a liquid for forming coating layer.

| | |
|---|---|
| Silicone resin solution | 100 parts |
| Toluene | 100 parts |
| γ-aminopropyl trimethoxysilane | 15 parts |
| Carbon black | 20 parts |

The liquid for forming coating layer was coated on the surface of the particles for core material of 1000 parts by mass by means of a coating apparatus of fluidized bed type, thereby a carrier coated with the silicone resin i.e. magnetic carrier was obtained.

To the 97.5 parts by mass of the magnetic carrier, 2.5 parts by mass of toner was blended thereby to prepare a black toner of double-component developer (K-1).

| <Preparation of Yellow Toner Developer Y-1> (Yellow Toner) | |
|---|---|
| Polyester resin | 95 parts |
| C.I. pigment yellow 180 | 5 parts |
| Zinc salicylate derivative | 2 parts |

The composition of the above ingredients were melted and kneaded, pulverized, and classified, thereby the toner having a particle size of 8.0 μm was obtained. The toner of 2.5 parts by mass and the above magnetic carrier of 97.5 parts by mass were blended to prepare a yellow toner of double-component developer (Y-1).

| <Preparation of Magenta Toner Developer M-1> (Magenta Toner) | |
|---|---|
| Polyester resin | 95 parts |
| C.I. pigment red 57:1 | 5 parts |
| Zinc salicylate derivative | 2 parts |

The composition of the above ingredients were melted and kneaded, pulverized, and classified, thereby the toner having a particle size of 8.0 μm was obtained. The toner of 2.5 parts by mass and the above magnetic carrier of 97.5 parts by mass were blended to prepare a magenta toner of double-component developer (M-1).

| <Preparation of Cyan Toner Developer C-1> (Cyan Toner) | |
|---|---|
| Polyester resin | 95 parts |
| C.I. pigment blue 15:3 | 5 parts |
| Zinc salicylate derivative | 2 parts |

The composition of the above ingredients were melted and kneaded, pulverized, and classified, thereby the toner having a particle size of 8.0 μm was obtained. The toner of 2.5 parts by mass and the above magnetic carrier of 97.5 parts by mass were blended to prepare a cyan toner of double-component developer (C-1).

| <Preparation of Black Toner Developer K-2> (Black Toner) | |
|---|---|
| Polyester resin | 100 parts |
| Carbon black | 10 parts |
| Zinc salicylate derivative | 2 parts |

The composition of the above ingredients were melted and kneaded, pulverized, and classified, thereby the toner having a particle size of 7.5 μm was obtained. To the toner, 0.9% by mass of titanium oxide fine particles, 0.9% by mass of silica fine particles, and 0.2% by mass of zinc stearate were added based on the toner. The resulting toner of 2.5 parts by mass and the above magnetic carrier of 97.5 parts by mass were blended thereby to prepare a double-component developer (K-2).

| <Preparation of Yellow Toner Developer Y-2> (Yellow Toner) | |
|---|---|
| Polyester resin | 100 parts |
| C.I. pigment yellow 180 | 5 parts |
| Zinc salicylate derivative | 2 parts |

The composition of the above ingredients were melted and kneaded, pulverized, and classified, thereby the toner having a particle size of 7.5 μm was obtained. To the toner, 0.9% by mass of titanium oxide fine particles, 0.9% by mass of silica fine particles, and 0.2% by mass of zinc stearate were added based on the toner. The resulting toner of 2.5 parts by mass and the above magnetic carrier of 97.5 parts by mass were blended to prepare a double-component developer (Y-2).

| <Preparation of Magenta Toner Developer M-2> (Magenta Toner) | |
|---|---|
| Polyester resin | 100 parts |
| C.I. pigment red 57:1 | 5 parts |
| Zinc salicylate derivative | 2 parts |

The composition of the above ingredients were melted and kneaded, pulverized, and classified, thereby the toner having a particle size of 7.5 μm was obtained. To the toner, 0.9% by mass of titanium oxide fine particles, 0.9% by mass of silica fine particles, and 0.2% by mass of zinc stearate were added based on the toner. The resulting toner of 2.5 parts by mass and the above magnetic carrier of 97.5 parts by mass were blended thereby to prepare a double-component developer (M-2).

| <Preparation of Cyan Toner Developer C-2> (Cyan Toner) | |
|---|---|
| Polyester resin | 100 parts |
| C.I. pigment blue 15:3 | 5 parts |
| Zinc salicylate derivative | 2 parts |

The composition of the above ingredients were melted and kneaded, pulverized, and classified, thereby the toner having a particle size of 7.5 μm was obtained. To the toner, 0.9% by mass of titanium oxide fine particles, 0.9% by mass of silica fine particles, and 0.2% by mass of zinc stearate were added based on the toner. The resulting toner of 2.5 parts by mass and the above magnetic carrier of 97.5 parts by mass were blended thereby to prepare a double-component developer (C-2).

| <Preparation of Black Toner Developer K-3> (Black Toner) | |
|---|---|
| Polyester resin | 95 parts |
| Carnauba wax | 5 parts |
| Carbon black | 10 parts |
| Zinc salicylate derivative | 2 parts |

The composition of the above ingredients were melted and kneaded, pulverized, and classified, thereby the toner having a particle size of 8.0 μm was obtained. The toner of 2.5 parts by mass and the above magnetic carrier of 97.5 parts by mass were blended thereby to prepare a double-component developer (K-3).

| <Preparation of Yellow Toner Developer Y-3> (Yellow Toner) | |
|---|---|
| Polyester resin | 95 parts |
| Carnauba wax | 5 parts |
| C.I. pigment yellow 180 | 5 parts |
| Zinc salicylate derivative | 2 parts |

The composition of the above ingredients were melted and kneaded, pulverized, and classified, thereby the toner having a particle size of 8.0 μm was obtained. The toner of 2.5 parts by mass and the above magnetic carrier of 97.5 parts by mass were blended thereby to prepare a double-component developer (Y-3).

| <Preparation of Magenta Toner Developer M-3> (Magenta Toner) | |
|---|---|
| Polyester resin | 95 parts |
| Carnauba wax | 5 parts |
| C.I. pigment red 57:1 | 5 parts |
| Zinc salicylate derivative | 2 parts |

The composition of the above ingredients were melted and kneaded, pulverized, and classified, thereby the toner having a particle size of 8.0 μm was obtained. The toner of 2.5 parts by mass and the above magnetic carrier of 97.5 parts by mass were blended thereby to prepare a double-component developer (M-3).

| <Preparation of Cyan Toner Developer C-3> (Cyan Toner) | |
|---|---|
| Polyester resin | 95 parts |
| Carnauba wax | 5 parts |
| C.I. pigment blue 15:3 | 5 parts |
| Zinc salicylate derivative | 2 parts |

The composition of the above ingredients were melted and kneaded, pulverized, and classified, thereby the toner having a particle size of 8.0 μm was obtained. The toner of 2.5 parts by mass and the above magnetic carrier of 97.5 parts by mass were blended thereby to prepare a double-component developer (C-3).

COMPARATIVE EXAMPLE 1

The photoconductor 1 explained before was set in the cartridge shown in FIG. 16 to prepare an image-forming element, and the cartridge of image-forming element was mounted on the image-forming apparatus shown in FIG. 12. The black toner developer K-1 was poured into the developing portion of the image-forming element, resulting in minus charging of the toner and reverse developing at light-writing image portion. As for the charging member, the non-contacting charging roller as shown in FIG. 13 was employed, wherein the diameter was 12 mm, the resistivity at the surface layer was $1.0\times10^5$ Ω·cm$^2$, the specific dielectric constant was 2.5, the gap between the roller surface and the photoconductor surface was 50 μm; the charging was performed with superimposed AC while controlling the surface potential to −600 V at the non-light exposing portion of the photoconductor (Vdc: −600V, Vpp: 2200 V (peak to peak), frequency: 900 Hz). Further, the cleaning member of the image forming apparatus shown in FIG. 12 was constructed by the combination of the cleaning brush and cleaning blade as shown in FIG. 14, a member formed with solidified zinc stearate as the charging hazard absorber was brought into contact with the cleaning brush, thereby the charging hazard absorber was coated to the photoconductor surface by means of the cleaning brush.

As for the exposing light source for forming images, LD (semiconductor laser) of 655 nm (beam diameter 50 μm at the photoconductor surface) was utilized, the writing was carried out in a writing density of 600 dpi. The irradiation energy was 4.0 erg at the solid image portion. The respective developing were carried out in non-contacting condition. A scoroton charger was employed as the charging member, and the transferring current was controlled to 35 μA. A blade made of urethane rubber was utilized for the cleaning member.

The linear velocity was set 185 mm/sec, 50000 sheets of images were formed using an original image of A4 size on which oblique lattice was described with 6% of writing proportion, and the images of 5 th sheet and 50000 th sheet were evaluated. After the output of 50000 sheets, a white solid image was output. In addition, the photoconductor was removed from the cartridge, the distribution of the film thickness was measured in the longitudinal direction of photoconductor. The experiment was conducted in an ambient environment of 22° C. and 50% relative humidity (RH). The results were summarized in Table 1-1.

EXAMPLE 1

Except for changing the charging conditions as follows, evaluations were carried out in the same manner as Comparative Example 1. The results are shown in Table 1-1.

Vdc: −600 V, Vpp: 2200 V, Frequency: 1350 Hz

EXAMPLE 2

Except for changing the charging conditions as follows, evaluations were carried out in the same manner as Comparative Example 1. The results are shown in Table 1-1.

Vdc: −600 V, Vpp: 2200 V, Frequency: 1600 Hz

EXAMPLE 3

Except for exchanging the charging conditions as follows, evaluations were carried out in the same manner as Comparative Example 1. The results are shown in Table 1-1.

Vdc: −600 V, Vpp: 2200 V, Frequency: 2000 Hz

EXAMPLE 4

Except for exchanging the charging conditions as follows, evaluations were carried out in the same manner as Comparative Example 1. The results are shown in Table 1-1.

Vdc: −600 V, Vpp: 2200 V, Frequency: 3000 Hz

COMPARATIVE EXAMPLE 2

Except for changing the charging conditions as follows, evaluations were carried out in the same manner as Comparative Example 1. The results are shown in Table 1-1.

Vdc: −600 V, Vpp: 2200 V, Frequency: 4000 Hz

COMPARATIVE EXAMPLE 3

Except for changing the charging conditions as follows, evaluations were carried out in the same manner as Comparative Example 1. The results are shown in Table 1-1.

Vdc: −600 V, Vpp: 2000 V, Frequency: 1350 Hz

EXAMPLE 5

Except for changing the charging conditions as follows, evaluations were carried out in the same manner as Comparative Example 1. The results are shown in Table 1-1.

Vdc: −600 V, Vpp: 2600 V, Frequency: 1350 Hz

COMPARATIVE EXAMPLE 4

Except for changing the charging conditions as follows, evaluations were carried out in the same manner as Comparative Example 1. The results are shown in Table 1-1.

Vdc: −600 V, Vpp: 3000 V, Frequency: 1350 Hz

EXAMPLE 6

Except for changing the charging conditions as follows, evaluations were carried out in the same manner as Comparative Example 1. The results are shown in Table 1-1.

Vdc: −600 V, Vpp: 2200 V, Frequency: 1350 Hz

EXAMPLE 7

Except for changing the gap between the charging roller and the photoconductor into 10 μm, evaluations were carried out in the same manner as Example 1. The results are shown in Table 1-1.

COMPARATIVE EXAMPLE 5

Except for changing the gap between the charging roller and the photoconductor into 110 μm, evaluations were carried out in the same manner as Example 1. The results are shown in Table 1-1.

EXAMPLE 8

Except for changing the diameter of the charging roller into 6 mm, evaluations were carried out in the same manner as Example 1. The results are shown in Table 1-2.

EXAMPLE 9

Except for changing the diameter of the charging roller into 24 mm, evaluations were carried out in the same manner as Example 1. The results are shown in Table 1-2.

EXAMPLE 10

Except for changing the linear velocity of the photoconductor into 150 mm/sec, evaluations were carried out in the same manner as Example 1. The results are shown in Table 1-2.

COMPARATIVE EXAMPLE 6

Except for changing the linear velocity of the photoconductor into 350 mm/sec, evaluations were carried out in the same manner as Example 1. The results are shown in Table 1-2.

EXAMPLE 11

Except for changing the charging conditions as follows, evaluations were carried out in the same manner as Comparative Example 1. The results are shown in Table 1-2.

Vdc: −600 V, Vpp: 2400 V, Frequency: 900 Hz

COMPARATIVE EXAMPLE 7

Except for changing the charging conditions as follows, evaluations were carried out in the same manner as Comparative Example 1. The results are shown in Table 1-2.

Vdc: −600 V, Vpp: 2000 V, Frequency: 900 Hz

EXAMPLE 12

Except for changing the charging conditions as follows, evaluations were carried out in the same manner as Example 9. The results are shown in Table 1-2.

Vdc: −600 V, Vpp: 2000 V, Frequency: 1350 Hz

REFERENCE EXAMPLE 1

Except for not employing zinc stearate as the charging hazard absorber, evaluations were carried out in the same manner as Example 2. The results are shown in Table 1-2.

EXAMPLE 13

Except for removing the cleaning blade from the image forming apparatus, evaluations were carried out in the same manner as Example 2. The results are shown in Table 1-2.

EXAMPLE 14

Except for exchanging zinc stearate for solid of tetrafluoroethylene as the charging hazard absorber, evaluations were carried out in the same manner as Example 2. The results are shown in Table 1-2.

EXAMPLE 15

Except for not employing zinc stearate as the charging hazard absorber, and except for exchanging the black toner developer K-1 for the black toner developer K-2, evaluations were carried out in the same manner as Example 2. The results are shown in Table 1-2.

EXAMPLE 16

Except for not employing zinc stearate as the charging hazard absorber, and except for exchanging the black toner developer K-1 for the black toner developer K-3, evaluations were carried out in the same manner as Example 2. The results are shown in Table 1-2.

EXAMPLE 17

Except for exchanging the employed original image for that of 70% image concentration, evaluations were carried out in the same manner as Example 2. The results are shown in Table 1-3.

EXAMPLE 18

Except for exchanging the employed original image for that of 1% image concentration, evaluations were carried out in the same manner as Example 15. The results are shown in Table 1-3.

EXAMPLE 19

Except for exchanging the black toner developer K-1 for the black toner developer K-2, evaluations were carried out in the same manner as Example 17. The results are shown in Table 1-3.

EXAMPLE 20

Except for making the cleaning brush contact with the solidified zinc stearate as the charging hazard absorber as Example 2, evaluations were carried out in the same manner as Example 18. The results are shown in Table 1-3.

EXAMPLE 21

Except for providing the solidified zinc stearate member with a contacting-separating mechanism to synchronize with the power source as shown in FIG. 14, thereby making the feeding member contact only when the voltage being applied to the charging member, evaluations were carried out in the same manner as Example 2. The results are shown in Table 1-3.

EXAMPLE 22

Except for changing the environmental atmosphere for evaluations and the installed image apparatus into that of 28° C. and 80% relative humidity (RH), evaluations were carried out in the same manner as Example 2. The results are shown in Table 1-3.

EXAMPLE 23

Except for providing a shield around the charging member as shown in FIG. 15, introducing air with 23° C. and 40% RH at 0.2 liter/min into the shield when the image forming apparatus was operated, maintaining the RH in the shield 50% or less, in particular 40 to 45%, evaluations were carried out in the same manner as Example 22. The results are shown in Table 1-3.

EXAMPLE 24

Except for providing a shield around the charging member as shown in FIG. 15, introducing air with 23° C. and 40% RH (relative humidity) at 0.2 liter/min into the shield when the image forming apparatus was operated, maintaining the RH in the shield 50% or less, in particular 35 to 38° C. and 40 to 45% RH, evaluations were carried out in the same manner as Example 22. The results are shown in Table 1-3.

EXAMPLE 25

Except for providing a drum heater inside the photoconductor, and controlling the surface temperature of the photoconductor within 40±1° C. and the RH around the photoconductor about 42% RH, evaluations were carried out in the same manner as Example 20. The results are shown in Table 1-3.

EXAMPLE 26

Except for providing a shield around the charging member as shown in FIG. 15, introducing nitrogen gas with 99.9% purity at 0.1 liter/min into the shield when the image forming apparatus was operated, maintaining the oxygen concentration in the shield 10% by volume or less, in particular 5 to 8% by volume, evaluations were carried out in the same manner as Example 2. The results are shown in Table 1-3.

EXAMPLE 27

Except for providing a shield around the charging member as shown in FIG. 15, introducing nitrogen gas with 99.9% purity at 0.5 liter/min into the shield when the image forming apparatus was operated, maintaining the oxygen concentration in the shield 5% by volume or less, in particular 2 to 3% by volume, evaluations were carried out in the same manner as Example 2. The results are shown in Table 1-3.

EXAMPLE 28

Except for exchanging the photoconductor for photoconductor 2, evaluations were carried out in the same manner as Example 2. The results are shown in Table 1-3.

EXAMPLE 29

Except for exchanging the photoconductor for photoconductor 3, evaluations were carried out in the same manner as Example 2.

The results are shown in Table 1-4.

EXAMPLE 30

Except for exchanging the photoconductor for photoconductor 4, evaluations were carried out in the same manner as Example 2.

The results are shown in Table 1-4.

EXAMPLE 31

Except for exchanging the photoconductor for photoconductor 5, evaluations were carried out in the same manner as Example 21.

The results are shown in Table 1-4.

EXAMPLE 32

Except for exchanging the photoconductor for photoconductor 6, evaluations were carried out in the same manner as Example 2. The results are shown in Table 1-4.

EXAMPLE 33

Except for exchanging the photoconductor for photoconductor 7, evaluations were carried out in the same manner as Example 2.

The results are shown in Table 1-4.

EXAMPLE 34

Except for exchanging the photoconductor for photoconductor 8, evaluations were carried out in the same manner as Example 2. The results are shown in Table 1-4.

EXAMPLE 35

Except for exchanging the photoconductor for photoconductor 9, evaluations were carried out in the same manner as Example 2. The results are shown in Table 1-4.

EXAMPLE 36

Except for exchanging the photoconductor for photoconductor 10, evaluations were carried out in the same manner as Example 2. The results are shown in Table 1-4.

EXAMPLE 37

Except for exchanging the photoconductor for photoconductor 11, evaluations were carried out in the same manner as Example 2. The results are shown in Table 1-4.

EXAMPLE 38

Except for exchanging the photoconductor for photoconductor 12, evaluations were carried out in the same manner as Example 2. The results are shown in Table 1-4.

EXAMPLE 39

Except for exchanging the photoconductor for photoconductor 13, evaluations were carried out in the same manner as Example 2. The results are shown in Table 1-4.

TABLE 1-1

| | | Charging Condition | | | | Linear | Roller | Hazard | Hazard | Abrasion | | |
|---|---|---|---|---|---|---|---|---|---|---|---|---|
| | Photo- | Vpp | Freque-ncy | Vdc | Gap | Velocity | Diameter | Amount | Amount | Wear | Image | |
| | conductor | (V) | (Hz) | (−V) | (μm) | (mm/s) | (mm) | #) | ##) | (μm) | 5th | 50000th |
| Com. Ex. 1 | 1 | 2200 | 900 | 600 | 50 | 185 | 12 | 4.27 | 1.42 | 0.5 | B' | B' |
| Ex. 1 | 1 | 2200 | 1350 | 600 | 50 | 185 | 12 | 6.21 | 2.09 | 0.8 | A | A |
| Ex. 2 | 1 | 2200 | 1600 | 600 | 50 | 185 | 12 | 7.34 | 2.46 | 1.0 | A | A |
| Ex. 3 | 1 | 2200 | 2000 | 600 | 50 | 185 | 12 | 9.02 | 3.04 | 1.3 | A | A |
| Ex. 4 | 1 | 2200 | 3000 | 600 | 50 | 185 | 12 | 13.4 | 3.80 | 1.5 | A | A |
| Com. Ex. 2 | 1 | 2200 | 4000 | 600 | 50 | 185 | 12 | 17.8 | 4.54 | 1.6 | A | E |
| Com. Ex. 3 | 1 | 2000 | 1350 | 600 | 50 | 185 | 12 | 3.89 | 1.36 | 0.5 | C | C |
| Ex. 5 | 1 | 2600 | 1350 | 600 | 50 | 185 | 12 | 11.8 | 3.72 | 1.5 | A | A |
| Com. Ex. 4 | 1 | 3000 | 1350 | 600 | 50 | 185 | 12 | 18.6 | 5.50 | 1.8 | A | E |
| Ex. 6 | 1 | 2200 | 1350 | 800 | 50 | 185 | 12 | 6.32 | 2.11 | 1.0 | A | A |
| Ex. 7 | 1 | 2200 | 1350 | 600 | 10 | 185 | 12 | 6.04 | 2.26 | 1.0 | A | A |
| Com. Ex. 5 | 1 | 2200 | 1350 | 600 | 110 | 185 | 12 | 3.59 | 0.08 | 0.5 | C | C |

#) $\times 10^{14}/m^2$-mm, corresponding to Equation (1)

) hazard amount of $3 \times 10^{-19}$ Joule or more, $\times 10^{14}/m^2$-mm corresponding to Equation (2)

TABLE 1-2

| | | Charging Condition | | | | Linear | Roller | Hazard | Hazard | Abrasion | | |
|---|---|---|---|---|---|---|---|---|---|---|---|---|
| | Photo- | Vpp | Freque-ncy | Vdc | Gap | Velocity | Diameter | Amount | Amount | Wear | Image | |
| | conductor | (V) | (Hz) | (−V) | (μm) | (mm/s) | (mm) | #) | ##) | (μm) | 5th | 50000th |
| Ex. 8 | 1 | 2200 | 1350 | 600 | 50 | 185 | 6 | 4.84 | 1.61 | 0.9 | A | A |
| Ex. 9 | 1 | 2200 | 1350 | 600 | 50 | 185 | 24 | 7.65 | 2.58 | 1.1 | A | A |
| Ex. 10 | 1 | 2200 | 1350 | 600 | 50 | 150 | 12 | 7.59 | 2.56 | 1.1 | A | A |
| Com. Ex. 6 | 1 | 2200 | 1350 | 600 | 50 | 350 | 12 | 2.54 | 0.84 | 0.7 | C | C |
| Ex. 11 | 1 | 2400 | 900 | 600 | 50 | 185 | 12 | 6.00 | 1.94 | 1.0 | A | A |
| Com. Ex. 7 | 1 | 2000 | 900 | 600 | 50 | 185 | 12 | 2.71 | 0.94 | 0.5 | C | C |
| Ex. 12 | 1 | 2000 | 1350 | 600 | 50 | 185 | 24 | 4.73 | 1.66 | 1.0 | A | A |
| Ref. Ex. 1 | 1 | 2200 | 1600 | 600 | 50 | 185 | 12 | 7.34 | 2.46 | 5.3 | A | D |
| Ex. 13 | 1 | 2200 | 1600 | 600 | 50 | 185 | 12 | 7.34 | 2.46 | 2.0 | A | A |
| Ex. 14 | 1 | 2200 | 1600 | 600 | 50 | 185 | 12 | 7.34 | 2.46 | 1.1 | A | A |
| Ex. 15 | 1 | 2200 | 1600 | 600 | 50 | 185 | 12 | 7.34 | 2.46 | 1.3 | A | A |
| Ex. 16 | 1 | 2200 | 1600 | 600 | 50 | 185 | 12 | 7.34 | 2.46 | 1.5 | A | A |

#) $\times 10^{14}/m^2$-mm

) hazard amount of $3 \times 10^{-19}$ Joule or more, $\times 10^{14}/m^2$-mm

TABLE 1-3

| | Photo-conductor | Charging Condition Vpp (V) | Freque-ncy (Hz) | Vdc (−V) | Gap (μm) | Linear Velocity (mm/s) | Roller Diameter (mm) | Hazard Amount #) | Hazard Amount ##) | Abrasion Wear (μm) | Image 5th | Image 50000th |
|---|---|---|---|---|---|---|---|---|---|---|---|---|
| Ex. 17 | 1 | 2200 | 1600 | 600 | 50 | 185 | 12 | 7.34 | 2.46 | 2.8 | A | A" |
| Ex. 18 | 1 | 2200 | 1600 | 600 | 50 | 185 | 12 | 7.34 | 2.46 | 3.0 | A | A" |
| Ex. 19 | 1 | 2200 | 1600 | 600 | 50 | 185 | 12 | 7.34 | 2.46 | 1.0 | A | A |
| Ex. 20 | 1 | 2200 | 1600 | 600 | 50 | 185 | 12 | 7.34 | 2.46 | 1.0 | A | A |
| Ex. 21 | 1 | 2200 | 1600 | 600 | 50 | 185 | 12 | 7.34 | 2.46 | 1.0 | A | A |
| Ex. 22 | 1 | 2200 | 1600 | 600 | 50 | 185 | 12 | 7.34 | 2.46 | 1.0 | A | A' |
| Ex. 23 | 1 | 2200 | 1600 | 600 | 50 | 185 | 12 | 7.34 | 2.46 | 1.0 | A | A |
| Ex. 24 | 1 | 2200 | 1600 | 600 | 50 | 185 | 12 | 7.34 | 2.46 | 1.0 | A | A |
| Ex. 25 | 1 | 2200 | 1600 | 600 | 50 | 185 | 12 | 7.34 | 2.46 | 1.0 | A | A |
| Ex. 26 | 1 | 2200 | 1600 | 600 | 50 | 185 | 12 | 7.34 | 2.46 | 0.7 | A | A |
| Ex. 27 | 1 | 2200 | 1600 | 600 | 50 | 185 | 12 | 7.34 | 2.46 | 0.5 | A | A |
| Ex. 28 | 2 | 2200 | 1600 | 600 | 50 | 185 | 12 | 5.50 | 1.84 | 0.8 | A | A |

#) $\times 10^{14}/m^2$-mm
) hazard amount of $3 \times 10^{-19}$ Joule or more, $\times 10^{14}/m^2$-mm

TABLE 1-4

| | Photo-conductor | Charging Condition Vpp (V) | Freque-ncy (Hz) | Vdc (−V) | Gap (μm) | Linear Velocity (mm/s) | Roller Diameter (mm) | Hazard Amount #) | Hazard Amount ##) | Abrasion Wear (μm) | Image 5th | Image 50000th |
|---|---|---|---|---|---|---|---|---|---|---|---|---|
| Ex. 29 | 3 | 2200 | 1600 | 600 | 50 | 185 | 12 | 4.51 | 1.55 | 0.5 | A | A |
| Ex. 30 | 4 | 2200 | 1600 | 600 | 50 | 185 | 12 | 7.34 | 2.46 | 0.8 | A | A |
| Ex. 31 | 5 | 2200 | 1600 | 600 | 50 | 185 | 12 | 7.34 | 2.46 | 0.6 | A | A |
| Ex. 32 | 6 | 2200 | 1600 | 600 | 50 | 185 | 12 | 7.34 | 2.46 | 0.5 | A | A |
| Ex. 33 | 7 | 2200 | 1600 | 600 | 50 | 185 | 12 | 7.34 | 2.46 | 0.7 | A | A |
| Ex. 34 | 8 | 2200 | 1600 | 600 | 50 | 185 | 12 | 7.34 | 2.46 | 0.6 | A | A |
| Ex. 35 | 9 | 2200 | 1600 | 600 | 50 | 185 | 12 | 7.34 | 2.46 | 0.6 | A | B |
| Ex. 36 | 10 | 2200 | 1600 | 600 | 50 | 185 | 12 | 7.34 | 2.46 | 1.0 | A | A' |
| Ex. 37 | 11 | 2200 | 1600 | 600 | 50 | 185 | 12 | 7.34 | 2.46 | 1.0 | A' | B |
| Ex. 38 | 12 | 2200 | 1600 | 600 | 50 | 185 | 12 | 7.34 | 2.46 | 0.5 | A | A |
| Ex. 39 | 13 | 2200 | 1600 | 600 | 50 | 185 | 12 | 7.34 | 2.46 | 0.4 | A | A |

#) $\times 10^{14}/m^2$-mm
) hazard amount of $3 \times 10^{-19}$ Joule or more, $\times 10^{14}/m^2$-mm The two terms "hazard amount" in Table 1-1 to 1-4 means [(Number of Charged Particles)/(Perimeter of Photoconductor)], and [(Number of Charged Particles Having Energy of $3\times10^{-19}$ (Joule) or more)/(Perimeter of Photoconductor)] obtained from Equations (1) and (2) respectively.

In the Tables 1-1 to 1-4 and 2-1 to 2-4, the images of 5 th sheet and 50000 th sheet were evaluated as follows.

A: good

A': very slight occurrences of image blur, or very slight decrease of image concentration A": very slight streak B: slight occurrences of image blur, or slight decrease of image concentration B': slight occurrences of image nonuniformity C: occurrences of charging nonuniformity, or occurrences of color nonuniformity D: occurrences of streak and void E: inferior develop due to adhesion of charging hazard absorber.

By the way, the consumed amount of zinc stearate in Example 21 was two-thirds as much as that of Example 2.

COMPARATIVE EXAMPLE 8

The photoconductor 14 was set in the cartridge shown in FIG. 16 to prepare four image-forming elements (Y, M, C, K), and the cartridge of the image-forming elements was mounted on the full-color image-forming apparatus as shown in FIG. 17. The black toner developer K-1, yellow toner developer Y-1, magenta toner developer M-1, and cyan toner developer C-1were poured into the color-developing portions of the image-forming elements, resulting in minus charging of the respective toners and reverse developing at light-writing image portions. As for the charging member, the non-contacting charging roller as shown in FIG. 13 was employed, wherein the diameter was 12 mm, the resistivity at the surface layer was $1.0\times10^5$ Ω·cm$^2$, the specific dielectric constant was 2.5, the gap between the roller surface and the photoconductor surface was 50 μm, and the charging was performed with superimposed AC while controlling the surface potential to −600 V at the non-light exposing portion of the photoconductor (DC bias: −700V, AC bias: 2200 V (peak to peak), frequency: 900 Hz). Further, the cleaning member of the image forming apparatus shown in FIG. 17 was constructed by the combination of a cleaning brush and cleaning blade as shown in FIG. 14, a member formed with solidified zinc stearate as the charging hazard absorber was brought into contact with the cleaning brush, thereby the charging hazard absorber was coated to the photoconductor surface by means of the cleaning brush.

As for the exposing light source for forming images, LD (semiconductor laser) of 780 nm (beam diameter 50 μm at the photoconductor surface) was utilized, the writing was carried out in a writing density of 600 dpi. The irradiation energy was 4.5 erg at the solid image portion. The respective developing were carried out in non-contacting condition. A scoroton charger was employed as the transfer charging member, and the transferring current was controlled to 35 μA. A blade made of urethane rubber was utilized for the cleaning member.

The linear velocity was set 185 mm/sec, 50000 sheets of images were formed using an original image of A4 size on which oblique lattice was described with 6% of writing proportion, and the images of 5 th sheet and 50000 th sheet were evaluated. After the output of 50000 sheets, a white solid image was output. In addition, the photoconductor was removed from the cartridge the distribution of the film thickness was measured in the longitudinal direction of photoconductor that was utilized for the image forming element in which the cyan developer was set. The experiment was conducted in an ambient environment of 22° C. and 50% RH. The results were summarized in Table 2-1.

EXAMPLE 40

Except for changing the charging conditions as follows, evaluations were carried out in the same manner as Comparative Example 8. The results are shown in Table 2-1.

Vdc: −700 V, Vpp: 2200 V, Frequency: 1350 Hz

EXAMPLE 41

Except for changing the charging conditions as follows, evaluations were carried out in the same manner as Comparative Example 8. The results are shown in Table 2-1.

Vdc: −700 V, Vpp: 2200 V, Frequency: 1600 Hz

EXAMPLE 42

Except for changing the charging conditions as follows, evaluations were carried out in the same manner as Comparative Example 8. The results are shown in Table 2-1.

Vdc: −700 V, Vpp: 2200 V, Frequency: 2000 Hz

EXAMPLE 43

Except for changing the charging conditions as follows, evaluations were carried out in the same manner as Comparative Example 8. The results are shown in Table 2-1.

Vdc: −700 V, Vpp: 2200V, Frequency: 3000 Hz

COMPARATIVE EXAMPLE 9

Except for changing the charging conditions as follows, evaluations were carried out in the same manner as Comparative Example 8. The results are shown in Table 2-1.

Vdc: −700 V, Vpp: 2200 V, Frequency: 4000 Hz

COMPARATIVE EXAMPLE 10

Except for changing the charging conditions as follows, evaluations were carried out in the same manner as Comparative Example 8. The results are shown in Table 2-1.

Vdc: −700 V, Vpp: 2000 V, Frequency: 1350 Hz

EXAMPLE 44

Except for changing the charging conditions as follows, evaluations were carried out in the same manner as Comparative Example 8. The results are shown in Table 2-1.

Vdc: −700 V, Vpp: 2600 V, Frequency: 1350 Hz

COMPARATIVE EXAMPLE 11

Except for changing the charging conditions as follows, evaluations were carried out in the same manner as Comparative Example 8. The results are shown in Table 2-1.

Vdc: −700 V, Vpp: 3000V, Frequency: 1350 Hz

EXAMPLE 45

Except for changing the charging conditions as follows, evaluations were carried out in the same manner as Comparative Example 8. The results are shown in Table 2-1.

Vdc: −850V, Vpp: 2200V, Frequency: 1350 Hz

EXAMPLE 46

Except for changing the gap between the charging roller and the photoconductor into 10 μm, evaluations were carried out in the same manner as Example 40. The results are shown in Table 2-1.

COMPARATIVE EXAMPLE 12

Except for changing the gap between the charging roller and the photoconductor into 110 μm, evaluations were carried out in the same manner as Example 40. The results are shown in Table 2-1.

EXAMPLE 47

Except for changing the diameter of the charging roller into 6 mm, evaluations were carried out in the same manner as Example 40. The results are shown in Table 2-1.

EXAMPLE 48

Except for changing the diameter of the charging roller into 24 mm, evaluations were carried out in the same manner as Example 40. The results are shown in Table 2-1.

EXAMPLE 49

Except for changing the linear velocity of the photoconductor into 150 mm/sec, evaluations were carried out in the same manner as Example 40. The results are shown in Table 2-1.

COMPARATIVE EXAMPLE 13

Except for changing the linear velocity of the photoconductor into 350 mm/sec, evaluations were carried out in the same manner as Example 40. The results are shown in Table 2-1.

EXAMPLE 50

Except for changing the charging conditions as follows, evaluations were carried out in the same manner as Comparative Example 8. The results are shown in Table 2-2.

Vdc: −600 V, Vpp: 2400 V, Frequency: 900 Hz

COMPARATIVE EXAMPLE 14

Except for changing the charging conditions as follows, evaluations were carried out in the same manner as Comparative Example 8. The results are shown in Table 2-2.

Vdc: −600 V, Vpp: 2000 V, Frequency: 900 Hz

EXAMPLE 51

Except for changing the charging conditions as follows, evaluations were carried out in the same manner as Example 48. The results are shown in Table 2-2.

Vdc: −600 V, Vpp: 2000 V, Frequency: 1350 Hz

REFERENCE EXAMPLE 2

Except for not employing zinc stearate as the charging hazard absorber, evaluations were carried out in the same manner as Example 41. The results are shown in Table 2-2.

EXAMPLE 52

Except for removing the cleaning blade from the image forming apparatus, evaluations were carried out in the same manner as Example 41. The results are shown in Table 2-2.

EXAMPLE 53

Except for exchanging zinc stearate for solid of tetrafluoroethylene as the charging hazard absorber, evaluations were carried out in the same manner as Example 41. The results are shown in Table 2-2.

EXAMPLE 54

Except for not employing zinc stearate as the charging hazard absorber, and except for exchanging the black toner developer K-1, yellow toner developer Y-1, magenta toner developer M-1, and cyan toner developer C-1 for the black toner developer K-2, yellow toner developer Y-2, magenta toner developer M-2, and cyan toner developer C-2, evaluations were carried out in the same manner as Example 41. The results are shown in Table 2-2.

EXAMPLE 55

Except for not employing zinc stearate as the charging hazard absorber, and except for exchanging the black toner developer K-1, yellow toner developer Y-1, magenta toner developer M-1, and cyan toner developer C-1 for the black toner developer K-3, yellow toner developer Y-3, magenta toner developer M-3, and cyan toner developer C-3, evaluations were carried out in the same manner as Example 41. The results are shown in Table 2-2.

EXAMPLE 56

Except for exchanging the employed original image for that of 70% image concentration, evaluations were carried out in the same manner as Example 41. The results are shown in Table 2-2.

EXAMPLE 57

Except for exchanging the employed original image for that of 1% image concentration, evaluations were carried out in the same manner as Example 54. The results are shown in Table 2-2.

EXAMPLE 58

Except for the black toner developer K-1, yellow toner developer Y-1, magenta toner developer M-1, and cyan toner developer C-1 for the black toner developer K-2, yellow toner developer Y-2, magenta toner developer M-2, and cyan toner developer C-2, evaluations were carried out in the same manner as Example 56. The results are shown in Table 2-2.

EXAMPLE 59

Except for making the cleaning brush contact with the solidified zinc stearate as the charging hazard absorber as Example 2, evaluations were carried out in the same manner as Example 57. The results are shown in Table 2-2.

EXAMPLE 60

Except for providing the solidified zinc stearate member with a contacting-separating mechanism to synchronize with the power source as shown in FIG. 14, thereby making the feeding member contact only when the voltage being applied to the charging member, evaluations were carried out in the same manner as Example 41. The results are shown in Table 2-2.

EXAMPLE 61

Except for exchanging the photoconductor for photoconductor 15, evaluations were carried out in the same manner as Example 41. The results are shown in Table 2-2.

EXAMPLE 62

Except for exchanging the photoconductor for photoconductor 16, evaluations were carried out in the same manner as Example 41. The results are shown in Table 2-2.

EXAMPLE 63

Except for exchanging the photoconductor for photoconductor 17, evaluations were carried out in the same manner as Example 41. The results are shown in Table 2-2.

TABLE 2-1

| | | Charging Condition | | | | Linear | Roller | Hazard | Hazard | Abrasion | | |
|---|---|---|---|---|---|---|---|---|---|---|---|---|
| | Photo- | Vpp | Freque-ncy | Vdc | Gap | Velocity | Diameter | Amount | Amount | Wear | Image | |
| | conductor | (V) | (Hz) | (−V) | (μm) | (mm/s) | (mm) | #) | ##) | (μm) | 5th | 50000th |
| Com. Ex. 8 | 14 | 2200 | 900 | 700 | 50 | 185 | 12 | 4.27 | 1.42 | 0.5 | C | C |
| Ex. 40 | 14 | 2200 | 1350 | 700 | 50 | 185 | 12 | 6.21 | 2.09 | 0.8 | A | A |

TABLE 2-1-continued

| | Photo-conductor | Charging Condition Vpp (V) | Freque-ncy (Hz) | Vdc (−V) | Gap (μm) | Linear Velocity (mm/s) | Roller Diameter (mm) | Hazard Amount #) | Hazard Amount ##) | Abrasion Wear (μm) | Image 5th | Image 50000th |
|---|---|---|---|---|---|---|---|---|---|---|---|---|
| Ex. 41 | 14 | 2200 | 1600 | 700 | 50 | 185 | 12 | 7.34 | 2.46 | 1.0 | A | A |
| Ex. 42 | 14 | 2200 | 2000 | 700 | 50 | 185 | 12 | 9.02 | 3.04 | 1.3 | A | A |
| Ex. 43 | 14 | 2200 | 3000 | 700 | 50 | 185 | 12 | 13.4 | 3.80 | 1.5 | A | A |
| Com. Ex. 9 | 14 | 2200 | 4000 | 700 | 50 | 185 | 12 | 17.8 | 4.54 | 1.6 | A | E |
| Com. Ex. 10 | 14 | 2000 | 1350 | 700 | 50 | 185 | 12 | 3.89 | 1.36 | 0.5 | C | C |
| Ex. 44 | 14 | 2600 | 1350 | 700 | 50 | 185 | 12 | 11.8 | 3.72 | 1.5 | A | A |
| Com. Ex. 11 | 14 | 3000 | 1350 | 700 | 50 | 185 | 12 | 18.6 | 5.50 | 2.0 | A | E |
| Ex. 45 | 14 | 2200 | 1350 | 850 | 50 | 185 | 12 | 6.32 | 2.11 | 1.0 | A | A |
| Ex. 46 | 14 | 2200 | 1350 | 700 | 10 | 185 | 12 | 6.04 | 2.26 | 1.0 | A | A |
| Com. Ex. 12 | 14 | 2200 | 1350 | 700 | 110 | 185 | 12 | 0.36 | 0.80 | 0.5 | C | C |
| Ex. 47 | 14 | 2200 | 1350 | 700 | 50 | 185 | 6 | 4.84 | 1.61 | 0.9 | A | A |
| Ex. 48 | 14 | 2200 | 1350 | 700 | 50 | 185 | 24 | 7.65 | 2.58 | 1.1 | A | A |
| Ex. 49 | 14 | 2200 | 1350 | 700 | 50 | 150 | 12 | 7.59 | 2.56 | 1.1 | A | A |
| Com. Ex. 13 | 14 | 2200 | 1350 | 700 | 50 | 350 | 12 | 2.54 | 0.84 | 0.7 | C | C |

#) $\times 10^{14}/m^2$-mm
) hazard amount of $3 \times 10^{-19}$ Joule or more, $\times 10^{14}/m^2$-mm

TABLE 2-2

| | Photo-conductor | Charging Condition Vpp (V) | Freque-ncy (Hz) | Vdc (−V) | Gap (μm) | Linear Velocity (mm/s) | Roller Diameter (mm) | Hazard Amount #) | Hazard Amount ##) | Abrasion Wear (μm) | Image 5th | Image 50000th |
|---|---|---|---|---|---|---|---|---|---|---|---|---|
| Ex. 50 | 1 | 2400 | 900 | 600 | 50 | 185 | 12 | 6.00 | 1.94 | 1.0 | | |
| Com. Ex. 14 | 1 | 2000 | 900 | 600 | 50 | 185 | 12 | 2.71 | 0.94 | 0.5 | | |
| Ex. 51 | 1 | 2000 | 1350 | 600 | 50 | 185 | 24 | 4.73 | 1.66 | 1.0 | | |
| Ref. Ex. 2 | 14 | 2200 | 1600 | 700 | 50 | 185 | 12 | 7.34 | 2.46 | 5.3 | A | D |
| Ex. 52 | 14 | 2200 | 1600 | 700 | 50 | 185 | 12 | 7.34 | 2.46 | 2.0 | A | A |
| Ex. 53 | 14 | 2200 | 1600 | 700 | 50 | 185 | 12 | 7.34 | 2.46 | 1.1 | A | A |
| Ex. 54 | 14 | 2200 | 1600 | 700 | 50 | 185 | 12 | 7.34 | 2.46 | 1.3 | A | A |
| Ex. 55 | 14 | 2200 | 1600 | 700 | 50 | 185 | 12 | 7.34 | 2.46 | 1.5 | A | A" |
| Ex. 56 | 14 | 2200 | 1600 | 700 | 50 | 185 | 12 | 7.34 | 2.46 | 2.8 | A | A" |
| Ex. 57 | 14 | 2200 | 1600 | 700 | 50 | 185 | 12 | 7.34 | 2.46 | 3.0 | A | A |
| Ex. 58 | 14 | 2200 | 1600 | 700 | 50 | 185 | 12 | 7.34 | 2.46 | 1.0 | A | A |
| Ex. 59 | 14 | 2200 | 1600 | 700 | 50 | 185 | 12 | 7.34 | 2.46 | 1.0 | A | A |
| Ex. 60 | 14 | 2200 | 1600 | 700 | 50 | 185 | 12 | 7.34 | 2.46 | 1.0 | A | A' |
| Ex. 61 | 15 | 2200 | 1600 | 700 | 50 | 185 | 12 | 7.34 | 2.46 | 1.0 | A' | B |
| Ex. 62 | 16 | 2200 | 1600 | 700 | 50 | 185 | 12 | 7.34 | 2.46 | 1.0 | A | A |
| Ex. 63 | 17 | 2200 | 1600 | 700 | 50 | 185 | 12 | 7.34 | 2.46 | 1.0 | A | A |

#) $\times 10^{14}/m^2$-mm
) hazard amount of $3 \times 10^{-19}$ Joule or more, $\times 10^{14}/m^2$-mm The two terms "hazard amount" in Table 2-1 to 2-4 refer to [(Number of Charged Particles)/(Perimeter of Photoconductor)], and [(Number of Charged Particles Having Energy of $3\times10^{-19}$ (Joule) or more)/(Perimeter of Photoconductor)] obtained from Equations (1) and (2) respectively.

By the way, the consumed amount of zinc stearate in Example 60 was two-thirds as much as that of Example 41. The image of Example 63 showed remarkably lower background smear compared with that of Example 41.

In accordance with the present invention, the charging hazard amount on the photoconductor may be ascertained with time without various trial and error experiments, thereby the charging uniformity and the abrasion wear of the photoconductor may be estimated, making possible to design the charging condition successfully.

Further, applying the present invention, that is, adjusting the number of charged particles collided to the photoconductor surface at the nip portion, absorbing the charging hazard due to the charged particles and decreasing the adverse effects on the photoconductor surface in the image forming apparatus in which charging is carried out through a direct voltage superimposed an alternating voltage, the trade off of the charging uniformity and the charging hazard decrease may be resolved, therefore, the image forming apparatus, image forming process and process cartridge may be provided that forms high quality images stably without causing significant abrasion wear of the photoconductor even after the prolonged and repeated usage thereof.

What is claimed is:

1. An image forming apparatus comprising:

a photoconductor, a latent electrostatic image forming unit which comprises a charging member configured to charge the photoconductor surface and an exposing member configured to irradiate light on the charged photoconductor surface, a developing unit configured to develop the latent electrostatic image by means of a toner to form a visible image, a transferring unit configured to transfer the visible image on a recording medium, and a fixing unit configured to fix the transferred image on the recording medium, wherein, the charging member is of roller shape disposed proximate to the photoconductor, the photoconductor is charged at the charging nip portion formed between the photoconductor and the charging member, in a condition that satisfies the following Equation (1), $$4.4\times10^{14}/m^2\text{-mm} \leqq [(\text{Number of Charged Particles}) \div (\text{circumferential length of the photoconductor})] \leqq 17.7\times10^{14}/m^2\text{-mm} \quad \text{Equation (1):}$$

wherein the "Number of Charged Particles" refers to the number of charged particles accepted by the photoconductor surface per its unit surface area from the operated charging member, while the photoconductor rotates one round, thus the unit is [number/$m^2$]; and the unit of "circumferential length of the photoconductor" is [mm].

2. The image forming apparatus according to claim 1, wherein the photoconductor is charged by the charging member to which a direct voltage is applied and an alternative voltage is superimposed on the direct voltage.

3. The image forming apparatus according to claim 1, wherein the photoconductor is charged in a condition that satisfies the following Equation (2), $$1.5\times10^{14}/m^2\text{-mm} \leqq [(\text{Number of Charged Particles having kinetic energy of } 3\times10^{-19} \text{ Joule or more}) \div (\text{circumferential length of the photoconductor})] \leqq 4.4\times10^{14}/m^2\text{-mm} \quad \text{Equation (2):}$$

wherein the "Number of Charged Particles having kinetic energy of $3\times10^{-19}$ Joule or more" refers to the number of charged particles accepted by the photoconductor surface per its unit surface area from the operated charging member, while the photoconductor rotates one round, and also the kinetic energy of each particle is $3\times10^{-19}$ Joule/number or more, thus the unit is [number/$m^2$]; and the unit of "circumferential length of the photoconductor" is [mm].

4. The image forming apparatus according to claim 1, wherein the gap at the charging nip portion is 10 to 100 μm.

5. The image forming apparatus according to claim 1, wherein the image forming apparatus further comprises a feeding unit configured to feed charging hazard absorber to the photoconductor.

6. The image forming apparatus according to claim 5, wherein the feeding unit configured to feed charging hazard absorber is brought into contact with the photoconductor.

7. The image forming apparatus according to claim 5, wherein the feeding unit configured to feed charging hazard absorber is of brush-like shape.

8. The image forming apparatus according to claim 7, wherein the feeding unit configured to feed charging hazard absorber comprises one of a brush-like member and a developing unit, and a blade-like member.

9. The image forming apparatus according to claim 5, wherein the feeding unit configured to feed charging hazard absorber is incorporated into the developing unit configured to develop the latent electrostatic image.

10. The image forming apparatus according to claim 9, wherein the feeding unit configured to feed charging hazard absorber comprises a brush-like member and a developing unit.

11. The image forming apparatus according to claim 5, wherein the feeding unit configured to feed charging hazard absorber is provided with such a contacting and separating mechanism that the feeding unit is separated from the photoconductor while the photoconductor is not charged from the charging member, and the feeding unit is brought into contact with the photoconductor while the photoconductor is charged from the charging member.

12. The image forming apparatus according to claim 5, wherein the charging hazard absorber is a substance selected from waxes and lubricants.

13. The image forming apparatus according to claim 12, wherein the lubricant is zinc stearate.

14. The image forming apparatus according to claim 1, wherein the charging nip portion is covered by a shield, and the relative humidity of the atmosphere at the charging nip portion is controlled 50% or less.

15. The image forming apparatus according to claim 14, wherein the relative humidity of the atmosphere at the charging nip portion is controlled 50% or less, through introducing a gas of which relative humidity is 50% or less.

16. The image forming apparatus according to claim 14, wherein the relative humidity of the atmosphere at the charging nip portion is controlled 50% or less, through introducing a gas of which temperature is higher than the room temperature.

17. The image forming apparatus according to claim 14, wherein the oxygen concentration inside the shield is 10 volume % or less.

18. The image forming apparatus according to claim 17, wherein the oxygen concentration of the atmosphere at the charging nip portion is controlled 10 volume % or less, through introducing a gas from outside of which oxygen concentration is 10 volume % or less.

19. The image forming apparatus according to claim 18, wherein the gas introduced from outside is inactive gas selected from at least one of nitrogen gas, argon gas, and helium gas.

20. The image forming apparatus according to claim 1, wherein a heating unit is disposed inside the photoconductor, and the relative humidity of the atmosphere at the charging nip portion is controlled 50% or less, through the action of the heating unit.

21. The image forming apparatus according to claim 1, wherein the photoconductor comprises a support and a photoconductive layer on the support, and the photoconductive layer comprises a polymer of charge-transporting substance.

22. The image forming apparatus according to claim 21, wherein the polymer of charge-transporting substance is a polycarbonate resin having a triaryl amine structure at least in the backbone chain or side chain.

23. The image forming apparatus according to claim 21, wherein the photoconductor comprises a protective layer on the photoconductive layer.

24. The image forming apparatus according to claim 23, wherein the protective layer comprises a substance selected from inorganic pigments and metal oxides of which specific resistance is $10^{10}$ Ω·cm or more.

25. The image forming apparatus according to claim 24, wherein the metal oxide is at least one of alumina, titanium oxide, and silica.

26. The image forming apparatus according to claim 25, wherein the metal oxide is α-alumina.

27. The image forming apparatus according to claim 23, wherein the protective layer comprises a polymer of charge-transporting substance.

28. The image forming apparatus according to claim 23, wherein the protective layer comprises a binder resin, and the binder resin have a cross-linked structure.

29. The image forming apparatus according to claim 28, wherein at least a charge transferring site exists in the binder resin having the cross-linked structure.

30. The image forming apparatus according to claim 21, wherein the support surface of the photoconductor is subjected to anodic oxide coating.

31. The image forming apparatus according to claim 1, wherein the photoconductor comprises a charge-generating substance of an azo pigment expressed by the following Formula (XI):

Formula (XI)

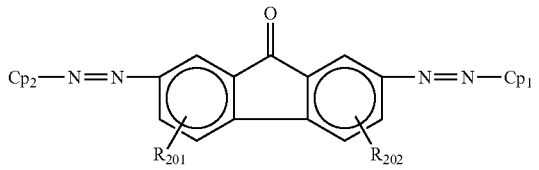

in the Formula (XI), $R_{201}$, $R_{202}$ may be identical or different, may be hydrogen atom, halogen atom, cyano group, alkyl group that may be substituted, or alkoxy group that may be substituted; Cp1 and Cp2 are coupler residues that may be identical or different, being expressed by the following Formula (XII), Formula (XII)

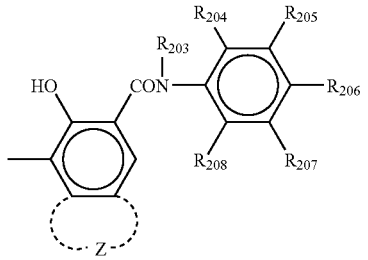

in Formula (XII), $R_{203}$ is an alkyl group that may be substituted or an aryl group that may be substituted; $R_{204}$, $R_{205}$, $R_{206}$ $R_{207}$, and $R_{208}$ may be identical or different, may be hydrogen atom, nitro group, cyano group, halogen atom, trifluoromethyl group, hydroxy group, alkyl group that may be substituted, alkoxy group that may be substituted, or dialkylamino group that may be substituted; and Z is an aromatic carbon ring that may be substituted, or an aromatic hetero ring that may be substituted.

32. The image forming apparatus according to claim 31, wherein Cp1 and Cp2 are coupler residues different each other.

33. The image forming apparatus according to claim 31, wherein the charge-generating substance is a titanyl phthalocyanine that shows a X-ray diffraction spectrum with a maximum peak at 27.2±0.2° in terms of Bragg (2θ) angles to the CuK-α characteristic X-ray wavelength at 1.542 Å.

34. The image forming apparatus according to claim 33, wherein the titanyl phthalocyanine shows a X-ray diffraction spectrum with main peaks at 9.4°, 9.6°, and 24.0° in addition and a peak as a lowest-angle peak at 7.3° and with no peaks in a range between 7.3° and 9.4°, and at 26.3° in terms of Bragg (2θ) angles to the CuK-α characteristic X-ray wavelength at 1.542 Å.

35. The image forming apparatus according to claim 1, comprising a plurality of image forming elements to form a tandem type apparatus, wherein the respective image forming elements comprising:

the photoconductor, the latent electrostatic image forming unit comprising the charging member configured to charge the photoconductor surface and the exposing member configured to irradiate light on the charged photoconductor surface, the developing unit configured to develop the latent electrostatic image by means of a toner to form a visible image, and the transferring unit configured to transfer the visible image on the recording medium.

36. The image forming apparatus according to claim 1, mounting a process cartridge in an attachable and detachable fashion, wherein the process cartridge comprises the photoconductor, and the latent electrostatic image forming unit comprising the charging member configured to charge the photoconductor surface and the exposing member configured to irradiate light on the charged photoconductor surface, wherein the process cartridge further comprises at least one of the developing unit configured to develop the latent electrostatic image by means of a toner to form a visible image, the transferring unit configured to transfer the visible image on the recording medium, and the cleaning unit configured to clean the toner remaining on the photoconductor.

37. An image forming process comprising:

forming a latent electrostatic image on a photoconductor surface through charging the photoconductor surface and irradiating light on the charged photoconductor surface, developing the latent electrostatic image to form a visible image by means of a toner, transferring the visible image on a recording medium, and fixing the image transferred on the recording medium, wherein, the charging member is of roller shape disposed proximate to the photoconductor, the photoconductor is charged at the charging nip portion formed between the photoconductor and the charging member, in a condition that satisfies the following Equation (1), $$4.4\times10^{14}/m^2\text{-mm} \leqq [(\text{Number of Charged Particles}) \div (\text{circumferential length of the photoconductor})] \leqq 17.7\times10^{14}/m^2\text{-mm} \quad \text{Equation (1):}$$

wherein the "Number of Charged Particles" refers to the number of charged particles accepted by the photoconductor surface per its unit surface area from the operated charging member, while the photoconductor rotates one round, thus the unit is [number/$m^2$]; and the unit of "circumferential length of the photoconductor" is [mm].

38. The image forming process according to claim 37, the photoconductor is charged by the charging member to which a direct voltage is applied and an alternative voltage is superimposed on the direct voltage.

39. The image forming process according to claim 37, wherein the photoconductor is charged in a condition that satisfies the following Equation (2), $$1.5\times10^{14}/m^2\text{-mm} \leqq [(\text{Number of Charged Particles having kinetic energy of } 3\times10^{-19} \text{ Joule or more}) \div (\text{circumferential length of the photoconductor})] \leqq 4.4\times10^{14}/m^2\text{-mm} \quad \text{Equation (2):}$$

wherein the "Number of Charged Particles having kinetic energy of $3\times10^{-19}$ Joule or more" refers to the number of charged particles accepted by the photoconductor surface per its unit surface area from the operated charging member, while the photoconductor rotates one round, and also the kinetic energy of each particle is $3\times10^{-19}$ Joule/number or more, thus the unit is [number/$m^2$]; and the unit of "circumferential length of the photoconductor" is [mm].

40. The image forming process according to claim 37, further comprising feeding charging hazard absorber to the photoconductor.

41. A process cartridge comprising:

a photoconductor, a latent electrostatic image forming unit which comprises a charging member configured to charge the photoconductor surface and an exposing member configured to irradiate light on the charged photoconductor surface, and at least one of:

a developing unit configured to develop the latent electrostatic image by means of a toner to form a visible image, a transferring unit configured to transfer the visible image on a recording medium, and a cleaning unit configured to clean the toner remaining on the photoconductor, wherein, the charging member is of roller shape disposed proximate to the photoconductor, the photoconductor is charged at the charging nip portion formed between the photoconductor and the charging member, in a condition that satisfies the following Equation (1), $$4.4\times10^{14}/m^2\text{-mm} \leqq [(\text{Number of Charged Particles}) \div (\text{circumferential length of the photoconductor})] \leqq 17.7\times10^{14}/m^2\text{-mm} \quad \text{Equation (1):}$$

wherein the "Number of Charged Particles" refers to the number of charged particles accepted by the photoconductor surface per its unit surface area from the operated charging member, while the photoconductor rotates one round, thus the unit is [number/$m^2$]; and the unit of "circumferential length of the photoconductor" is [mm].

42. The process cartridge according to claim 41, the photoconductor is charged by the charging member to which a direct voltage is applied and an alternative voltage is superimposed on the direct voltage.

43. The process cartridge according to claim 41, wherein the photoconductor is charged in a condition that satisfies the following Equation (2), $$1.5\times10^{14}/m^2\text{-mm} \leqq [(\text{Number of Charged Particles having kinetic energy of } 3\times10^{-19} \text{ Joule or more}) \div (\text{circumferential length of the photoconductor})] \leqq 4.4\times10^{14}/m^2\text{-mm} \quad \text{Equation (2):}$$

wherein the "Number of Charged Particles having kinetic energy of $3\times10^{-19}$ Joule or more" refers to the number of charged particles accepted by the photoconductor surface per its unit surface area from the operated charging member, while the photoconductor rotates one round, and also the kinetic energy of each particle is $3\times10^{-19}$ Joule/number or more, thus the unit is [number/$m^2$]; and the unit of "circumferential length of the photoconductor" is [mm].

44. The process cartridge according to claim 41, further comprising a feeding unit configured to feed charging hazard absorber to the photoconductor.

* * * * *